US007079101B1

(12) United States Patent
Asada

(10) Patent No.: US 7,079,101 B1
(45) Date of Patent: Jul. 18, 2006

(54) LIQUID CRYSTAL DISPLAY DEVICE AND DRIVING METHOD THEREFOR

(75) Inventor: Hideki Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 56 days.

(21) Appl. No.: 09/290,579

(22) Filed: Apr. 13, 1999

(30) Foreign Application Priority Data

May 13, 1998 (JP) ..... 10-130558

(51) Int. Cl.
*G09G 3/36* (2006.01)

(52) U.S. Cl. ..... 345/92; 345/87; 345/90

(58) Field of Classification Search ..... 345/87, 345/90, 92, 205; 349/42, 48
See application file for complete search history.

(56) References Cited

U.S. PATENT DOCUMENTS

| | | | | |
|---|---|---|---|---|
| 5,194,974 | A * | 3/1993 | Hamada et al. | 349/48 |
| 5,627,557 | A * | 5/1997 | Yamaguchi et al. | 345/90 |
| 5,828,429 | A * | 10/1998 | Takemura | 349/42 |
| 5,844,538 | A * | 12/1998 | Shiraki et al. | 345/98 |
| 5,903,249 | A * | 5/1999 | Koyama et al. | 345/92 |
| 6,064,362 | A * | 5/2000 | Brownlow et al. | 345/98 |

FOREIGN PATENT DOCUMENTS

| | | |
|---|---|---|
| JP | 56-43679 | 4/1981 |
| JP | 58-140781 | 8/1983 |
| JP | 59-119379 | 7/1984 |
| JP | 60-26991 | 2/1985 |
| JP | 60-169837 | 9/1985 |
| JP | 61-166172 | 7/1986 |
| JP | 61-267734 | 11/1986 |
| JP | 62-65375 | 3/1987 |
| JP | 1-292979 | 11/1989 |
| JP | 2-138728 | 11/1990 |
| JP | 2-272521 | 11/1990 |
| JP | 3-77915 | 4/1991 |
| JP | 3-77922 | 4/1991 |
| JP | 3-229221 | 10/1991 |
| JP | 5-119352 | 5/1993 |
| JP | 5-173175 | 7/1993 |
| JP | 7-20820 | 1/1995 |
| JP | 07-064051 | 3/1995 |
| JP | 9-5794 | 1/1997 |
| JP | 9-138428 | 5/1997 |
| JP | 9-304791 | 11/1997 |
| JP | 9-329806 | 12/1997 |
| JP | 10-148848 | 6/1998 |
| JP | 11-271713 | 10/1999 |
| TW | 83213065 | 6/1995 |

* cited by examiner

*Primary Examiner*—Guy Lamarre
*Assistant Examiner*—Fritz Alphonse
(74) *Attorney, Agent, or Firm*—Young & Thompson

(57) ABSTRACT

A liquid crystal display device which performs a gradation display for each frame, by eliminating fluctuations in pixel voltage. The device includes a pixel electrode and a MOS transistor circuit driving the pixel electrode. The MOS transistor circuit is disposed near a cross-over point of a scanning line and a signal line, and includes a first MOS transistor having a gate electrode connected to the scanning line, and one of a source electrode and a drain electrode connected to the signal line. The MOS transistor circuit also includes a source follower type analog amplifier having an input electrode connected to the other one of the source and drain electrodes of the MOS transistor, one of plural power supply electrodes connected to the scanning line, and an output electrode connected to the pixel electrode.

5 Claims, 43 Drawing Sheets

LIQUID CRYSTAL DISPLAY DEVICE AND DRIVING METHOD THEREFOR

BACKGROUND OF THE INVENTION

1. Field of the Invention

The present invention relates to an active matrix type liquid crystal display device used for projectors, note book PCs, monitors and the like, and to a drive method therefor.

2. Description of the Related Art

With the progress of the multimedia era, there has been rapid popularization of liquid crystal display devices from small size devices used in projector apparatus, to large size devices used in notebook PCs, monitors and the like. In particular, with the active matrix type liquid crystal display device which is driven by thin film transistors, since this obtains a high resolution, and high picture quality compared to the simple matrix type liquid crystal display device, these have become the main stream of liquid crystal display devices.

FIG. 59 shows an example of an equivalent circuit for one pixel section of a conventional active matrix type liquid crystal display device. As shown in FIG. 59, the pixel of the active matrix type liquid crystal display device comprises a MOS type transistor (Qn) (referred to hereunder as transistor (Qn) 5904 with a gate electrode connected to a scanning line 5901, one of a source electrode and a drain electrode connected to a signal line 5902, and the other of the source electrode and the drain electrode connected to a pixel electrode 5903, a storage capacitor 5906 formed between the pixel electrode 5903 and a storage capacitor electrode 5905, and a liquid crystal 5908 interposed between the pixel electrode 5903 and an opposing electrode Vcom 5907. Presently, with notebook PCs, which constitute a large practical application market for liquid crystal display devices, normally for the transistor (Qn) 5904, an amorphous silicon thin film transistor (referred to hereunder as an a-SiTFT) or a polysilicon thin film transistor (referred to hereunder as a p-SiTFT) is used. Moreover, for liquid crystal material, a twisted nematic liquid crystal (referred to hereunder as a TN liquid crystal) is used. FIG. 60 shows an equivalent circuit for a TN liquid crystal. As shown in FIG. 60, the equivalent circuit for the TN liquid crystal can be represented by a circuit where a liquid crystal capacitance component Cpix, and a resistance Rr and capacitance Cr are connected in parallel. Here the resistance Rr and the capacitance Cr are components for determining the response time constant of the liquid crystal.

The timing chart for a gate scanning voltage Vg, a data signal voltage Vd, and a voltage of the pixel electrode 5903 (referred to hereunder as the pixel voltage) Vpix, for the case where this TN liquid crystal is driven by the pixel circuit construction shown in FIG. 59, is shown in FIG. 61. As shown in FIG. 61, due to the gate scanning voltage Vg in the horizontal scanning period becoming a high level VgH, the transistor (Qn) 5904 comes on, and the data signal voltage Vd input to the signal line is transferred to the pixel electrode 5903 through the transistor (Qn) 5904. The TN liquid crystal normally operates in a mode which passes light when a voltage is not applied, that is a so called normally-white mode. Here for the data signal Vd, a voltage which gives a high light transmittance through the TN liquid crystal is applied over several fields. When the horizontal scanning period is completed and the gate scanning voltage Vg becomes a low level, the transistor (Qn) 5904 goes off, and the data signal transferred to the pixel electrode 5903 is held by the storage capacitor 5906 and the capacitance Cpix of the liquid crystal. At this time, with the pixel voltage Vpix, at the time when the transistor (Qn) 5904 goes off, a voltage shift referred to as feed-through voltage occurs through the capacitance between the gate and source of the transistor (Qn) 5904. In FIG. 61 this is shown by Vf1, Vf2 and Vf3. The amount of this voltage shift Vf1, Vf2 and Vf3 can be made smaller by designing the value for the storage capacitor 5906 to be large. The pixel voltage Vpix is held until the gate scanning voltage Vg again becomes a high level in the subsequent field period and the transistor (Qn) 5904 is selected. The TN liquid crystal switches in accordance with the held pixel voltage Vpix, and as shown by the light transmittance T1, undergoes a transition from the state where the liquid crystal transmitted light is dark to the state where this is bright. At this time, as shown in FIG. 61, in the holding periods, the pixel voltage Vpix fluctuates slightly in the fields by respective amounts ΔV1, ΔV2 and ΔV3. This is in accordance with the liquid crystal response, and is attributable to the change in the capacitance of the liquid crystal. Normally, in order to make this fluctuation as small as possible, the storage capacitor 5906 is designed with a value 2 to 3 three times larger than the pixel capacitance Cpix. As described above, the TN liquid crystal can be driven by the pixel circuit configuration shown in FIG. 59.

However, as indicated by the change in the light transmittance shown in FIG. 61, with the response time of the TN liquid crystal normally large at from 30 to 100 msec, then there is the problem that in the case where an object moving at high speed is displayed, a residual image occurs and a distinct display is thus not possible. Furthermore with the TN liquid crystal, there is the problem that the viewing angle is narrow. Therefore recently, in order to provide high speed and a wide viewing angle, research and development of liquid crystal materials having polarization, and liquid crystal display devices using such liquid crystal materials has been actively performed. An equivalent circuit for a high speed liquid crystal having polarization can be represented as shown in FIG. 62, by a circuit where a series connected resistance Rsp and capacitance Csp, and a high frequency pixel capacitance Cpix which does not change with rotation of polarization, are connected in parallel. The construction of the equivalent circuit is the same as for the equivalent circuit for the TN liquid crystal previously shown in FIG. 60. However, the resistance Rsp and capacitance Csp which determine the liquid crystal response time are different from those of the TN liquid crystal. Therefore in order to distinguish that these are components participating in polarization response, they are shown as a separate figure.

For such a liquid crystal material having polarization, there is for example, a ferroelectric liquid crystal, an antiferroelectric liquid crystal, a thresholdless antiferroelectric liquid crystal, a distorted helix ferroelectric liquid crystal, a twisted ferroelectric liquid crystal, and a monostable ferroelectric liquid crystal. Of these liquid crystal materials, in particular, with a liquid crystal display device using the thresholdless antiferroelectric liquid crystal, not only does this have high speed and wide viewing angle, but as disclosed for example in the Japanese Journal of Applied Physics, Volume 36 p. 720 referred to hereunder as reference 1, by using an active matrix type drive as shown in FIG. 59, then a gradation display is also possible.

FIG. 63 shows a timing chart for the gate scanning voltage Vg, the data signal voltage Vd, and the pixel voltage Vpix, for the case where a thresholdless antiferroelectric liquid crystal is driven by the conventional pixel circuit construction shown in FIG. 59. As shown in FIG. 63, due to the gate scanning voltage Vg in the horizontal scanning period becoming a high level VgH, the transistor (Qn) 5904 comes on, and the data signal voltage Vd input to the signal line is transferred to the pixel electrode 5903 through the transistor (Qn) 5904. The thresholdless antiferroelectric liquid crystal normally operates in a mode which does not pass light when voltage is not applied, that is a so called normally-black mode. When the horizontal scanning period is completed and the gate scanning voltage Vg becomes a low level, the transistor (Qn) 5904 goes off, and the data signal transferred to the pixel electrode 5903 is held by the storage capacitor 5906 and the high frequency pixel capacitance Cpix of the liquid crystal. At this time, with the pixel voltage Vpix, at the time when the transistor (Qn) 5904 goes off, then as with the beforementioned case of driving the TN liquid crystal, a voltage shift through the capacitance between the gate and source of the transistor (Qn) 5904, referred to as feed-through voltage, occurs. Furthermore, after completing the horizontal scanning period, the pixel voltage Vpix fluctuates slightly in the fields by respective amounts ΔV1, ΔV2 and ΔV3 as shown in FIG. 63, due to reallocation of the electrical load held in the high frequency capacitance Cpix and the electrical load held in the capacitance Csp due to polarization. With the drive method disclosed in reference 1, a drive method for gradation control using the pixel voltage Vpix after this voltage fluctuation is disclosed. At this time, in FIG. 63, the light transmittance changes as shown by T1, and the thresholdless antiferroelectric liquid crystal can be driven by means of the pixel circuit configuration shown in FIG. 59.

As an example of a high speed liquid crystal which does not have polarization, a liquid crystal display device which uses an OCB mode liquid crystal is disclosed in IRDC 97, p. L-66. An OCB mode liquid crystal is one which uses the bend orientation of the TN liquid crystal. Compared to the conventional TN liquid crystal; this can switch one or more columns at high speed. Furthermore, by jointly using bi-axial phase difference compensation films, a wide viewing angle display can be obtained.

Recently, research and development into color liquid crystal display devices with a time division driving method which use a high speed crystal such as a ferroelectric liquid crystal, an OCB mode dielectric liquid crystal or the like, has become intense. For example in Japanese Unexamined Patent Publication No. 7-64051, there is disclosed a liquid crystal display device with a time division driving method which uses a ferroelectric liquid crystal. Moreover, in IRDC 97, p. 37, there is disclosed a color liquid crystal display device with a time division driving method which uses an OCB mode liquid crystal. With the liquid crystal display device with a time division driving method, color display is realized by successively changing the light incident on the liquid crystal to red, green and blue in a period of one field. Therefore, a high speed liquid crystal which responds in at least ⅓ of one field period or less is necessary. In the case where the liquid crystal display device with a time division driving method is applied to a direct viewing type liquid crystal display device such as a notebook PC or a monitor, a color filter is not required and hence a cost reduction for the liquid crystal display device can be achieved. Furthermore, in the case where this is applied to a projector apparatus, then a high aperture efficiency similar to that for a three plate type liquid crystal light bulb, can be realized with a liquid crystal display device with a single plate color display. Hence a small size, light weight, low cost and high brightness liquid crystal projector apparatus can be provided.

In the case where a TN liquid crystal, a ferroelectric liquid crystal having polarization, an antiferroelectric liquid crystal, or a high speed liquid TN crystal which responds within one field period, are driven by the above described conventional pixel construction and drive method, the following problems arise.

In the case where, as described above, the TN liquid crystal is driven by the pixel construction shown in FIG. 59, then as shown in FIG. 61, with the pixel voltage Vpix, the voltage fluctuations of ΔV1, ΔV2 and ΔV3 occur due to the change in the liquid crystal capacitance in the holding periods. The amount of these voltage fluctuations changes depending on the amount for operating the liquid crystal molecules. Therefore even in the case where the same data signal is written in, since this depends on the data signal written into the previous field, a problem arises in that the voltage desired to be actually written to the liquid crystal cannot be continually applied over the holding period. As a result, the light transmittance of the liquid crystal which should become the curve shown by T0 in FIG. 61, actually becomes the curve shown by T1 as mentioned before. Hence it is not possible to have an accurate gradation display. Heretofore, in order to reduce the voltage changes ΔV1, ΔV2 and ΔV3, then a method of solving this by designing to increase the storage capacity has been tried. In this case however, there is the problem that the aperture efficiency is reduced.

Furthermore, in the case where a ferroelectric liquid crystal or an antiferroelectric liquid crystal having polarization is driven, then as shown in FIG. 63, with the pixel voltage Vpix, voltage fluctuations shown as ΔV1, ΔV2 and ΔV3 occur due to the polarization switching in the holding periods. These voltage fluctuations, as described before, are due to reallocation of the electrical load held in the high frequency capacitance Cpix and the electrical load held in the capacitance Csp due to polarization. Here Csp has a large value 5 to 100 times that of Cpix. Therefore the voltage changes ΔV1, ΔV2 and ΔV3 become a large value exceeding 1 to 2 volts, so that it is necessary to make the amplitude of the data signal large. As a result, the power consumption of the liquid crystal display device increases. The requirement also arises to make the signal processing circuit, the peripheral drive circuits and the pixel transistors have a high voltage endurance, so that there is the problem of an increase in cost of the liquid crystal display device. Moreover, since the amount of the voltage fluctuation ΔV1, ΔV2 and ΔV3 changes depending on the data signal written in the previous field, then the light transmittance of the liquid crystal which should become the curve shown by T0 in FIG. 62, actually becomes the curve shown by T1 as mentioned before, so that it is not possible to have an accurate gradation display for each field. Consequently, when applied to a liquid crystal display device with a time division driving method, color display with good color reproducibility cannot be performed.

A problem similar to that with the liquid crystal display device using the abovementioned liquid crystal material having polarization also occurs with a liquid crystal display device using an OCB mode liquid crystal.

In Japanese Unexamined Patent Publication No. 7-64051, there is disclosed a liquid crystal display device which uses a single crystal silicon transistor, in order to solve these problems. However with the construction shown in FIG. 18 of Japanese Unexamined Patent Publication No. 7-64051, there is the problem that resetting of the transistor Q2 which operates as a source follower type amplifier is not done. Therefore if a data signal of a voltage lower than the previously written data signal is input, the transistor Q2 remains in the off condition, so that a voltage corresponding to this data signal cannot be output. Furthermore, with the construction shown in FIG. 18 of Japanese Unexamined Patent Publication No. 7-64051, since the transistor Q2 goes off after the data signal is output to the picture element electrode 10, then when after this the polarization current for the ferroelectric liquid crystal flows, a problem similar to the beforementioned problem occurs in that the voltage of the picture element electrode fluctuates.

SUMMARY OF THE INVENTION

It is an object of the present invention, with a liquid crystal display device which uses a TN liquid crystal, a ferroelectric liquid crystal having polarization, an antiferroelectric liquid crystal, or some another high speed liquid crystal which responds within one field period, to provide a small size, light weight, high aperture efficiency, high speed, high visual field, high gradation, low power consumption, and low cost liquid crystal display device, by eliminating the abovementioned voltage fluctuations $\Delta V1$, $\Delta V2$ and $\Delta V3$.

In order to solve the abovementioned problems, with the liquid crystal display device of a first aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprises: a MOS type transistor with a gate electrode connected to a scanning line, and one of a source electrode and a drain electrode connected to a signal line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode.

Preferably, in the liquid crystal display device, the MOS type transistor circuits are formed by integrating thin film transistors.

Moreover, preferably for liquid crystal material, a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal is used.

A first liquid crystal display device drive method of the present invention is characterized in that with a method of driving the liquid crystal display device according to the first aspect of the present invention, the method involves: in a scanning line selection period, storing a data signal in a voltage holding capacitor through the MOS type transistor; and in a scanning line selection period and a scanning line non selection period, writing a signal corresponding to the stored data signal to a pixel electrode through the MOS type analog amplifier circuit.

With a liquid crystal display device of a second aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a p-type MOS transistor with a gate electrode connected to the other of the source electrode and the drain electrode of the n-type MOS transistor, and one of a source electrode and a drain electrode connected to the scanning line, and the other of the source electrode and the drain electrode connected to a pixel electrode; a voltage holding capacitor formed between the gate electrode of the p-type MOS transistor and a voltage holding capacitor electrode; and a resistor connected between the pixel electrode and the voltage holding capacitor electrode.

With a liquid crystal display device of a third aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to the scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to a voltage adjustable power supply line, a source electrode connected to the voltage holding capacitor electrode, and a drain electrode connected to the pixel electrode.

With a liquid crystal display device of a fourth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to the scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to the voltage holding capacitor electrode, a source electrode connected to a voltage adjustable power supply line, and a drain electrode connected to the pixel electrode.

With a liquid crystal display device of a fifth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to the scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode and a source electrode connected to the voltage holding capacitor electrode and a drain electrode connected to the pixel electrode.

With the liquid crystal display device of the second aspect of the present invention, preferably the value of the resistance is set to less than or equal to the value of a resistance component which determines a response time constant of the liquid crystal. Moreover, preferably the resistance is formed from a semiconductor thin film, or a semiconductor thin film which has been doped with impurities.

With the third through fifth aspects of the present invention, preferably the value of a source-drain resistance of the second p-type MOS transistor is set to less than or equal to the value of a resistance component which determines a response time constant of the liquid crystal. Furthermore, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A second liquid crystal display device drive method of the present invention is characterized in that, with a method of driving the liquid crystal display device according to the second through fifth aspects of the present invention, the method involves: supplying a voltage higher than a maximum voltage of the data signal to the voltage holding capacitor electrode; and in a scanning line selection period, storing a data signal in the voltage holding capacitor through the n-type MOS transistor by means of a scanning pulse signal, and resetting the p-type MOS transistor or the first p-type MOS transistor by transferring the scanning pulse signal to the pixel electrode through the p-type MOS transistor or the first p-type MOS transistor; and after completion of the scanning line selection period, writing a signal corresponding to the stored data signal to a pixel electrode through the p-type MOS transistor or the first p-type MOS transistor.

With a liquid crystal display device of a sixth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; an n-type MOS transistor with a gate electrode connected to the other of the source electrode and the drain electrode of the p-type MOS transistor, and one of a source electrode and a drain electrode connected to the scanning line, and the other of the source electrode and the drain electrode connected to a pixel electrode; a voltage holding capacitor formed between the gate electrode of the n-type MOS transistor and a voltage holding capacitor electrode; and a resistor connected between the pixel electrode and the voltage holding capacitor electrode.

With a liquid crystal display device of a seventh aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to the scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to a voltage adjustable bias power supply line, a source electrode connected to the voltage holding capacitor electrode, and a drain electrode connected to the pixel electrode.

With a liquid crystal display device of an eighth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to the scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to the voltage holding capacitor electrode, a source electrode connected to a voltage adjustable power supply line, and a drain electrode connected to the pixel electrode.

With a liquid crystal display device of a ninth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to the scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode and a source electrode connected to the voltage holding capacitor electrode, and a drain electrode connected to the pixel electrode.

With the liquid crystal display device of the sixth aspect of the present invention, preferably the value of the resistance is set to less than or equal to the value of a resistance component which determines a response time constant of the liquid crystal. Moreover, it is also preferable if the resistance is preferably formed from a semiconductor thin film, or a semiconductor thin film which has been doped with impurities.

With the seventh through ninth aspects of the present invention, preferably the value of a source-drain resistance of the second n-type MOS transistor is set to less than or equal to the value of a resistance component which determines a response time constant of the liquid crystal.

With the sixth through ninth aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

Furthermore, a third liquid crystal display device drive method of the present invention is characterized in that, with a method of driving the liquid crystal display device according to the sixth through ninth aspects of the present invention, the method involves: supplying a voltage lower than a minimum voltage of the data signal to the voltage holding capacitor electrode; and in a scanning line selection period, storing a data signal in the voltage holding capacitor through the p-type MOS transistor by means of a scanning pulse signal, and resetting the n-type MOS transistor or the first n-type MOS transistor by transferring the scanning pulse signal to the pixel electrode through the n-type MOS transistor or the first n-type MOS transistor; and after completion of the scanning line selection period, writing a signal corresponding to the stored data signal to a pixel electrode through the n-type MOS transistor or the first n-type MOS transistor.

With a liquid crystal display device of a tenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to an Nth (where N is an integer of two or more) scanning line, and one of a source electrode and a drain electrode connected to a signal line; a p-type MOS transistor with a gate electrode connected to the other of the source electrode and the drain electrode of the n-type MOS transistor, and one of a source electrode and a drain electrode connected to an (N−1)th scanning line, and the other of the source electrode and the drain electrode connected to a pixel electrode; a voltage holding capacitor formed between the gate electrode of the p-type MOS transistor and a voltage holding capacitor electrode; and a resistor connected between the pixel electrode and the voltage holding capacitor electrode.

With a liquid crystal display device of an eleventh aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to an Nth scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to an (N−1)th scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to a voltage adjustable bias power supply line, a source electrode connected to the voltage holding capacitor electrode, and a drain electrode connected to the pixel electrode.

With a liquid crystal display device of an twelfth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to an Nth scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to an (N−1)th scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to the voltage holding capacitor electrode, a source electrode connected to a voltage adjustable power supply line, and a drain electrode connected to the pixel electrode.

With a liquid crystal display device of a thirteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to an Nth scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to an (N−1)th scanning line, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode and a source electrode connected to the voltage holding capacitor electrode, and a drain electrode connected to the pixel electrode.

With the liquid crystal display device of the tenth aspect of the present invention, preferably the value of the resistance is set to less than or equal to the value of a resistance component which determines a response time constant of the liquid crystal. Moreover, it is also preferable if the resistance is formed from a semiconductor thin film, or a semiconductor thin film which has been doped with impurities.

With the eleventh through thirteenth aspects of the present invention, preferably the value of a source-drain resistance of the second p-type MOS transistor is set to less than or equal to the value of a resistance component which determines a response time constant of the liquid crystal.

With the tenth through thirteenth aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A fourth liquid crystal display device drive method of the present invention is characterized in that, with the method of driving the liquid crystal display device according to the tenth through thirteenth aspects of the present invention, the method involves: supplying a voltage higher than a maximum voltage of the data signal to the voltage holding capacitor electrode; and in a previous line scanning line selection period, resetting the p-type MOS transistor or the first p-type MOS transistor by transferring the scanning pulse signal of the previous line to the pixel electrode through the p-type MOS transistor or the first p-type MOS transistor; and in a scanning line selection period, storing a data signal in the voltage holding capacitor through the n-type MOS transistor by means of a scanning pulse signal, and writing a signal corresponding to the stored data signal to a pixel electrode through the p-type MOS transistor or the first p-type MOS transistor, and also continuing on after completion of the scanning line selection period, writing a signal corresponding to the stored data signal to a pixel electrode through the p-type MOS transistor or the first p-type MOS transistor.

With a liquid crystal display device of a fourteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to an Nth (where N is an integer of two or more) scanning line; and one of a source electrode and a drain electrode connected to a signal line; an n-type MOS transistor with a gate electrode connected to the other of the source electrode and the drain electrode of the p-type MOS transistor, and one of a source electrode and a drain electrode connected to an (N−1)th scanning line, and the other of the source electrode and the drain electrode connected to a pixel electrode; a voltage holding capacitor formed between the gate electrode of the n-type MOS transistor and a voltage holding capacitor electrode; and a resistor connected between the pixel electrode and the voltage holding capacitor electrode.

With a liquid crystal display device of a fifteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to an Nth (where N is an integer of two or more) scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to an (N−1)th scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to a voltage adjustable bias power supply line, a source electrode connected to the voltage holding capacitor electrode, and a drain electrode connected to the pixel electrode.

With a liquid crystal display device of a sixteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to an Nth (where N is an integer of two or more) scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to an (N−1)th scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to the voltage holding capacitor electrode, a source electrode connected to a voltage adjustable power supply line, and a drain electrode connected to the pixel electrode.

With a liquid crystal display device of a seventeenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to an Nth (where N is an integer of two or more) scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to an (N−1)th scanning line, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode and a source electrode connected to the voltage holding capacitor electrode, and a drain electrode connected to the pixel electrode.

With the liquid crystal display device of the fourteenth aspect of the present invention, preferably the value of the resistance is set to less than or equal to the value of a resistance component which determines a response time constant of the liquid crystal. Moreover, it is also preferable if the resistance is formed from a semiconductor thin film, or a semiconductor thin film which has been doped with impurities.

With the fifteenth through seventh aspects of the present invention, preferably the value of a source-drain resistance of the second n-type MOS transistor is set to less than or equal to the value of a resistance component which determines a response time constant of the liquid crystal.

With the fourteenth through seventeenth aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A fifth liquid crystal display device drive method of the present invention is characterized in that, with a method of driving the liquid crystal display device according to the fourteenth through seventeenth aspects of the present invention, the method involves: supplying a voltage lower than a minimum voltage of the data signal to the voltage holding capacitor electrode; and in a previous line scanning line selection period, resetting the n-type MOS transistor or the first n-type MOS transistor by transferring the scanning pulse signal of the previous line to the pixel electrode through the n-type MOS transistor or the first n-type MOS transistor; and in a scanning line selection period, storing a data signal in the voltage holding capacitor through the p-type MOS transistor by means of a scanning pulse signal, and writing a signal corresponding to the stored data signal to a pixel electrode through the n-type MOS transistor or the first n-type MOS transistor, and also continuing on after completion of the scanning line selection period, writing a signal corresponding to the stored data signal to a pixel electrode through the n-type MOS transistor or the first n-type MOS transistor.

With a liquid crystal display device of an eighteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a p-type MOS transistor with a gate electrode connected to the other of the source electrode and the drain electrode of the n-type MOS transistor, and one of a source electrode and a drain electrode connected to a reset electrode, and the other of the source electrode and the drain electrode connected to a pixel electrode; a voltage holding capacitor formed between the gate electrode of the p-type MOS transistor and a voltage holding capacitor electrode; and a resistor connected between the pixel electrode and the voltage holding capacitor electrode.

With a liquid crystal display device of a nineteenth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to a reset electrode, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to a voltage adjustable bias power supply line, a source electrode connected to the voltage holding capacitor electrode, and a drain electrode connected to the pixel electrode.

With a liquid crystal display device of a twentieth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to a reset electrode, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode connected to the voltage holding capacitor electrode, a source electrode connected to a voltage adjustable power supply line, and a drain electrode connected to the pixel electrode.

With a liquid crystal display device of a twenty first aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: an n-type MOS transistor with a gate electrode connected to a scanning line, and one of a source electrode and a drain electrode connected to a signal line; a first p-type MOS transistor with a gate electrode connected to the other of the source electrode and the drain electrode of the n-type MOS transistor, and one of a source electrode and a drain electrode connected to a reset electrode, and the other of the source electrode and the drain electrode connected to a pixel electrode; a voltage holding capacitor formed between the gate electrode of the first p-type MOS transistor and a voltage holding capacitor electrode; and a second p-type MOS transistor with a gate electrode and a source electrode connected to the voltage holding capacitor electrode, and a drain electrode connected to the pixel electrode.

With the liquid crystal display device of the eighteenth aspect of the present invention, preferably the value of the resistance is set to less than or equal to the value of a resistance component which determines a response time constant of the liquid crystal. Moreover, it is preferable if the resistance is formed from a semiconductor thin film, or a semiconductor thin film which has been doped with impurities.

With the liquid crystal display device of the nineteenth through twenty first aspects of the present invention, preferably the value of a source-drain resistance of the second p-type MOS transistor is set to less than or equal to the value of a resistance component which determines a response time constant of the liquid crystal.

With the liquid crystal display device of the eighteenth through twenty first aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A sixth liquid crystal display device drive method of the present invention is characterized in that, with a method of driving the liquid crystal display device according to the eighteenth through twenty first aspects of the present invention, the method involves: supplying a voltage higher than a maximum voltage of the data signal to the voltage holding capacitor electrode; and at a time prior to a scanning line selection period, resetting the p-type MOS transistor or the first p-type MOS transistor by transferring a reset signal to the pixel electrode through the p-type MOS transistor or the first p-type MOS transistor; and in a scanning line selection period, storing a data signal in the voltage holding capacitor through the n-type MOS transistor by means of a scanning pulse signal, and writing a signal corresponding to the stored data signal to a pixel electrode through the p-type MOS transistor or the first p-type MOS transistor, and also continuing on after completion of the scanning line selection period, writing a signal corresponding to the stored data signal to a pixel electrode through the p-type MOS transistor or the first p-type MOS transistor.

A seventh liquid crystal display device drive method of the present invention is characterized in that, with a method of driving the liquid crystal display device according to the eighteenth through twenty first aspects of the present invention, the method involves: supplying a voltage higher than a maximum voltage of the data signal to the voltage holding capacitor electrode; and in a scanning line selection period, storing a data signal in the voltage holding capacitor through the n-type MOS transistor by means of a scanning pulse signal, and resetting the p-type MOS transistor or the first p-type MOS transistor by transferring a reset signal to the pixel electrode through the p-type MOS transistor or the first p-type MOS transistor; and after completion of the scanning line selection period, writing a signal corresponding to the stored data signal to a pixel electrode through the p-type MOS transistor or the first p-type MOS transistor.

With a liquid crystal display device of a twenty second aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; an n-type MOS transistor with a gate electrode connected to the other of the source electrode and the drain electrode of the p-type MOS transistor, and one of a source electrode and a drain electrode connected to a reset electrode, and the other of the source electrode and the drain electrode connected to a pixel electrode; a voltage holding capacitor formed between the gate electrode of the n-type MOS transistor and a voltage holding capacitor electrode; and a resistor connected between the pixel electrode and the voltage holding capacitor electrode.

With a liquid crystal display device of a twenty third aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to a reset electrode, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to a voltage adjustable bias power supply line, a source electrode connected to the voltage holding capacitor electrode, and a drain electrode connected to the pixel electrode.

With a liquid crystal display device of a twenty fourth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to a reset electrode, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode connected to the voltage holding capacitor electrode, a source electrode connected to a voltage adjustable power supply line, and a drain electrode connected to the pixel electrode.

With a liquid crystal display device of a twenty fifth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a p-type MOS transistor with a gate electrode connected to a scanning line, and one of a source electrode and a drain electrode connected to a signal line; a first n-type MOS transistor with a gate electrode connected to the other of the source electrode and the drain electrode of the p-type MOS transistor, and one of a source electrode and a drain electrode connected to a reset electrode, and the other of the source electrode and the drain electrode connected to a pixel electrode; a voltage holding capacitor formed between the gate electrode of the first n-type MOS transistor and a voltage holding capacitor electrode; and a second n-type MOS transistor with a gate electrode and a source electrode connected to the voltage holding capacitor electrode, and a drain electrode connected to the pixel electrode.

With the liquid crystal display device of the twenty second aspect of the present invention, preferably the value of the resistance is set to less than or equal to the value of a resistance component which determines a response time constant of the liquid crystal. Moreover, it is preferable if the resistance is formed from a semiconductor thin film, or a semiconductor thin film which has been doped with impurities.

With the liquid crystal display device of the twenty third through twenty fifth aspects of the present invention, preferably the value of a source-drain resistance of the second n-type MOS transistor is set to less than or equal to the value of a resistance component which determines a response time constant of the liquid crystal.

With the liquid crystal display device of the twenty second through twenty fifth aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

An eighth liquid crystal display device drive method of the present invention is characterized in that, with a method of driving the liquid crystal display device according to the twenty second through twenty fifth aspects of the present invention, the method involves: supplying a voltage lower than a minimum voltage of the data signal to the voltage holding capacitor electrode; and at a time prior to a scanning line selection period, resetting the n-type MOS transistor or the first n-type MOS transistor by transferring a reset signal to the pixel electrode through the n-type MOS transistor or the first n-type MOS transistor; and in a scanning line selection period, storing a data signal in the voltage holding capacitor through the n-type MOS transistor by means of a scanning pulse signal, and writing a signal corresponding to the stored data signal to a pixel electrode through the n-type MOS transistor or the first n-type MOS transistor, and also continuing on after completion of the scanning line selection period, writing a signal corresponding to the stored data signal to a pixel electrode through the n-type MOS transistor or the first n-type MOS transistor.

A ninth liquid crystal display device drive method of the present invention is characterized in that, with a method of driving the liquid crystal display device according to the twenty second through twenty fifth aspects of the present invention, the method involves: supplying a voltage lower than a minimum voltage of the data signal to the voltage holding capacitor electrode; and in a scanning line selection period, storing a data signal in the voltage holding capacitor through the p-type MOS transistor by means of a scanning pulse signal, and resetting the n-type MOS transistor or the first n-type MOS transistor by transferring a reset signal to the pixel electrode through the n-type MOS transistor or the first n-type MOS transistor; and after completion of the scanning line selection period, writing a signal corresponding to the stored data signal to a pixel electrode through the n-type MOS transistor or the first n-type MOS transistor.

With a liquid crystal display device of a twenty sixth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first n-type MOS transistor with a gate electrode connected to a scanning line, and one of a source electrode and a drain electrode connected to a signal line; a second n-type MOS transistor with a gate electrode connected to the other of the source electrode and the drain electrode of the first n-type MOS transistor, and one of a source electrode and a drain electrode connected to a reset electrode, and the other of the source electrode and the drain electrode connected to a pixel electrode; a voltage holding capacitor formed between the gate electrode of the second n-type MOS transistor and a voltage holding capacitor electrode; and a resistor connected between the pixel electrode and the voltage holding capacitor electrode.

With a liquid crystal display device of a twenty seventh aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first n-type MOS transistor with a gate electrode connected to a scanning line, and one of a source electrode and a drain electrode connected to a signal line; a second n-type MOS transistor with a gate electrode connected to the other of the source electrode and the drain electrode of the first n-type MOS transistor, and one of a source electrode and a drain electrode connected to a reset electrode, and the other of the source electrode and the drain electrode connected to a pixel electrode; a voltage holding capacitor formed between the gate electrode of the second n-type MOS transistor and a voltage holding capacitor electrode; and a third n-type MOS transistor with a gate electrode connected to a voltage adjustable bias power supply line, a source electrode connected to the voltage holding capacitor electrode, and a drain electrode connected to the pixel electrode.

With a liquid crystal display device of a twenty eighth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first n-type MOS transistor with a gate electrode connected to a scanning line, and one of a source electrode and a drain electrode connected to a signal line; a second n-type MOS transistor with a gate electrode connected to the other of the source electrode and the drain electrode of the first n-type MOS transistor, and one of a source electrode and a drain electrode connected to a reset electrode, and the other of the source electrode and the drain electrode connected to a pixel electrode; a voltage holding capacitor formed between the gate electrode of the second n-type MOS transistor and a voltage holding capacitor electrode; and a third n-type MOS transistor with a gate electrode connected to the voltage holding capacitor electrode, a source electrode connected to a voltage adjustable bias power supply line, and a drain electrode connected to the pixel electrode.

With a liquid crystal display device of a twenty ninth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first n-type MOS transistor with a gate electrode connected to a scanning line, and one of a source electrode and a drain electrode connected to a signal line; a second n-type MOS transistor with a gate electrode connected to the other of the source electrode and the drain electrode of the first n-type MOS transistor, and one of a source electrode and a drain electrode connected to a reset electrode, and the other of the source electrode and the drain electrode connected to a pixel electrode; a voltage holding capacitor formed between the gate electrode of the second n-type MOS transistor and a voltage holding capacitor electrode; and a third n-type MOS transistor with a gate electrode and a source electrode connected to the voltage holding capacitor electrode, and a drain electrode connected to the pixel electrode.

With the liquid crystal display device of the twenty sixth aspect of the present invention, preferably the value of the resistance is set to less than or equal to the value of a resistance component which determines a response time constant of the liquid crystal. Moreover, it is preferable if the resistance is formed from a semiconductor thin film, or a semiconductor thin film which has been doped with impurities.

With the liquid crystal display device of the twenty seventh through twenty ninth aspects of the present invention, preferably the value of a source-drain resistance of the third n-type MOS transistor is set to less than or equal to the value of a resistance component which determines a response time constant of the liquid crystal.

With the liquid crystal display device of the twenty sixth through twenty ninth aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A tenth liquid crystal display device drive method of the present invention is characterized in that, with a method of driving the liquid crystal display device according to the twenty sixth through twenty ninth aspects of the present invention, the method involves: supplying a voltage lower than a minimum voltage of the data signal to the voltage holding capacitor electrode; and at a time prior to a scanning line selection period, resetting the second n-type MOS transistor by transferring a reset signal to the pixel electrode through the second n-type MOS transistor; and in a scanning line selection period, storing a data signal in the voltage holding capacitor through the first n-type MOS transistor by means of a scanning pulse signal, and writing a signal corresponding to the stored data signal to a pixel electrode through the second n-type MOS transistor, and also continuing on after completion of the scanning line selection period, writing a signal corresponding to the stored data signal to a pixel electrode through the second n-type MOS transistor.

An eleventh liquid crystal display device drive method of the present invention is characterized in that, with a method of driving the liquid crystal display device according to the twenty sixth through twenty ninth aspects of the present invention, the method involves: supplying a voltage lower than a minimum voltage of the data signal to the voltage holding capacitor electrode; and in a scanning line selection period, storing a data signal in the voltage holding capacitor through the first n-type MOS transistor by means of a scanning pulse signal, and resetting the second n-type MOS transistor by transferring a reset signal to the pixel electrode through the second n-type MOS transistor; and after completion of the scanning line selection period, writing a signal corresponding to the stored data signal to a pixel electrode through the second n-type MOS transistor.

With a liquid crystal display device of a thirtieth aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first p-type MOS transistor with a gate electrode connected to a scanning line, and one of a source electrode and a drain electrode connected to a signal line; a second p-type MOS transistor with a gate electrode connected to the other of the source electrode and the drain electrode of the first p-type MOS transistor, and one of a source electrode and a drain electrode connected to a reset electrode, and the other of the source electrode and the drain electrode connected to a pixel electrode; a voltage holding capacitor formed between the gate electrode of the second p-type MOS transistor and a voltage holding capacitor electrode; and a resistor connected between the pixel electrode and the voltage holding capacitor electrode.

With a liquid crystal display device of a thirty first aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first p-type MOS transistor with a gate electrode connected to a scanning line, and one of a source electrode and a drain electrode connected to a signal line; a second p-type MOS transistor with a gate electrode connected to the other of the source electrode and the drain electrode of the first p-type MOS transistor, and one of a source electrode and a drain electrode connected to a reset electrode, and the other of the source electrode and the drain electrode connected to a pixel electrode; a voltage holding capacitor formed between the gate electrode of the second p-type MOS transistor and a voltage holding capacitor electrode; and a third p-type MOS transistor with a gate electrode connected to a voltage adjustable bias power supply line, a source electrode connected to the voltage holding capacity electrode, and a drain electrode connected to the pixel electrode.

With a liquid crystal display device of a thirty second aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first p-type MOS transistor with a gate electrode connected to a scanning line, and one of a source electrode and a drain electrode connected to a signal line; a second p-type MOS transistor with a gate electrode connected to the other of the source electrode and the drain electrode of the first p-type MOS transistor, and one of a source electrode and a drain electrode connected to a reset electrode, and the other of the source electrode and the drain electrode connected to a pixel electrode; a voltage holding capacitor formed between the gate electrode of the second p-type MOS transistor and a voltage holding capacitor electrode; and a third p-type MOS transistor with a gate electrode connected to the voltage holding capacitor electrode, a source electrode connected to a voltage adjustable bias power supply line, and a drain electrode connected to the pixel electrode.

With a liquid crystal display device of a thirty third aspect of the present invention, in an active matrix type liquid crystal display device where pixel electrodes are driven by MOS type transistor circuits respectively disposed in the vicinity of intersection points of a plurality of scanning lines and a plurality of signal lines, the MOS type transistor circuits comprise: a first p-type MOS transistor with a gate electrode connected to a scanning line, and one of a source electrode and a drain electrode connected to a signal line; a second p-type MOS transistor with a gate electrode connected to the other of the source electrode and the drain electrode of the first p-type MOS transistor, and one of a source electrode and a drain electrode connected to a reset electrode, and the other of the source electrode and the drain electrode connected to a pixel electrode; a voltage holding capacitor formed between the gate electrode of the second p-type MOS transistor and a voltage holding capacitor electrode; and a third p-type MOS transistor with a gate electrode and a source electrode connected to the voltage holding capacitor electrode, and a drain electrode connected to the pixel electrode.

With the liquid crystal display device of the thirtieth aspect of the present invention, preferably the value of the resistance is set to less than or equal to the value of a resistance component which determines a response time constant of the liquid crystal. Moreover, it is preferable if the resistance is formed from a semiconductor thin film, or a semiconductor thin film which has been doped with impurities.

With the liquid crystal display device of the thirty first through thirty third aspects of the present invention, preferably the value of a source-drain resistance of the third p-type MOS transistor is set to less than or equal to the value of a resistance component which determines a response time constant of the liquid crystal.

With the liquid crystal display device of the thirtieth through thirty third aspects of the present invention, preferably the MOS type transistor circuits are formed by integrating thin film transistors. Moreover, it is also preferable if liquid crystal material is a nematic liquid crystal, a ferroelectric liquid crystal, an antiferroelectric liquid crystal, a thresholdless antiferroelectric liquid crystal, a distorted helix ferroelectric liquid crystal, a twisted ferroelectric liquid crystal, or a monostable ferroelectric liquid crystal.

A twelfth liquid crystal display device drive method of the present invention is characterized in that, with a method of driving the liquid crystal display device according to the thirtieth through thirty third aspects of the present invention, the method involves: supplying a voltage higher than a maximum voltage of the data signal to the voltage holding capacitor electrode; and at a time prior to a scanning line selection period, resetting the second p-type MOS transistor by transferring a reset signal to the pixel electrode through the second p-type MOS transistor; and in a scanning line selection period, storing a data signal in the voltage holding capacitor through the first p-type MOS transistor by means of a scanning pulse signal, and writing a signal corresponding to the stored data signal to a pixel electrode through the second p-type MOS transistor, and also continuing on after completion of the scanning line selection period, writing a signal corresponding to the stored data signal to a pixel electrode through the second p-type MOS transistor.

A thirteenth liquid crystal display device drive method of the present invention is characterized in that, with a method of driving the liquid crystal display device according to the thirtieth through thirty third aspects of the present invention, the method involves: supplying a voltage higher than a maximum voltage of the data signal to the voltage holding capacitor electrode; and in a scanning line selection period, storing a data signal in the voltage holding capacitor through the first p-type MOS transistor by means of a scanning pulse signal, and resetting the second p-type MOS transistor by transferring a reset signal to the pixel electrode through the second p-type MOS transistor; and after completion of the scanning line selection period, writing a signal corresponding to the stored data signal to a pixel electrode through the second p-type MOS transistor.

Preferably the construction is as a liquid crystal display device with a time division drive scheme, which performs color display by driving involving switching the color of the incident light in one frame period, using any one of the liquid crystal display devices of the first through thirty third aspects of the present invention.

DESCRIPTION OF THE PREFERRED EMBODIMENTS

Figure 1:
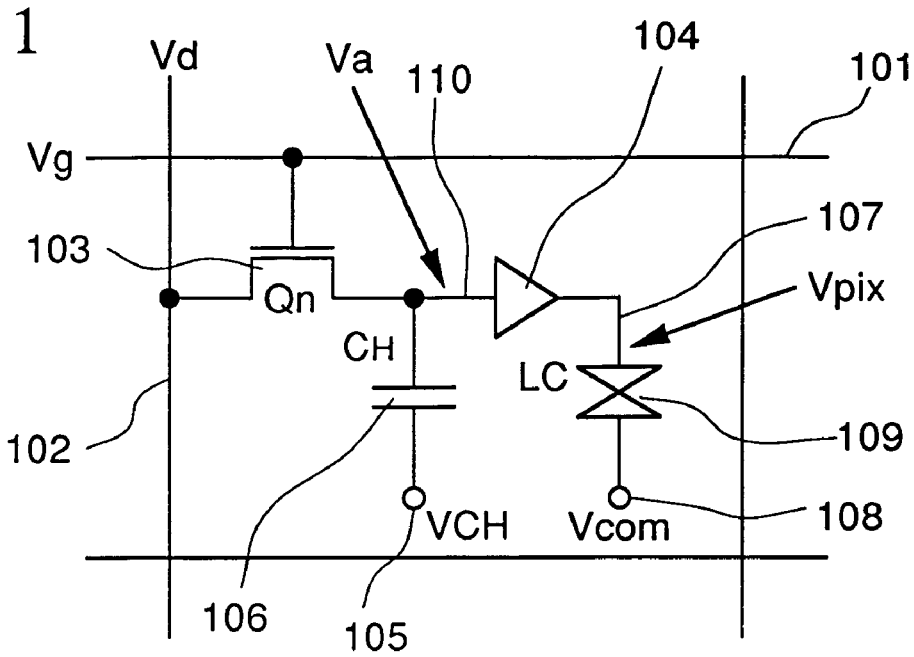
FIG. 1 is a diagram showing a first embodiment of a liquid crystal display device of the present invention.

A first embodiment of the present invention will now be described in detail with reference to the figures. FIG. 1 is a diagram showing a first embodiment of a liquid crystal display device of the present invention. As shown in the figure, the liquid crystal display device of the present invention comprises: a MOS type transistor (Qn) 103 with a gate electrode connected to a scanning line 101, and one of a source electrode and a drain electrode connected to a signal line 102; an analog amplifier circuit 104 with an input electrode connected to the other of the source electrode and the drain electrode of the transistor (Qn) 103, and an output electrode connected to a pixel electrode 107; a voltage holding capacitor 106 formed between the input electrode of the analog amplifier circuit 104 and a voltage holding capacitor electrode 105; and a liquid crystal 109 which is to be switched, disposed between the pixel electrode 107 and an opposing electrode 108. Here the MOS type transistor (Qn) 103 and the analog amplifier circuit 104 are constituted by p-SiTFTs. Furthermore, the gain of the analog amplifier circuit 104 is set to one.

Figure 2:
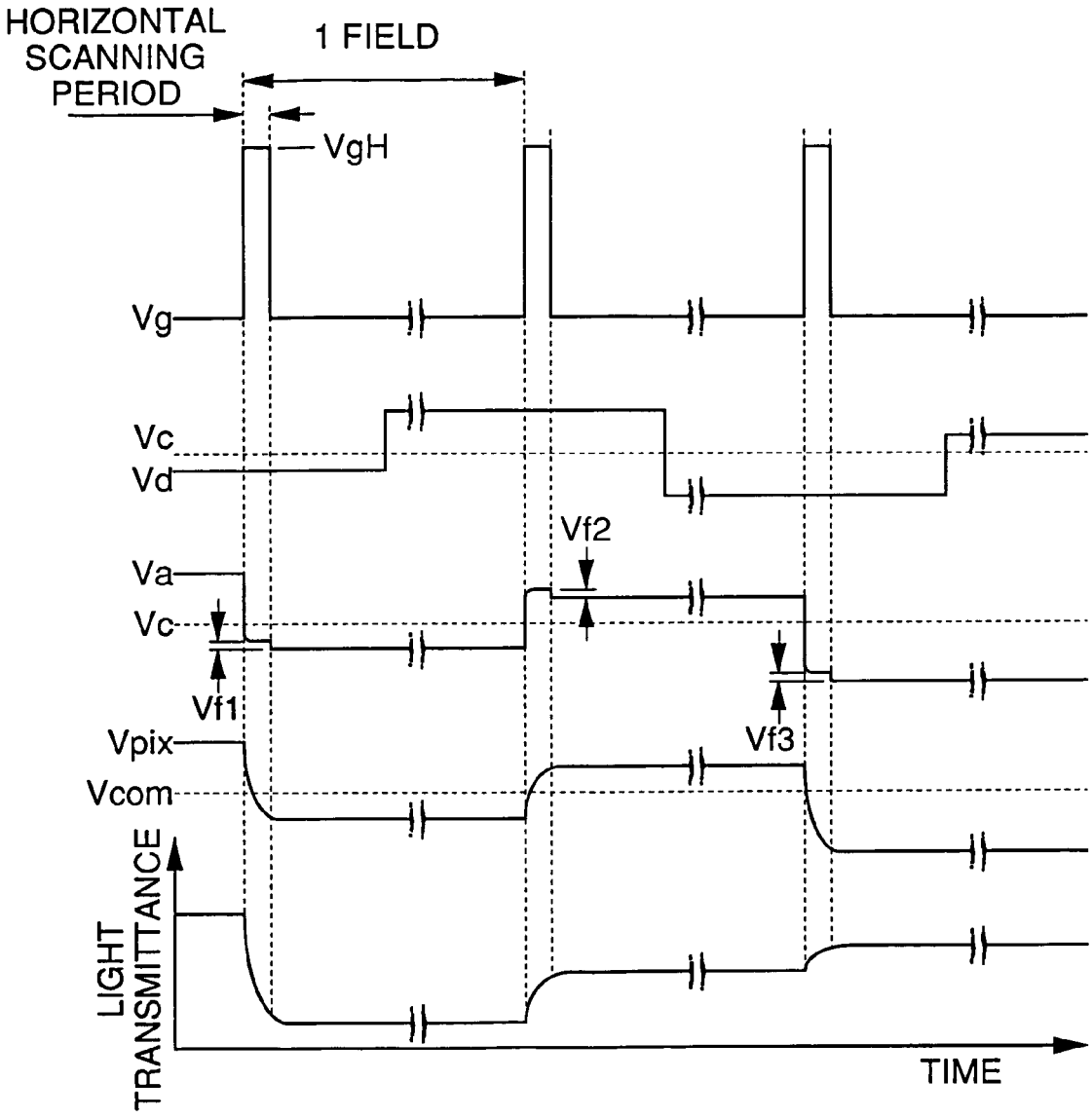
FIG. 2 is a diagram illustrating a drive method for the liquid crystal display device of the present invention.

As follows is a description of the drive method for the liquid crystal display device using this pixel construction, with reference to FIG. 2. FIG. 2 shows the timing chart, and the change in light transmittance of the liquid crystal, a gate scanning voltage Vg, a data signal voltage Vd, an amplifier input voltage Va and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 1. Here the example is given for when the liquid crystal operates in a so called normally black mode, becoming dark when a voltage is not applied. As shown in the figure, due for to the gate scanning voltage Vg in the horizontal scanning period becoming a high level VgH, the transistor 103 comes on, and the data signal Vd input to the signal line is transferred to the input electrode of the analog amplifier circuit 104 through the transistor 103. When the horizontal scanning period is completed and the gate scanning voltage Vg becomes a low level, the transistor (Qa) 103 goes off, and the data signal transferred to the input electrode of the analog amplifier circuit is held by the voltage holding capacitor 105. At this time, with the amplifier input voltage Va, at the time when the transistor (Qa) 103 goes off, a voltage shift referred to as a feed-through voltage occurs through the capacitance between the gate and the source of the transistor (Qa) 103. In FIG. 2 this is shown by Vf1, Vf2 and Vf3. The amount of this voltage shift Vf1, Vf2 and Vf3 can be made smaller by designing the value for the voltage holding capacitor 105 to be large. The amplifier input voltage Va is held until the gate scanning voltage Vg again becomes a high level in the subsequent field period and the transistor (Qn) 103 is selected. The analog amplifier circuit 104, during the period in the subsequent field up until the amplifier input voltage changes, can output an analog gradation voltage corresponding to the held amplifier input voltage Va. In this case, the pixel electrode 107 is driven by the analog amplifier circuit 104 even after completion of the horizontal scanning period, and hence the fluctuations in the pixel voltage Vpix accompanying the response of the liquid crystal as discussed for the conventional technology can be eliminated. As a result, as shown by the wave form of the pixel voltage Vpix in FIG. 2, a desired voltage can be applied to the liquid crystal over the one field period, and as also shown by the liquid crystal light transmittance, it becomes possible to obtain a desired gradation for each one field.

With the abovementioned embodiment, it was noted that the MOS type transistor (Qn) 103 and the analog amplifier circuit 104 were formed from p-SiTFTs. However these may be formed from other thin film transistors such as a-SiTFTs or cadmium-selenium thin film transistors (referred to hereunder as CdSeTFTs). Moreover these may be formed from single crystal silicon transistors. Furthermore, in the abovementioned embodiment, an n-type MOS transistor is employed for the pixel selection switch. However a p-type MOS transistor may be employed. In this case, for the gate scanning signal, a pulse signal which becomes a low level at the time of selection and a high level at the time of non selection is input. Furthermore, with the abovementioned embodiment, the description has been for the case of driving a high speed liquid crystal such as a ferroelectric liquid crystal having polarization, an antiferroelectric liquid crystal, or an OCB liquid crystal which responds within one field period. However even in the case of driving another liquid crystal such as a TN liquid crystal which does not completely respond within one field period, a similar effect where a more accurate gradation display can be realized, can be obtained.

When the above described liquid crystal display device and drive method of the first embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 3:
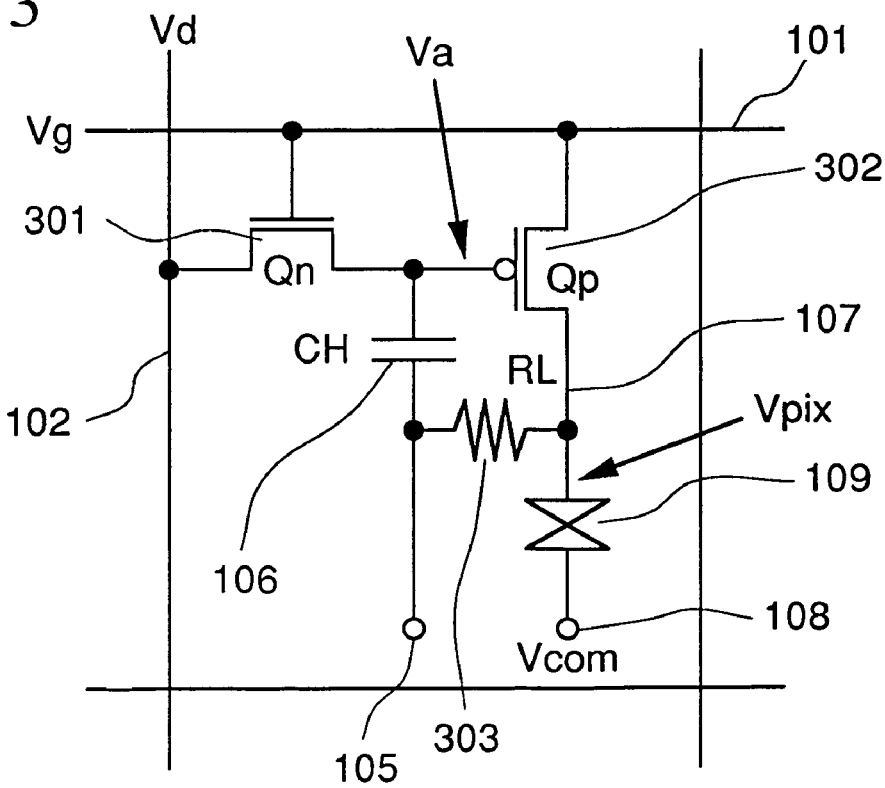
FIG. 3 is a diagram showing a second embodiment of a liquid crystal display device of the present invention.

A second embodiment of the present invention will now be described in detail with reference to the figures. FIG. 3 is a diagram showing a second embodiment of a liquid crystal display device of the present invention. As shown in the figure, the liquid crystal display device of the present invention comprises: an n-type MOS transistor (Qn) 301 with a gate electrode connected to a scanning line 101, and one of a source electrode and a drain electrode connected to a signal line 102; a p-type MOS transistor (Qp) 302 with a gate electrode connected to the other of the source electrode and the drain electrode of the n-type MOS transistor (Qn) 301, and one of a source electrode and a drain electrode connected to the scanning line 101, and the other of the source electrode and the drain electrode connected to a pixel electrode 107; a voltage holding capacitor 106 formed between the gate electrode of the p-type MOS transistor 302 and a voltage holding capacitor electrode 105; a resistor RL 303 connected between the pixel electrode 107 and the voltage holding capacitor electrode 105; and a liquid crystal 109 which is to be switched, disposed between the pixel electrode 107 and an opposing electrode 108. Here the n-type MOS transistor (Qn) 301 and the p-type MOS transistor (Qp) 302 are constituted by p-SiTFTs.

Figure 60:
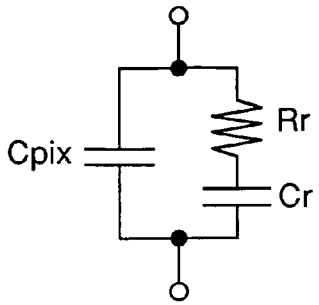
FIG. 60 is a diagram showing an equivalent circuit for a liquid crystal.
Figure 62:
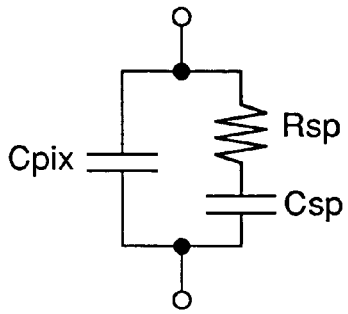
FIG. 62 is a diagram showing an equivalent circuit for a liquid crystal.
Figure 63:
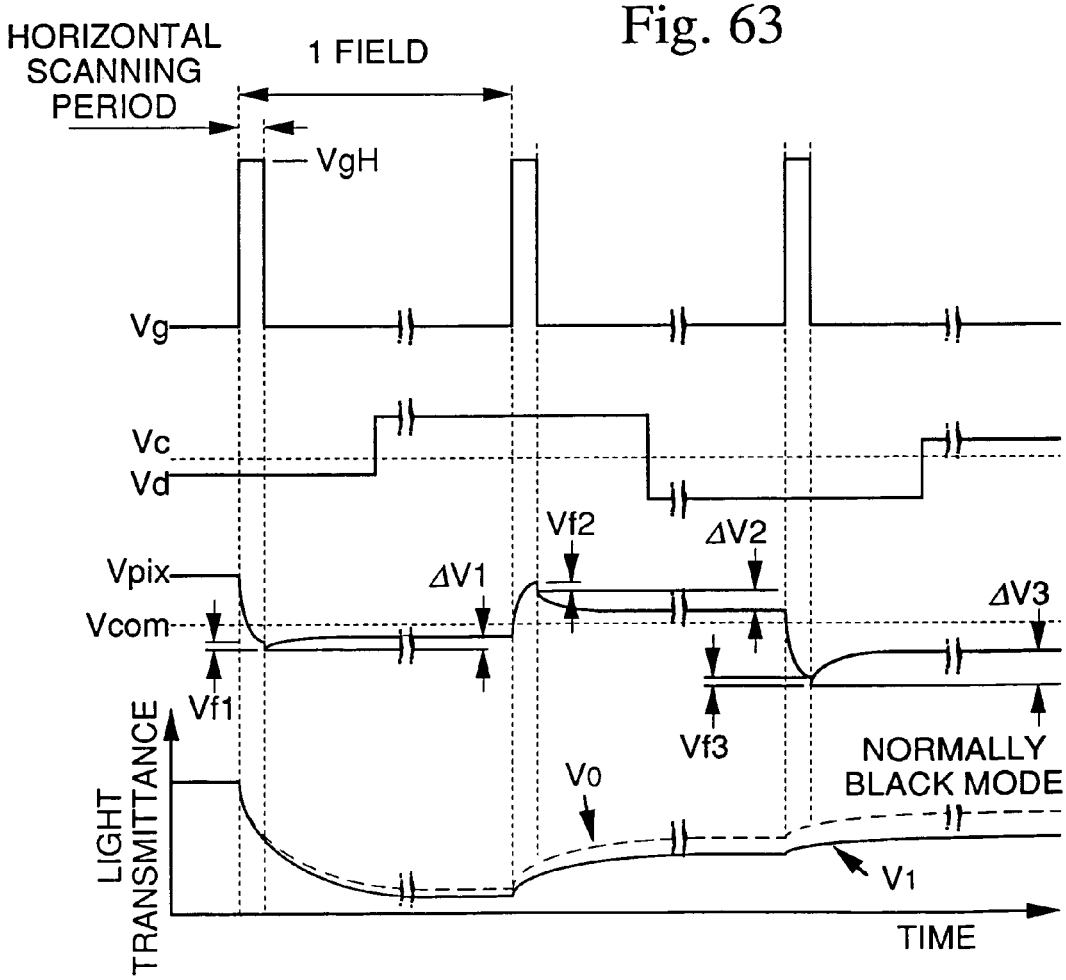
FIG. 63 is a diagram illustrating a drive method for a conventional liquid crystal display device.

Moreover, the value of the resistor RL 303 is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 303, have the relation shown by the following equation:

$$RL \leqq Rr,\ RL \leqq Rsp \tag{1}$$

For example, in the case when the resistance Rsp is 5 GΩ, then the value of the resistor RL is set to a value of around 1 GΩ. A value of 1 GΩ which is a large resistance not used in normal semiconductor integrated circuits, is formed from a semiconductor thin film or a semiconductor thin film which has been doped with impurities.

Figure 4:
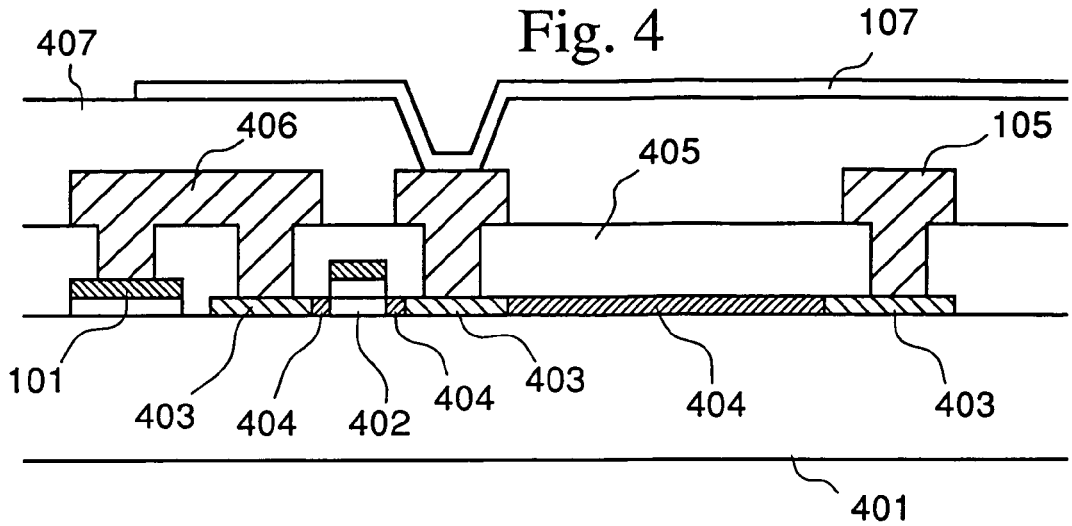
FIG. 4 is a diagram showing the structure of a resistor constituting the liquid crystal display device of the present invention.

FIG. 4 shows a structural example for the case where the resistor RL is formed from a lightly doped p-type semiconductor thin film (p−). In FIG. 4, the construction of a p-type p-SiTFT 402 is also shown. As shown in the figure, one of the source and the drain electrodes of the p-type p-SiTFT 402 is connected to the scanning line 101, and the other is connected to the pixel electrode 107. Here with the p− layer 404 portion which forms the resistor, the amount of impurity doping, and the length and width are designed so that the conditions shown in equation (1) are satisfied. Moreover, the p-type p-SiTFT 402 has a lightly doped drain (referred to hereunder as an LDD) construction for high voltage endurance. In order to simplify the production process, the step of forming the LDD of the p-SiTFT 402 and the step of forming the resistor RL (p−) are performed at the same time.

Figure 5:
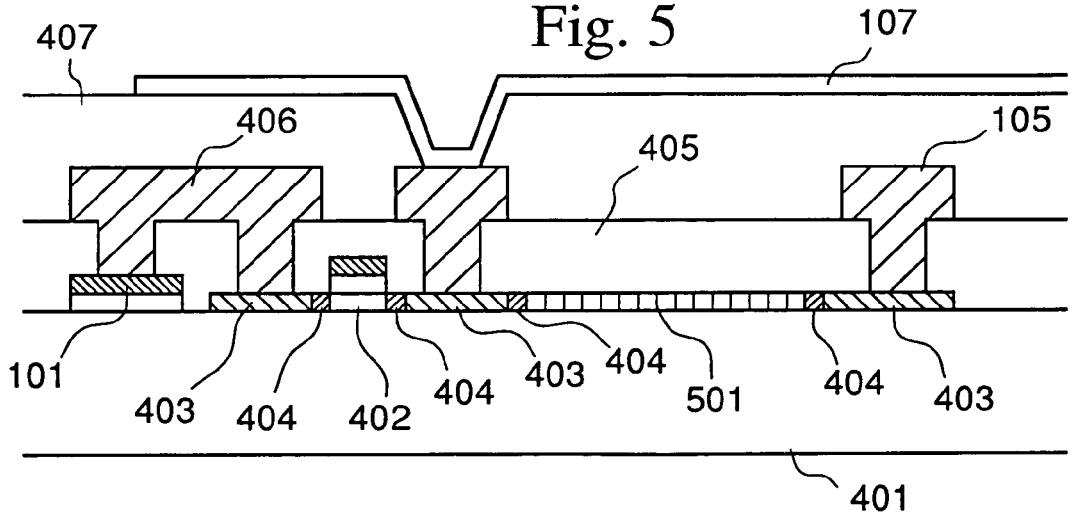
FIG. 5 is a diagram showing the structure of a resistor constituting the liquid crystal display device of the present invention.

Next, an example of where the resistor RL is formed from a semiconductor thin film (i layer) 501 which has not been doped with impurities is shown in FIG. 5. Here the length and width of the i layer 501 forming the resistor are designed so that equation (1) is satisfied. Furthermore, in the case where the i layer 501 is used as the resistor RL, then as shown in the figure, a p-type lightly doped p− layer 404 is formed between a source-drain electrode (p+) 403 on the side of the p-type p-SiTFT 402 which is connected to the pixel electrode 107, and the resistor RL (i layer) 501. This is because if the p+ layer and the i layer are contacted, an extremely high short key resistance is formed, and a resistance satisfying equation (1) can no longer be formed on the small area. Similarly, a p− layer 404 is formed between the p+ electrode 403 connected to the voltage holding capacitor electrode 105, and the i layer 501.

Figure 6:
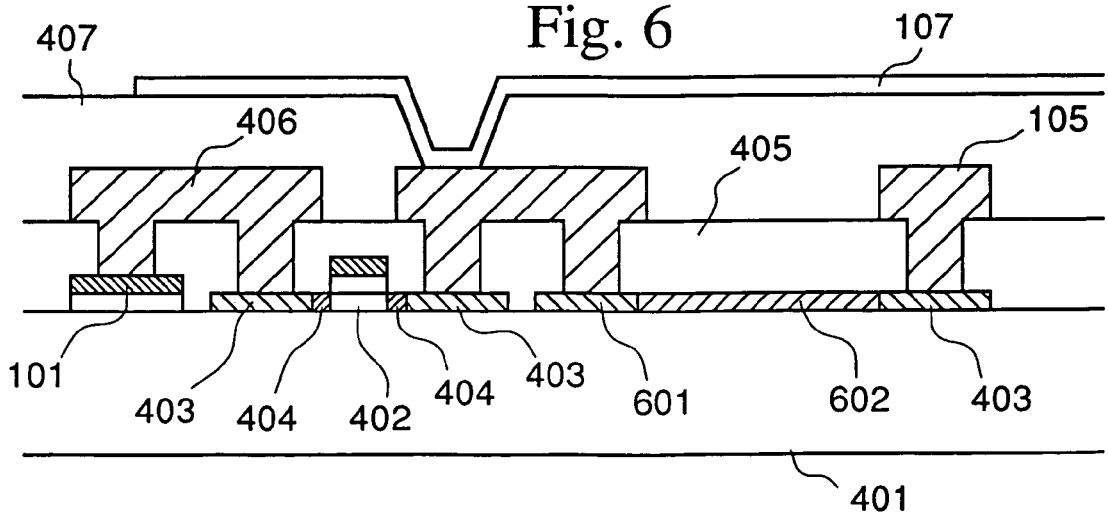
FIG. 6 is a diagram showing the structure of a resistor constituting the liquid crystal display device of the present invention.

Next, an example for the case where the resistor RL is formed from an n-type semiconductor thin film (n−) which has been lightly doped is shown in FIG. 6. Here with the portion of the n− layer 602 which forms the resistor, the amount of impurity doping, and the length and width are designed so that the conditions shown in equation (1) are satisfied. In the case where the source-drain electrode (p+ layer) 403 of the p-type p-SiTFT 402, and the n− layer 602 are connected, then as shown in the figure, the p+ layer 403 and the n+ layer 601 are connected through a metal layer 406, and the n+ layer 601 is contacted with the n− layer 602.

In the above, the description has been for the case where the resistor RL shown in FIG. 3 is formed from a semiconductor thin film or a semiconductor thin film doped with impurities. However provided the resistance satisfies equation (1), then other materials may be employed.

Figure 7:
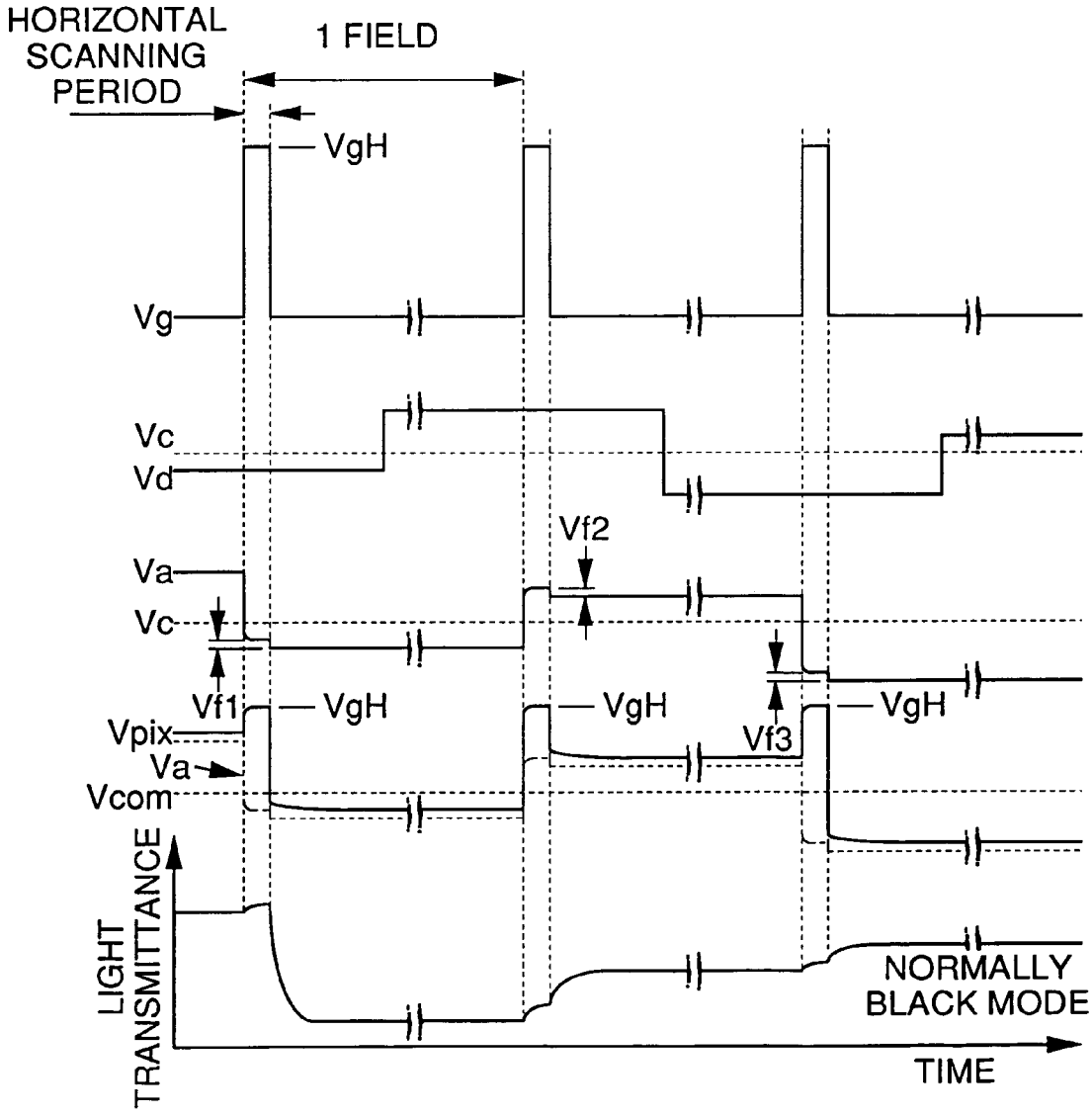
FIG. 7 is a diagram illustrating a drive method for the liquid crystal display device of the present invention.

As follows is a description of the drive method for the liquid crystal display device using the pixel construction shown in FIG. 3. FIG. 7 shows the timing chart, and the change in light transmittance of the liquid crystal, for a gate scanning voltage Vg, a data signal voltage Vd, a gate voltage Va of the p-type MOS transistor (Qp) 302, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 3. Here the example is given for when the liquid crystal operates in a normally black mode, becoming dark when a voltage is not applied. As shown in the figure, due to the gate scanning voltage Vg in the horizontal scanning period becoming a high level VgH, the n-type MOS transistor (Qn) 301 comes on, and the data signal Vd input to the signal line is transferred to the gate electrode of the p-type MOS transistor (Qp) 302 through the n-type MOS transistor (Qn) 301. On the other hand, in the horizontal scanning period, the pixel electrode 107 attains the reset state due to the gate scanning voltage VgH being transferred through the p-type MOS transistor (Qp) 302. Here as described below, the p-type MOS transistor (Qp) 302 operates as a source follower type analog amplifier, after the horizontal scanning period is completed. However due to the pixel voltage Vpix becoming VgH in the horizontal scanning period, the resetting of the p-type MOS transistor (Qp) 302 is performed at the same time.

When the horizontal scanning period is completed and the gate scanning voltage Vg becomes a low level, the n-type MOS transistor (Qn) 301 goes off, and the data signal transferred to the gate electrode of the p-type MOS transistor (Qp) 302 is held by the voltage holding capacitor 105. At this time, with the gate input voltage Va of the p-type MOS transistor, at the time when the n-type MOS transistor (Qn) 301 goes off, a voltage shift referred to as a feed-through voltage occurs through the capacitance between the gate and the source of the n-type MOS transistor (Qn) 301. In FIG. 7 this is shown by Vf1, Vf2 and Vf3. The amount of this voltage shift Vf1, Vf2 and Vf3 can be made smaller by designing the value for the voltage holding capacitor 105 to be large. The gate input voltage Va of the p-type MOS transistor (Qp) 302 is held until the gate scanning voltage Vg again becomes a high level in the subsequent field period and the n-type MOS transistor (Qn) 301 is selected. On the other hand, the p-type MOS transistor (Qp) 302, on completion of resetting in the horizontal scanning period, operates as a source follower type analog amplifier with the pixel electrode 107 as the source electrode. At this time, in order to operate the p-type MOS transistor (Qp) 302 as an analog amplifier, a voltage at least higher than (Vdmax−Vtp) is supplied to the voltage holding capacitor electrode 105. Here Vdmax is the maximum value of the data signal voltage Vd, while Vtp is the threshold value voltage of the p-type MOS transistor (Qp) 302. The p-type MOS transistor (Qp) 302, during the period in the subsequent field up until the gate scanning voltage becomes VgH to thus execute reset, can output an analog gradation voltage corresponding to the held gate input voltage Va. This output voltage changes depending on the transconductance gmp of the p-type MOS transistor, and the value of the resistor RL 303, however it is generally represented by the following equation:

$$Vpix \approx Va - Vtp \tag{2}$$

Here Vtp is normally a negative value, and hence as shown in FIG. 7, the pixel voltage Vpix becomes a voltage which is higher than Va by the absolute value of the threshold value voltage of the p-type MOS transistor (Qp) 302. In this way, the fluctuations in the pixel voltage Vpix accompanying the response of the liquid crystal as discussed for the conventional technology can be eliminated, and as also shown by the liquid crystal light transmittance in FIG. 7, it becomes possible to obtain a desired gradation for each one field.

Furthermore, with the liquid crystal display device of the present invention, the construction is such that the scanning voltage is used as the power supply for the p-type MOS transistor (Qp) 302 which operates as an analog amplifier, and as the reset power supply, and resetting of the amplifier is performed by the p-type MOS transistor (Qp) 302 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 301 and the p-type MOS transistor (Qp) 302 were formed from p-SiTFTs. However these may be formed from other thin film transistors such as a-SiTFTs or CdSeTFTs. Moreover these may be formed from single crystal silicon transistors.

Figure 8:
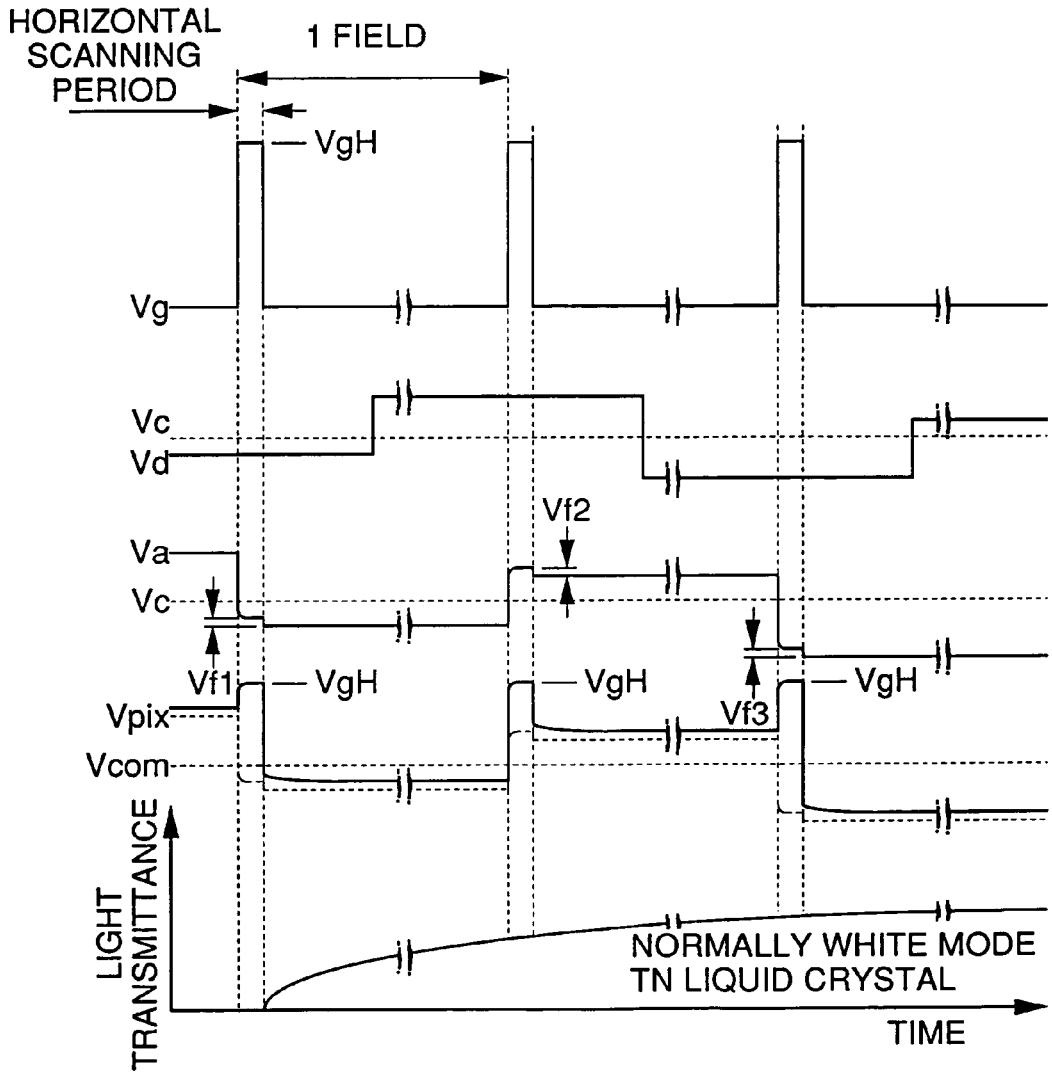
FIG. 8 is a diagram illustrating a drive method for the liquid crystal display device of the present invention.
Figure 61:
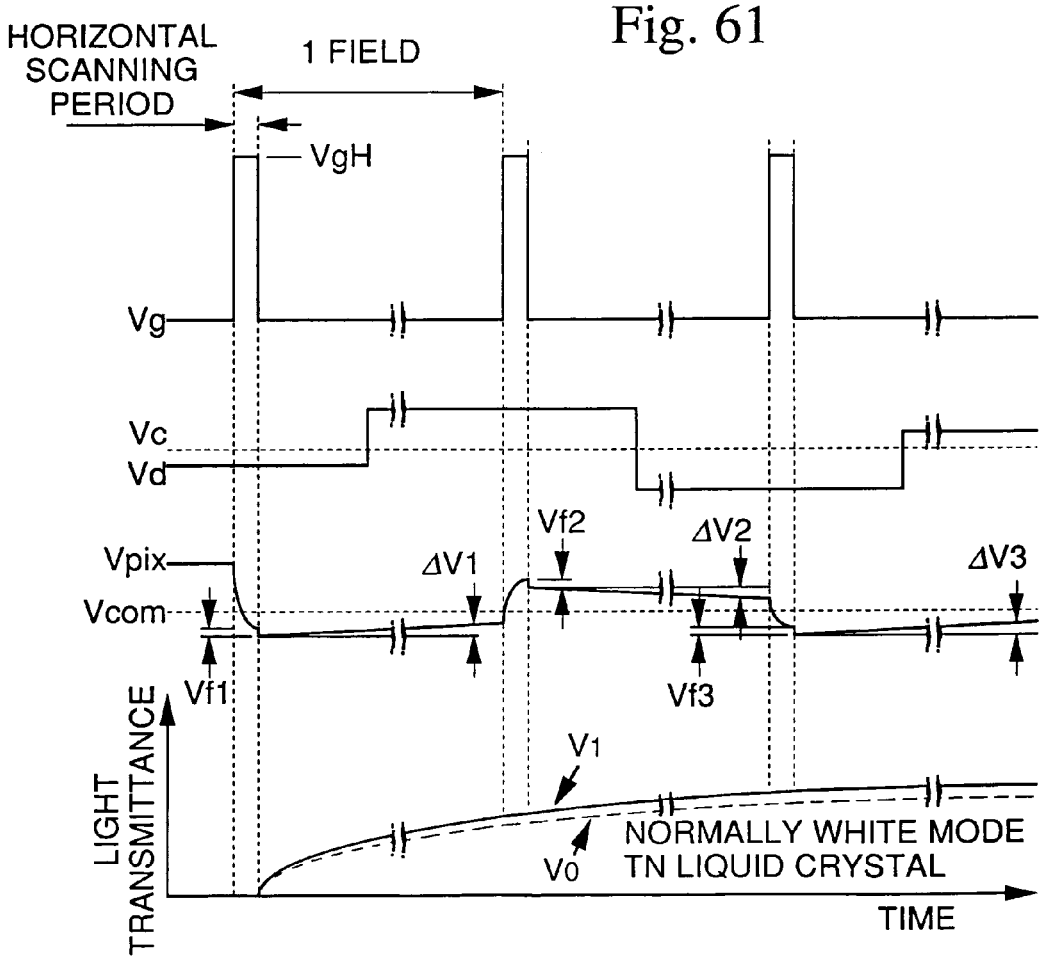
FIG. 61 is a diagram illustrating a drive method for a conventional liquid crystal display device.

Next is a description of a method of driving a TN liquid crystal using the liquid crystal display device of the present invention shown in FIG. 3. FIG. 8 shows the timing chart, and the change in light transmittance of the liquid crystal, for a gate scanning voltage Vg, a data signal voltage Vd, the gate voltage Va of the p-type MOS transistor (Qa) 302, and the pixel voltage Vpix, for this case. Here the example is given for when the liquid crystal operates in a normally white mode, becoming bright when a voltage is not applied. Furthermore, for the data signal Vd, the example is given for where a signal voltage for creating a bright state over several fields is applied. The drive method is the same as for the one shown in the beforementioned FIG. 7. With the TN liquid crystal, since the response time is around several tens of msec to 100 mec, then as shown in FIG. 8, the TN liquid crystal undergoes a transition to the bright state over several fields. During this time, the liquid crystal capacitance changes due to the molecules of the TN liquid crystal switching. With the conventional liquid crystal display device, as shown in the beforementioned FIG. 61, the pixel voltage Vpix fluctuates, and hence the inherent liquid crystal light transmittance T0 cannot be obtained. On the other hand, with the liquid crystal display device of the present invention, the p-type MOS transistor (Qp) 302 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

Figure 9:
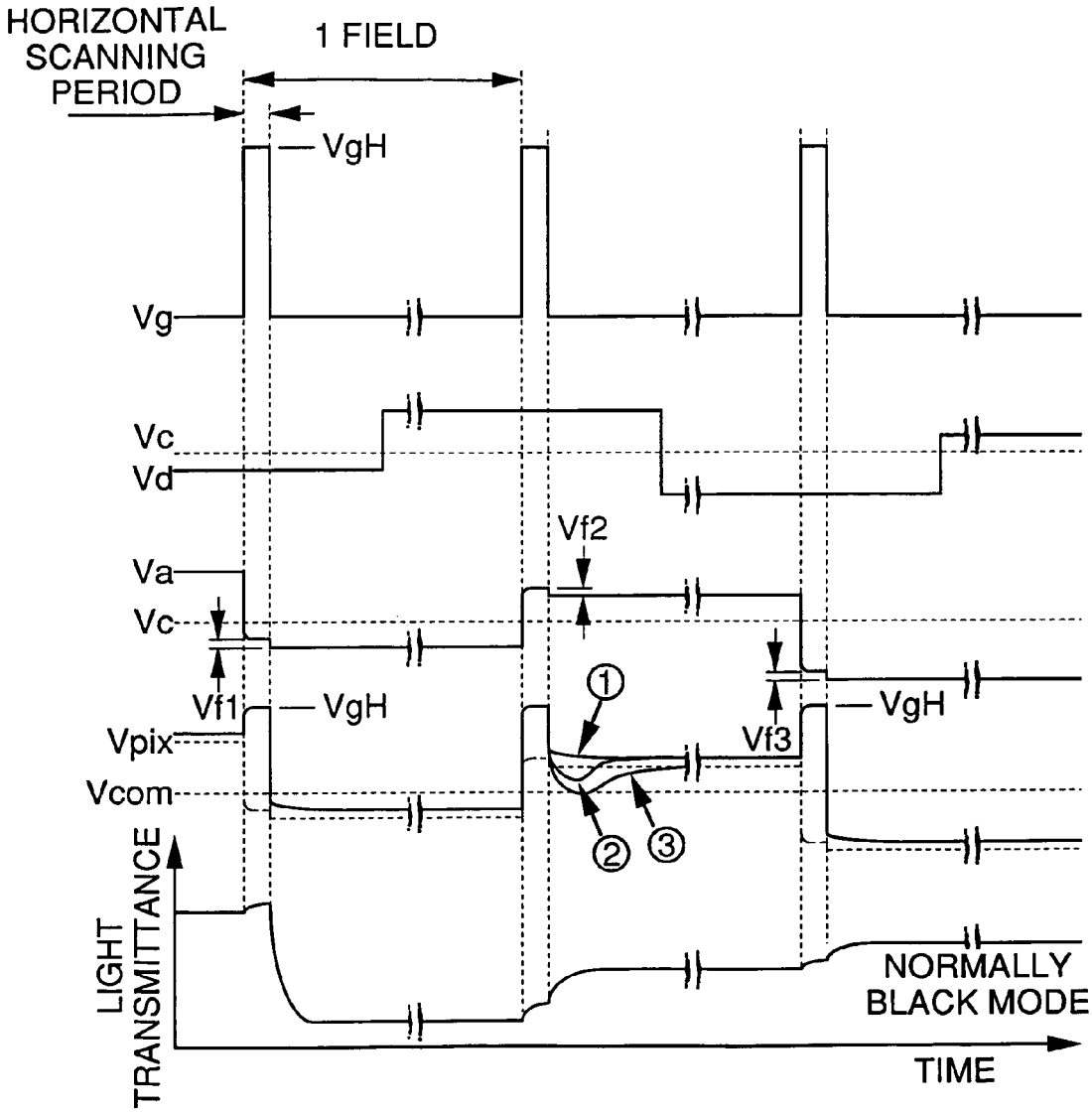
FIG. 9 is a diagram illustrating a drive method for the liquid crystal display device of the present invention.

Next is a description of the change of the pixel voltage Vpix when the value of the resistor RL 303 is changed, in the liquid crystal display device of the present invention shown in FIG. 3. FIG. 9 shows aspects of the change of the pixel voltage Vpix for the case where the value of the resistor RL 303 in FIG. 3 is changed with respect to the liquid crystal resistance Rsp in FIG. 62, to (1) Rsp/4, (2) Rsp and (3) 2×Rsp. As shown in the figure, in the case where the value of the resistor RL 303 is greater than that of the liquid crystal resistance Rsp ((3)), the pixel voltage Vpix shows a large fluctuation in the field in which a positive polarity signal is written. On the other hand, in the case where the value of the resistor RL 303 is less than or equal to that of the liquid crystal resistance Rsp ((1),(2)), the fluctuation in the pixel voltage Vpix is practically gone. In the case where the value of the resistor RL 303 is the same as that of the liquid crystal resistance Rsp ((2)), only a slight fluctuation is observed, and since the period of this fluctuation is extremely short compared to the period of one field, it has no influence on performing gradation display control.

Due to the above described reasons, in the liquid crystal display device shown in FIG. 3, the resistor RL 303 is designed so that the conditions shown in equation (1) are satisfied. In practice, the value of the resistor RL 303 is determined taking into consideration the fluctuation amount of the pixel voltage Vpix, and the power consumption. In order to reduce power consumption, it is desirable to design the value of the resistor RL 303 so as to be as large as possible within the range where the fluctuations of the pixel voltage Vpix do not exert an influence on the liquid crystal light transmittance.

When the above described liquid crystal display device and drive method of the second embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 10:
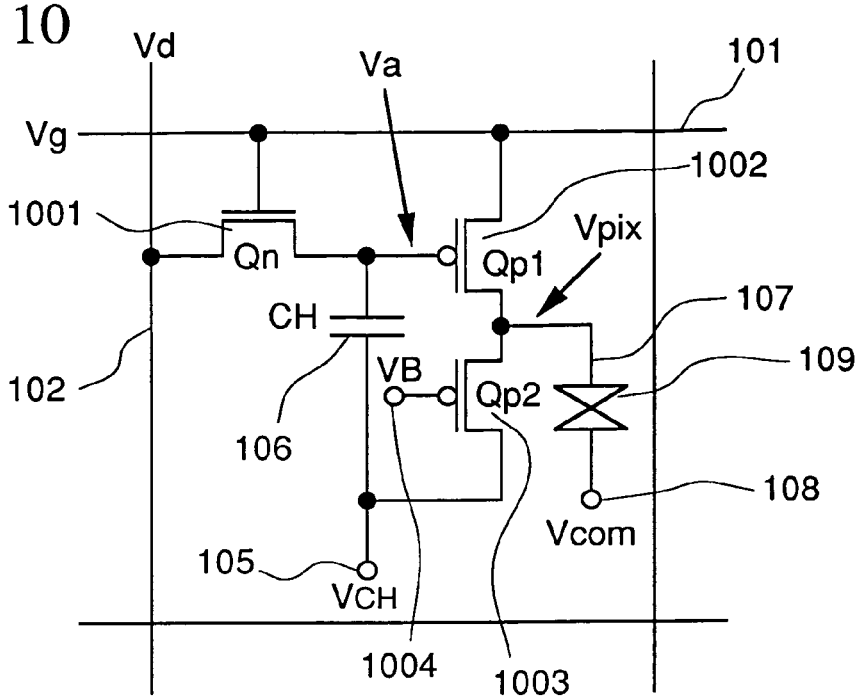
FIG. 10 is a diagram showing a third embodiment of a liquid crystal display device of the present invention.

A third embodiment of the present invention will now be described in detail with reference to the figures. FIG. 10 is a diagram showing a third embodiment of a liquid crystal display device of the present invention. As shown in the figure, the liquid crystal display device of the present invention comprises: an n-type MOS transistor (Qn) 1001 with a gate electrode connected to a scanning line 101, and one of a source electrode and a drain electrode connected to a signal line 102; a first p-type MOS transistor (Qp1) 1002 with a gate electrode connected to the other of the source electrode and the drain electrode of the n-type MOS transistor (Qn) 1001, and one of a source electrode and a drain electrode connected to the scanning line 101, and the other of the source electrode and the drain electrode connected to a pixel electrode 107; a voltage holding capacitor 106 formed between the gate electrode of the first p-type MOS transistor (Qp1) f002 and a voltage holding capacitor electrode 105; a second p-type MOS transistor (Qp2) 1003 with a gate electrode connected to a bias power supply VB 1004, a source electrode connected to the voltage holding capacitor electrode 105, and a drain electrode connected to the pixel electrode 107, and a liquid crystal 109 which is to be switched, disposed between the pixel electrode 107 and an opposing electrode 108. Here the n-type MOS transistor (Qn) 1001 and the first and second p-type MOS transistors (Qp1) 1002 and (Qp2) 1003 are constituted by p-SiTFTs. The bias power supply VB 1004 for supply to the gate electrode of the second p-type MOS transistor (Qp2) 1003, is set so that a source-drain resistance Rdsp of the second p-type MOS transistor (Qp2) 1003 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the following equation:

$$Rdsp \leqq Rr,\ Rdsp \leqq Rsp \tag{3}$$

Figure 11:
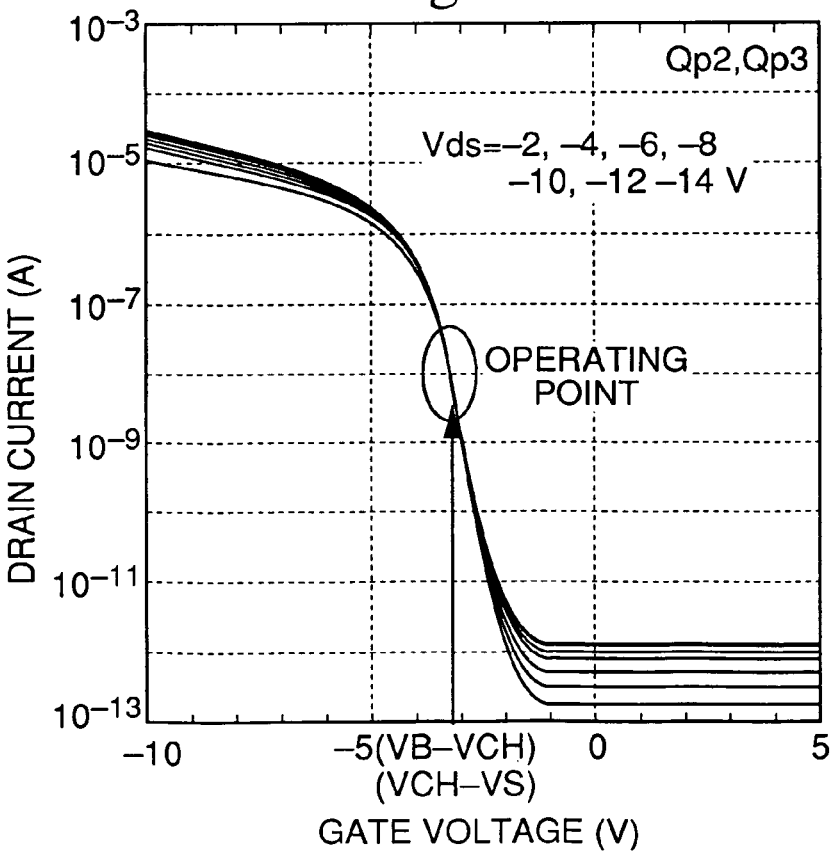
FIG. 11 is a diagram showing an operating point of a MOS type transistor constituting the liquid crystal display device of the present invention.

For example, in the case when the resistance Rsp is 5 GΩ, then a bias power supply VB 1004 such that the source-drain resistance Rdsp does not exceed 1 GΩ is supplied. FIG. 11 shows the drain current-gate current characteristics of the second p-type MOS transistor (Qp2) 1003, and the operating point. With the example in the figure, the gate-source voltage (VB−VCH) of the second p-type MOS transistor (Qp2) 1003 is set to around −3V. For example, the voltage holding capacitor voltage VCH is set to 20V, and VB is set to 17V. As a result, when the drain current of the second p-type MOS transistor (Qp2) 1003 becomes around 1E-8 (A) and the source-drain voltage Vdsp is −10V, then the source-drain resistance Rdsp becomes 1 GΩ. Furthermore, even if the second p-type MOS transistor (Qp2) 1003 is operated in the weakly inverted region with the source-drain voltage Vdsp changing from −2 to −14V, the drain current is approximately constant. The second p-type MOS transistor (Qp2) 1003 is operated as the bias current power supply for the case where the first p-type MOS transistor (Qp1) 1002 is operated as an analog amplifier.

The above described drive method for the liquid crystal display device of the third embodiment shown in FIG. 10 is the same as the drive method for the liquid crystal display device of the second embodiment shown beforehand in FIG. 3. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 7, while in the case where a TN liquid crystal is driven, these are the same as those shown in FIG. 8.

That is to say, if the liquid crystal display device shown in FIG. 10 is used, then as with the second embodiment, the fluctuations of the pixel voltage Vpix accompanying the response of the liquid crystal can be eliminated, enabling a desired gradation to be obtained for each one field.

Moreover, with the liquid crystal display device shown in FIG. 10, the construction is such that the scanning voltage is used as the power supply for the first p-type MOS transistor (Qp1) 1002 which operates as an analog amplifier, and as the reset power supply, and resetting of the amplifier is performed by the first p-type MOS transistor (Qp1) 1002 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 1001 and the first and second p-type MOS transistors (Qp1) 1002 and (Qp2) 1003 were formed from p-SiTFTs. However these may be formed from other thin film transistors such as a-SiTFTs or CdSeTFTs. Moreover these may be formed from single crystal silicon transistors.

When the above described liquid crystal display device and drive method of the third embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 12:
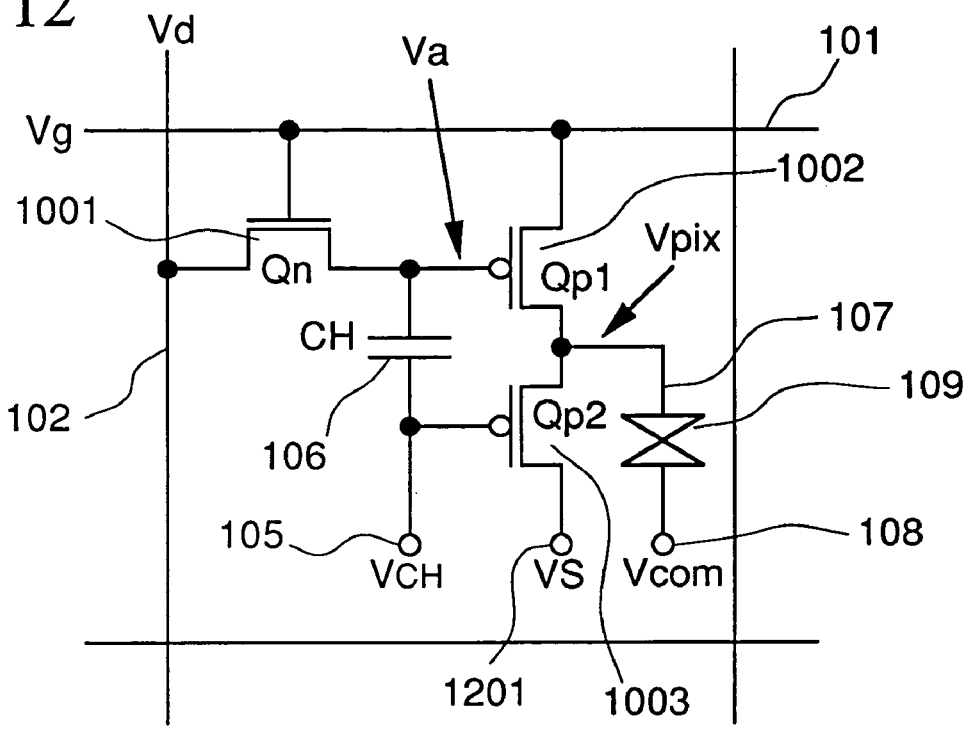
FIG. 12 is a diagram showing a fourth embodiment of a liquid crystal display device of the present invention.

A fourth embodiment of the present invention will now be described in detail with reference to the figures. FIG. 12 is a diagram showing a fourth embodiment of a liquid crystal display device of the present invention. As shown in the figure, the liquid crystal display device of the present invention comprises: an n-type MOS transistor (Qn) 1001 with a gate electrode connected to a scanning line 101, and one of a source electrode and a drain electrode connected to a signal line 102; a first p-type MOS transistor (Qp1) 1002 with a gate electrode connected to the other of the source electrode and the drain electrode of the n-type MOS transistor (Qn) 1001, and one of a source electrode and a drain electrode connected to the scanning line 101, and the other of the source electrode and the drain electrode connected to a pixel electrode 107; a voltage holding capacitor 106 formed between the gate electrode of the first p-type MOS transistor (Qp1) 1002 and a voltage holding capacitor electrode 105; a second p-type MOS transistor (Qp2) 1003 with a gate electrode connected to the voltage holding capacitor electrode 105, a source electrode connected to a source power supply VS 1201, and a drain electrode connected to the pixel electrode 107; and a liquid crystal 109 which is to be switched, disposed between the pixel electrode 107 and an opposing electrode 108. Here the n-type MOS transistor (Qn) 1001 and the first and second p-type MOS transistors (Qp1) 1002 and (Qp2) 1003 are constituted by p-SiTFTs.

The source power supply VS 1201 for supply to the source electrode of the second p-type MOS transistor (Qp2) 1003, is set so that the source-drain resistance Rdsp of the second p-type MOS transistor (Qp2) 1003 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previous equation (3). For example, in the case when the resistance Rsp is 5 GΩ, then a source power supply VS 1201 such that the source-drain resistance Rdsp does not exceed 1 GΩ is supplied. The operating point for the second p-type MOS transistor (Qp2) 1003 is the same as the operating point shown in FIG. 11. That is, with the example in the figure, the gate-source voltage (VCH−VS) of the second p-type MOS transistor (Qp2) 1003 is set to around −3V. For example, the voltage holding capacitor voltage VCH is set to 17V, and VS is set to 20V. As a result, when the drain current of the second p-type MOS transistor (Qp2) 1003 becomes around 1E-8 (A) and the source-drain voltage Vdsp is −10V, then the source-drain resistance Rdsp becomes 1 GΩ. Furthermore, even if the second p-type MOS transistor (Qp2) 1003 is operated in the weakly inverted region with the source-drain voltage Vdsp changing from −2 to −14V, the drain current is approximately constant. The second p-type MOS transistor (Qp2) 1003 is operated as the bias current power supply for the case where the first p-type MOS transistor (Qp1) 1002 is operated as an analog amplifier.

The above described drive method for the liquid crystal display device of the fourth embodiment shown in FIG. 12 is the same as the drive method for the liquid crystal display device of the second and third embodiments shown beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 7, while in the case where a TN liquid crystal is driven, these are the same as those shown in FIG. 8.

That is to say, if the liquid crystal display device shown in FIG. 12 is used, then as with the second and third embodiments, the fluctuations of the pixel voltage Vpix accompanying the response of the liquid crystal can be eliminated, enabling a desired gradation to be obtained for each one field.

Moreover, with the liquid crystal display device shown in FIG. 12, the construction is such that the scanning voltage is used as the power supply for the first p-type MOS transistor (Qp1) 1002 which operates as an analog amplifier, and as the reset power supply, and resetting of the amplifier is performed by the first p-type MOS transistor (Qp1) 1002 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 1001 and the first and second p-type MOS transistors (Qp1) 1002 and (Qp2) 1003 were formed from p-SiTFTs. However these may be formed from other thin film transistors such as a-SiTFTs or CdSeTFTs. Moreover these may be formed from single crystal silicon transistors.

When the above described liquid crystal display device and drive method of the fourth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 13:
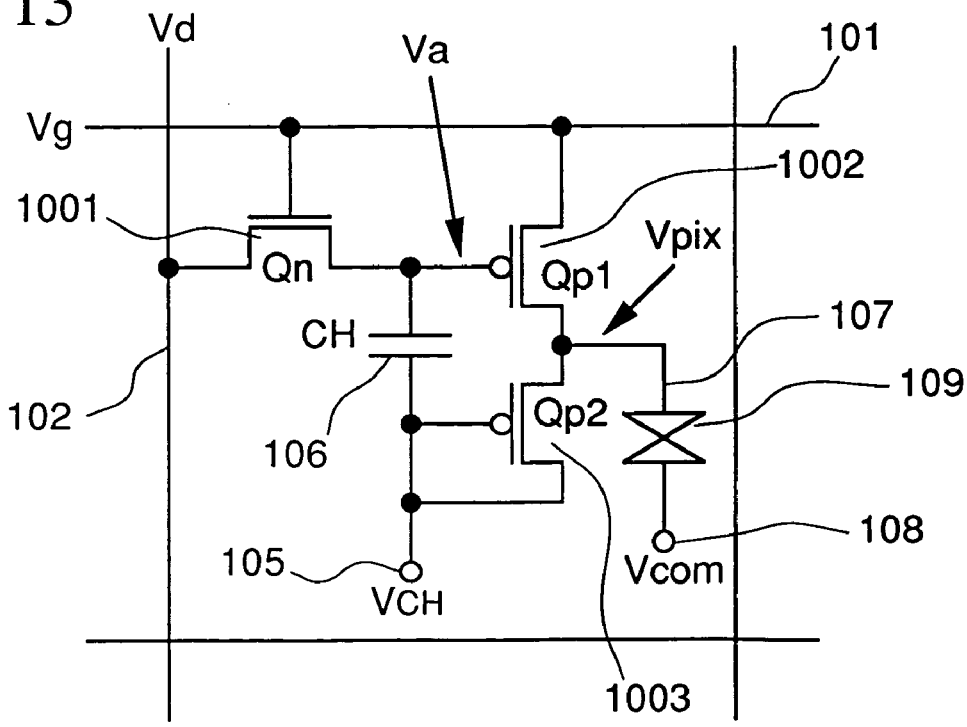
FIG. 13 is a diagram showing a fifth embodiment of a liquid crystal display device of the present invention.

A fifth embodiment of the present invention will now be described in detail with reference to the figures. FIG. 13 is a diagram showing a fifth embodiment of a liquid crystal display device of the present invention. As shown in the figure, the liquid crystal display device of the present invention comprises: an n-type MOS transistor (Qn) 1001 with a gate electrode connected to a scanning line 101, and one of a source electrode and a drain electrode connected to a signal line 102; a first p-type MOS transistor (Qp1) 1002 with a gate electrode connected to the other of the source electrode and the drain electrode of the n-type MOS transistor (Qn) 1001, and one of a source electrode and a drain electrode connected to the scanning line 101, and the other of the source electrode and the drain electrode connected to a pixel electrode 107; a voltage holding capacitor 106 formed between the gate electrode of the first p-type MOS transistor (Qp1) 1002 and a voltage holding capacitor electrode 105; a second p-type MOS transistor (Qp2) 1003 with a gate electrode and a source electrode connected to the voltage holding capacitor electrode 105 and a drain electrode connected to the pixel electrode 107; and a liquid crystal 109 which is to be switched, disposed between the pixel electrode 107 and an opposing electrode 108. Here the n-type MOS transistor (Qn) 1001 and the first and second p-type MOS transistors (Qp1) 1002 and (Qp2) 1003 are constituted by p-SiTFTs.

Figure 14:
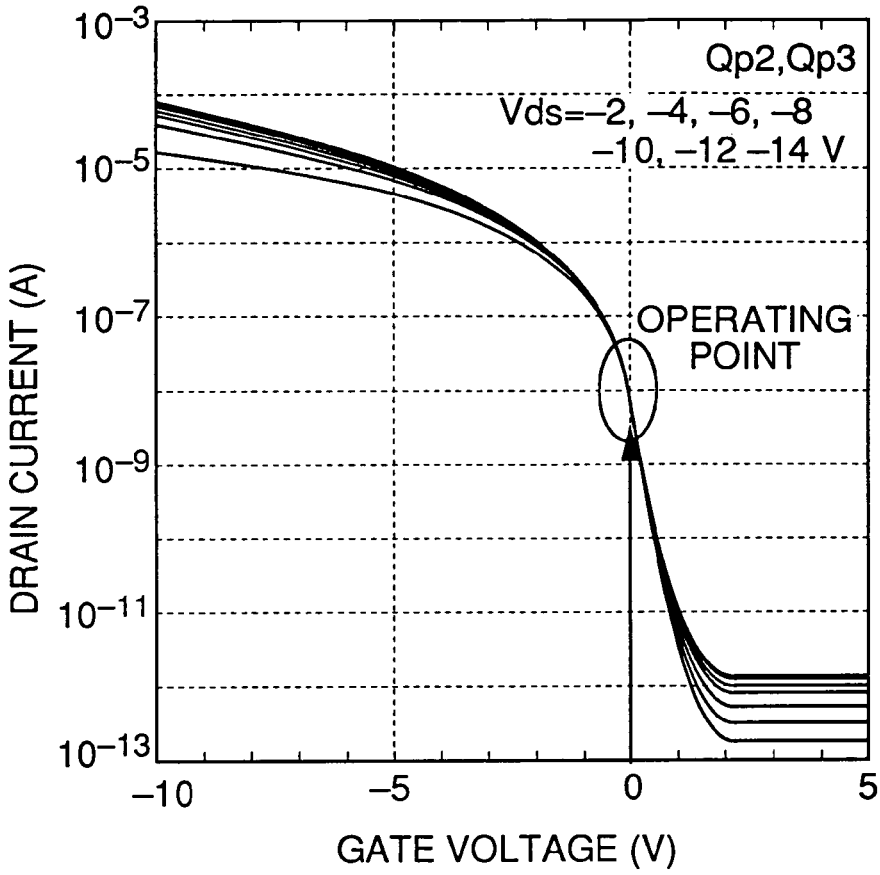
FIG. 14 is a diagram showing an operating point of a MOS type transistor constituting the liquid crystal display device of the present invention.

Furthermore, since the gate electrode and the source electrode of the second p-type MOS transistor (Qp2) 1003 are both connected to the voltage holding capacitor electrode 105, then the gate-source voltage Vgsp of the second p-type MOS transistor (Qp2) 1003 becomes 0V. Under this bias condition, so that the source-drain resistance Rdsp of the second p-type MOS transistor (Qp2) 1003 satisfies the beforementioned equation (3), the threshold value voltage of the second p-type MOS transistor (Qp2) 1003 is shift controlled to the positive side by channel-dose. FIG. 14 shows the drain current-gate voltage characteristics of the second p-type MOS transistor (Qp2) 1003, and the operating point. As shown in the figure, the threshold value voltage is shift controlled to the positive side by channel-dose so that when the gate-source voltage is 0V, the drain current becomes approximately 1E-8 (A). As a result, when the drain current of the second p-type MOS transistor (Qp2) 1003 becomes around 1E-8 (A) and the source-drain voltage Vdsp is −10V, then the source-drain resistance Rdsp becomes 1 GΩ. Furthermore, even if the second p-type MOS transistor (Qp2) 1003 is operated in the weakly inverted region with the source-drain voltage Vdsp changing from −2 to −14V, the drain current is approximately constant. The second p-type MOS transistor (Qp2) 1003 is operated as the bias current power supply for the case where the first p-type MOS transistor (Qp1) 1002 is operated as an analog amplifier.

With the fifth embodiment, the bias power supply VB 1004, and the source power supply VS 1201 necessary in the third and fourth embodiments are not necessary. However a channel-dose forming step is additionally required.

The above described drive method for the liquid crystal display device of the fifth embodiment shown in FIG. 13 is the same as the drive method for the liquid crystal display device of the second through fourth embodiments shown beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 7, while in the case where a TN liquid crystal is driven, these are the same as those shown in FIG. 8.

That is to say, if the liquid crystal display device shown in FIG. 13 is used, then as with the second through fourth embodiments, the fluctuations of the pixel voltage Vpix accompanying the response of the liquid crystal can be eliminated, enabling a desired gradation to be obtained for each one field.

Moreover, with the liquid crystal display device shown in FIG. 13, the construction is such that the scanning voltage is used as the power supply for the first p-type MOS transistor (Qp1) 1002 which operates as an analog amplifier, and as the reset power supply, and resetting of the amplifier is performed by the first p-type MOS transistor (Qp1) 1002 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 1001 and the first and second p-type MOS transistors (Qp1) 1002 and (Qp2) 1003 were formed from p-SiTFTs. However these may be formed from other thin film transistors such as a-SiTFTs or CdSeTFTs. Moreover these may be formed from single crystal silicon transistors.

When the above described liquid crystal display device and drive method of the fifth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 15:
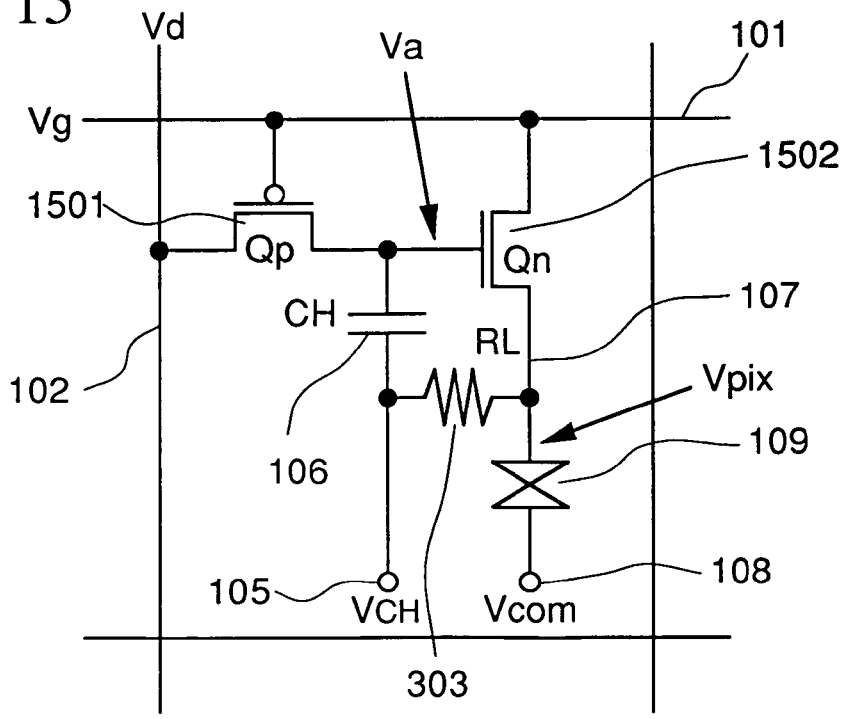
FIG. 15 is a diagram showing a sixth embodiment of a liquid crystal display device of the present invention.

A sixth embodiment of the present invention will now be described in detail with reference to the figures. FIG. 15 is a diagram showing a sixth embodiment of a liquid crystal display device of the present invention. As shown in the figure, the liquid crystal display device of the present invention comprises: a p-type MOS transistor (Qp) 1501 with a gate electrode connected to a scanning line 101, and one of a source electrode and a drain electrode connected to a signal line 102; an n-type MOS transistor (Qn) 1502 with a gate electrode connected to the other of the source electrode and the drain electrode of the p-type MOS transistor (Qp) 1501, and one of a source electrode and a drain electrode connected to the scanning line 101, and the other of the source electrode and the drain electrode connected to a pixel electrode 107; a voltage holding capacitor 106 formed between the gate electrode of the n-type MOS transistor (Qn) 1502 and a voltage holding capacitor electrode 105; a resistor RL 1503 connected between the pixel electrode 107 and the voltage holding capacitor electrode 105; and a liquid crystal 109 which is to be switched, disposed between the pixel electrode 107 and an opposing electrode 108. Here the p-type MOS transistor (Qp) 1501 and the n-type MOS transistor (Qn) 1502 are constituted by p-SiTFTs.

Moreover, the value of the resistor RL 1503 is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 1503, have the relation shown by the previously mentioned equation (1).

For example, in the case when the resistance Rsp is 5 GΩ, then the value of the resistor RL 1503 is set to a value of around 1 GΩ. A value of 1 GΩ which is a large resistance not used in normal semiconductor integrated circuits, is formed from a semiconductor thin film or a semiconductor thin film which has been doped with impurities, as with the second embodiment.

Figure 16:
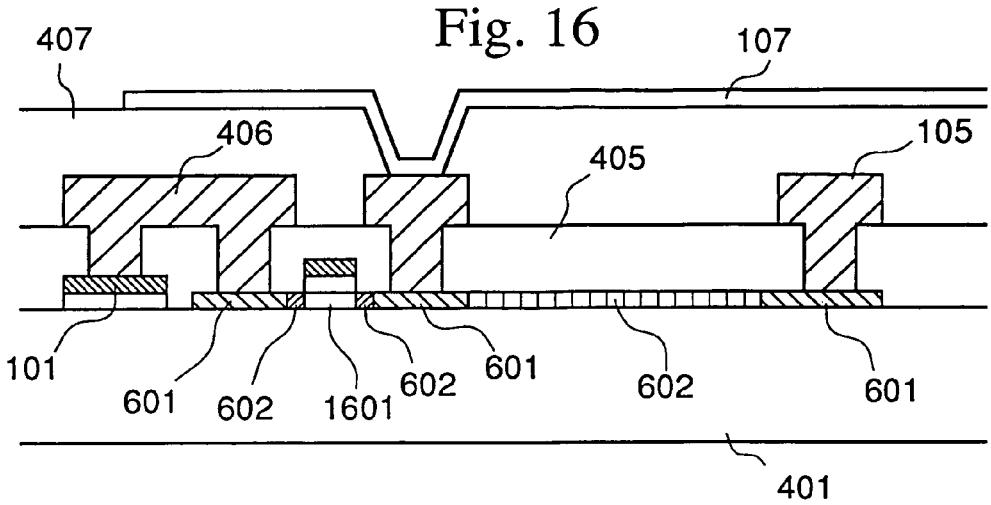
FIG. 16 is a diagram showing the structure of a resistor constituting the liquid crystal display device of the present invention.

FIG. 16 shows a structural example for the case where the resistor RL 1503 is formed from a lightly doped n-type semiconductor thin film (n−). In FIG. 16, the construction of an n-type p-SiTFT 1601 is also shown. As shown in the figure, one of the source and the drain electrodes of the n-type p-SiTFT 1601 is connected to the scanning line 101, and the other is connected to the pixel electrode 107. Here with the n− layer 602 portion which forms the resistor, the amount of impurity doping, and the length and width are designed so that the conditions shown in equation (1) are satisfied. Moreover, the n-type p-SiTFT 1601 has a lightly doped drain (referred to hereunder as an LDD) construction for high voltage endurance. In order to simplify the production process, the step of forming the LDD of the p-SiTFT 1601 and the step of forming the resistor RL (n−) are performed at the same time.

Figure 17:
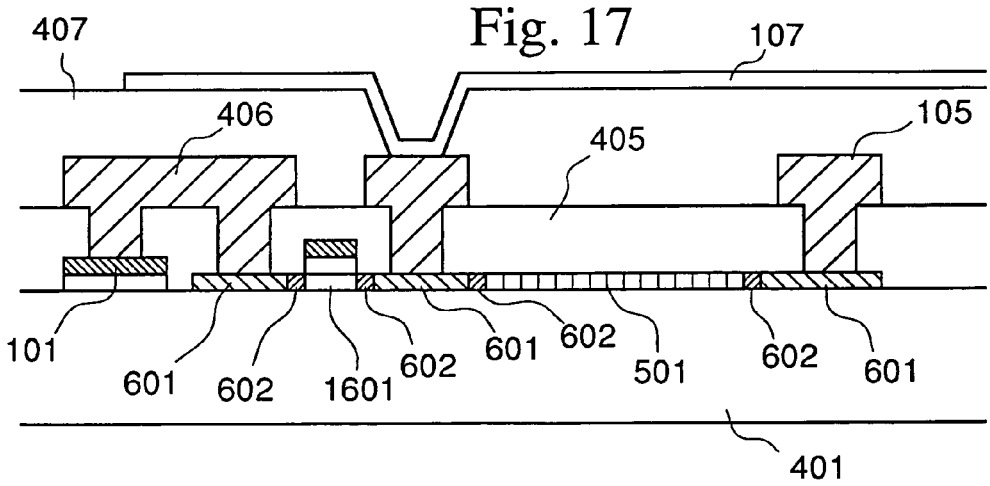
FIG. 17 is a diagram showing the structure of a resistor constituting the liquid crystal display device of the present invention.

Next, an example of where the resistor RL is formed from a semiconductor thin film (i layer) 501 which has not been doped with impurities is shown in FIG. 17. Here the length and width of the i layer 501 forming the resistor are designed so that equation (1) is satisfied. Furthermore, in the case where the i layer 501 is used as the resistor RL, then as shown in the figure, an n-type lightly doped n− layer 602 is formed between a source-drain electrode (n+) 601 on the side of the n-type p-SiTFT 1601 which is connected to the pixel electrode 107, and the resistor RL (i layer) 501. This is because if the n+ layer and the i layer are contacted, an extremely high short key resistance is formed, and a resistance satisfying equation (1) can no longer be formed on the small area. Similarly, an n− layer 602 is formed between the n+ electrode 601 connected to the voltage holding capacitor electrode 105, and the i layer 501.

Figure 18:
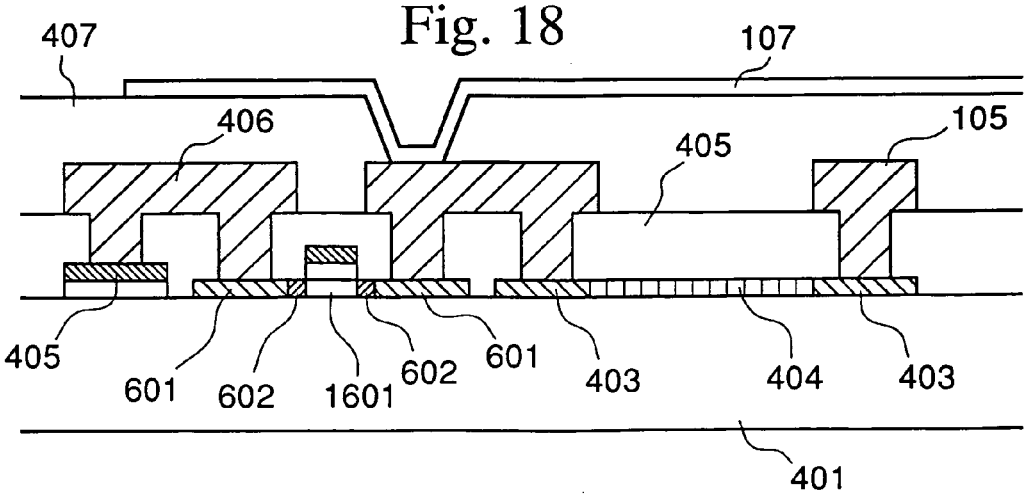
FIG. 18 is a diagram showing the structure of a resistor constituting the liquid crystal display device of the present invention.

Next, an example for the case where the resistor RL is formed from a p-type semiconductor thin film (p−) which has been lightly doped is shown in FIG. 18. Here with the portion of the p− layer 404 which forms the resistor, the amount of impurity doping, and the length and width are designed so that the conditions shown in equation (1) are satisfied. In the case where the source-drain electrode (n+ layer) 601 of the n-type p-SiTFT 1601, and the p− layer 404 are connected, then as shown in the figure, the n+ layer 601 and the p+ layer 403 are connected through the metal layer 406, and the p+ layer 403 is contacted with the p− layer 404.

In the above, the description has been for the case where the resistor RL 1503 shown in FIG. 15 is formed from a semiconductor thin film or a semiconductor thin film doped with impurities. However provided the resistance satisfies equation (1), then other materials may be employed.

Figure 19:
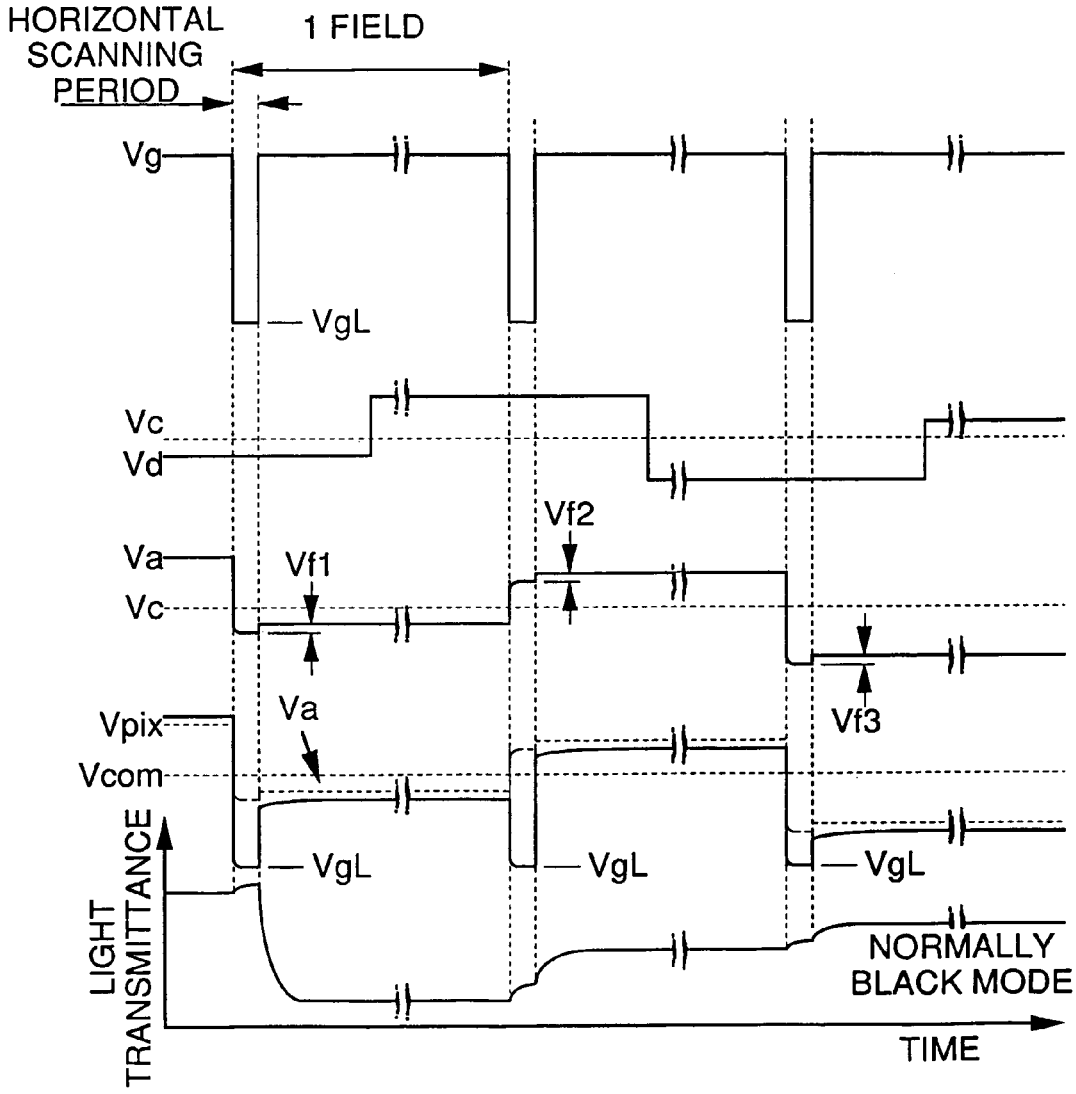
FIG. 19 is a diagram illustrating a drive method for the liquid crystal display device of the present invention.

As follows is a description of the drive method for the liquid crystal display device using the pixel construction shown in FIG. 15. FIG. 19 shows the timing chart, and the change in light transmittance of the liquid crystal, for a gate scanning voltage Vg, a data signal voltage Vd, a gate voltage Va of the n-type MOS transistor (Qn) 1502, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 15. Here the example is given for when the liquid crystal operates in a normally black mode, becoming dark when a voltage is not applied. As shown in the figure, due to the gate scanning voltage Vg in the horizontal scanning period becoming a low level VgL, the p-type MOS transistor (Qp) 1501 comes on, and the data signal Vd input to the signal line is transferred to the gate electrode of the n-type MOS transistor (Qn) 1502 through the p-type MOS transistor (Qp) 1501. On the other hand, in the horizontal scanning period, the pixel electrode 107 attains the reset state due to the gate scanning voltage VgL being transferred through the n-type MOS transistor (Qn) 1502. Here as described below, the n-type MOS transistor (Qn) 1502 operates as a source follower type analog amplifier, after the horizontal scanning period is completed. However due to the pixel voltage Vpix becoming VgL in the horizontal scanning period, the resetting of the n-type MOS transistor (Qn) 1502 is performed at the same time.

When the horizontal scanning period is completed and the gate scanning voltage Vg becomes a high level, the p-type MOS transistor (Qp) 1501 goes off, and the data signal transferred to the gate electrode of the n-type MOS transistor (Qn) 1502 is held by the voltage holding capacitor 105. At this time, with the gate input voltage Va of the n-type MOS transistor, at the time when the p-type MOS transistor (Qp) 1501 goes off, a voltage shift referred to as a feed-through voltage occurs through the capacitance between the gate and the source of the p-type MOS transistor (Qp) 1501. In FIG. 19 this is shown by Vf1, Vf2 and Vf3. The amount of this voltage shift Vf1, Vf2 and Vf3 can be made smaller by designing the value for the voltage holding capacitor 105 to be large. The gate input voltage Va of the n-type MOS transistor (Qn) 1502 is held until the gate scanning voltage Vg again becomes a low level in the subsequent field period and the p-type MOS transistor (Qp) 1501 is selected. On the other hand, the n-type MOS transistor (Qn) 1502, on completion of resetting in the horizontal scanning period, operates as a source follower type analog amplifier with the pixel electrode 107 as the source electrode. At this time, in order to operate the n-type MOS transistor (Qn) 1502 as an analog amplifier, a voltage at least lower than (Vdmin−Vtn) is supplied to the voltage holding capacitor electrode 105. Here Vdmin is the minimum value of the data signal voltage Vd, while Vtn is the threshold value voltage of the n-type MOS transistor (Qn) 1502. The n-type MOS transistor (Qn) 1502, during the period in the subsequent field up until the gate scanning voltage becomes VgL to thus execute reset, can output an analog gradation voltage corresponding to the held gate input voltage Va. This output voltage changes depending on the transconductance gmn of the n-type MOS transistor (Qn) 1502, and the value of the resistor RL 1503, however it is generally represented by the following equation:

$$Vpix \approx Va - Vtn \tag{4}$$

Here Vtn is normally a positive value, and hence as shown in FIG. 19, the pixel voltage Vpix becomes a voltage which is lower than Va by the threshold value voltage of the n-type MOS transistor (Qn) 1502.

In this way, the fluctuations in the pixel voltage Vpix accompanying the response of the liquid crystal as discussed for the conventional technology can be eliminated, and as also shown by the liquid crystal light transmittance in FIG. 19, it becomes possible to obtain a desired gradation for each one field.

Furthermore, with the liquid crystal display device of the present invention, the construction is such that the scanning voltage is used as the power supply for the n-type MOS transistor (Qn) 1502 which operates as an analog amplifier, and as the reset power supply, and resetting of the amplifier is performed by the n-type MOS transistor (Qn) 1502 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 1501 and the n-type MOS transistor (Qn) 1502 were formed from p-SiTFTs. However these may be formed from other thin film transistors such as a-SiTFTs or CdSeTFTs. Moreover these may be formed from single crystal silicon transistors.

Figure 20:
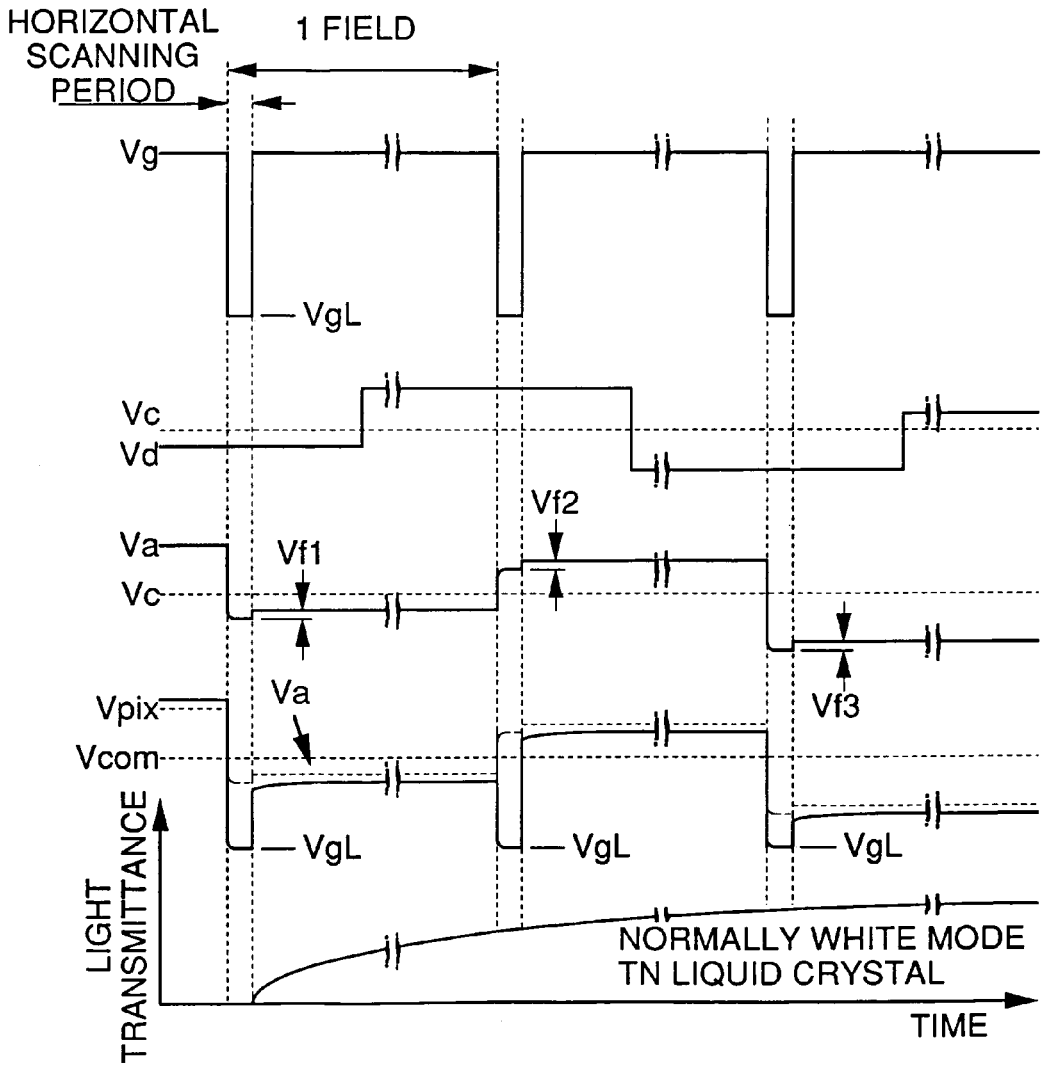
FIG. 20 is a diagram illustrating a drive method for the liquid crystal display device of the present invention.

Next is a description of a method of driving a TN liquid crystal using the liquid crystal display device of the present invention shown in FIG. 15. FIG. 20 shows the timing chart, and the change in light transmittance of the liquid crystal, for a gate scanning voltage Vg, a data signal voltage Vd, a gate voltage Va of the n-type MOS transistor (Qn) 1502, and a pixel voltage Vpix, for this case. Here the example is given for when the liquid crystal operates in a normally white mode, becoming bright when a voltage is not applied. Furthermore, for the data signal Vd, the example is given for where a signal voltage for creating a bright state over several fields is applied. The drive method is the same as for the one shown in the beforementioned FIG. 19. With the TN liquid crystal, since the response time is around several tens of msec to 100 mec, then as shown in FIG. 20, the TN liquid crystal undergoes a transition to the bright state over several fields. During this time, the liquid crystal capacitance changes due to the molecules of the TN liquid crystal switching. With the conventional liquid crystal display device, as shown in the beforementioned FIG. 61, the pixel voltage Vpix fluctuates, and hence the inherent liquid crystal light transmittance T0 cannot be obtained. On the other hand, with the liquid crystal display device of the present invention, the n-type MOS transistor (Qn) 1502 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

Figure 21:
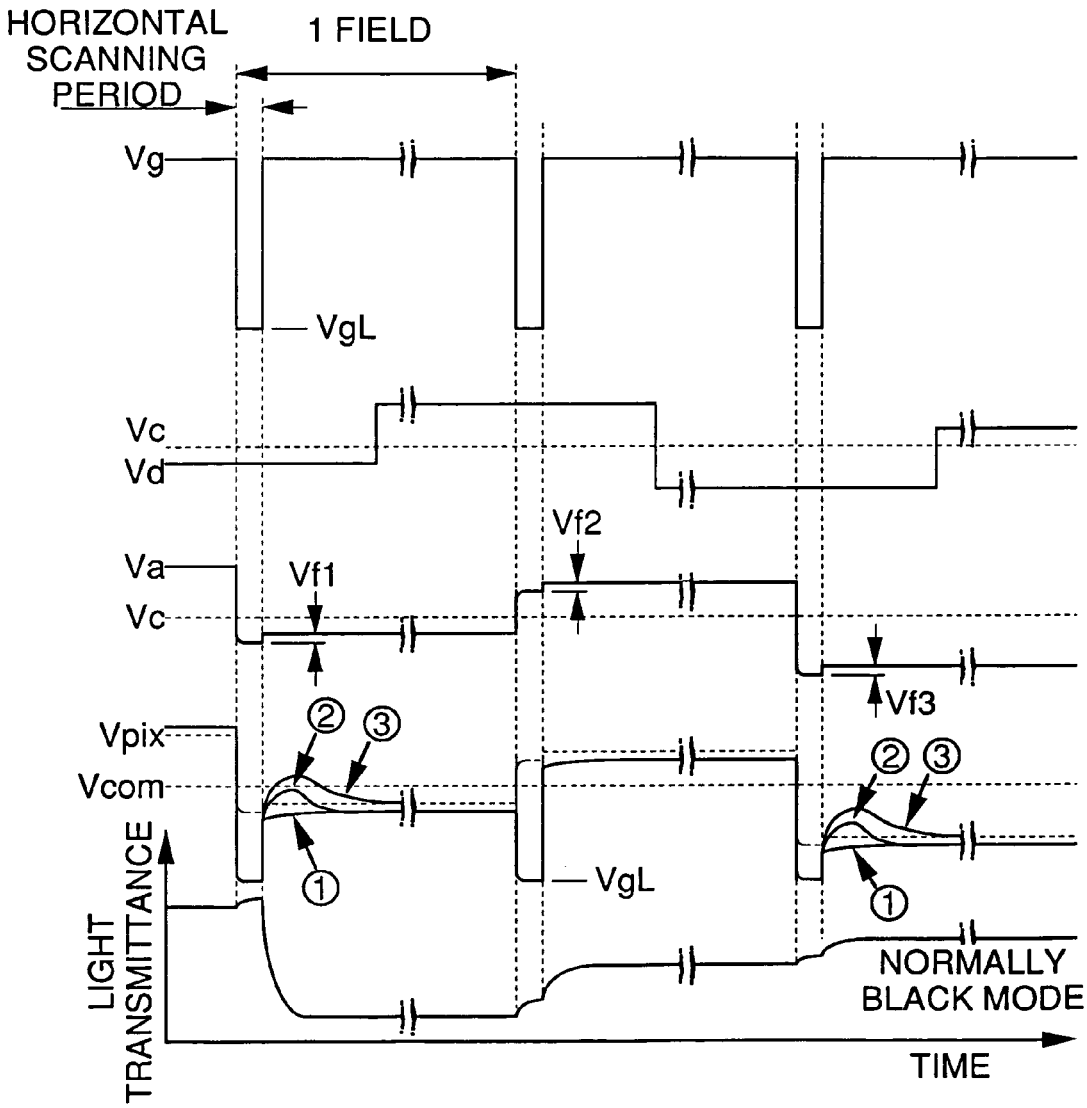
FIG. 21 is a diagram illustrating a drive method for the liquid crystal display device of the present invention.

Next is a description of the change of the pixel voltage Vpix when the value of the resistor RL 1503 is changed, in the liquid crystal display device of the present invention shown in FIG. 15. FIG. 21 shows aspects of the change of the pixel voltage Vpix for the case where the value of the resistor RL 1503 in FIG. 15 is changed with respect to the liquid crystal resistance Rsp in FIG. 62, to (1) Rsp/4, (2) Rsp and (3) 2×Rsp. As shown in the figure, in the case where the value of the resistor RL 1503 is greater than that of the liquid crystal resistance Rsp ((3)), the pixel voltage Vpix shows a large fluctuation in the field in which a negative polarity signal is written. On the other hand, in the case where the value of the resistor RL 1503 is less than or equal to that of the liquid crystal resistance Rsp ((1),(2)), the fluctuation in the pixel voltage Vpix is practically gone. In the case where the value of the resistor RL 1503 is the same as that of the liquid crystal resistance Rsp ((2)), only a slight fluctuation is observed, and since the period of this fluctuation is extremely short compared to the period of one field, it has no influence on performing gradation display control.

Due to the above described reasons, in the liquid crystal display device shown in FIG. 15, the resistor RL 1503 is designed so that the conditions shown in equation (1) are satisfied. In practice, the value of the resistor RL 1503 is determined taking into consideration the fluctuation amount of the pixel voltage Vpix, and the power consumption. In order to reduce power consumption, it is desirable to design the value of the resistor RL 1503 so as to be as large as possible within the range where the fluctuations of the pixel voltage Vpix do not exert an influence on the liquid crystal light transmittance.

When the above described liquid crystal display device and drive method of the sixth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 22:
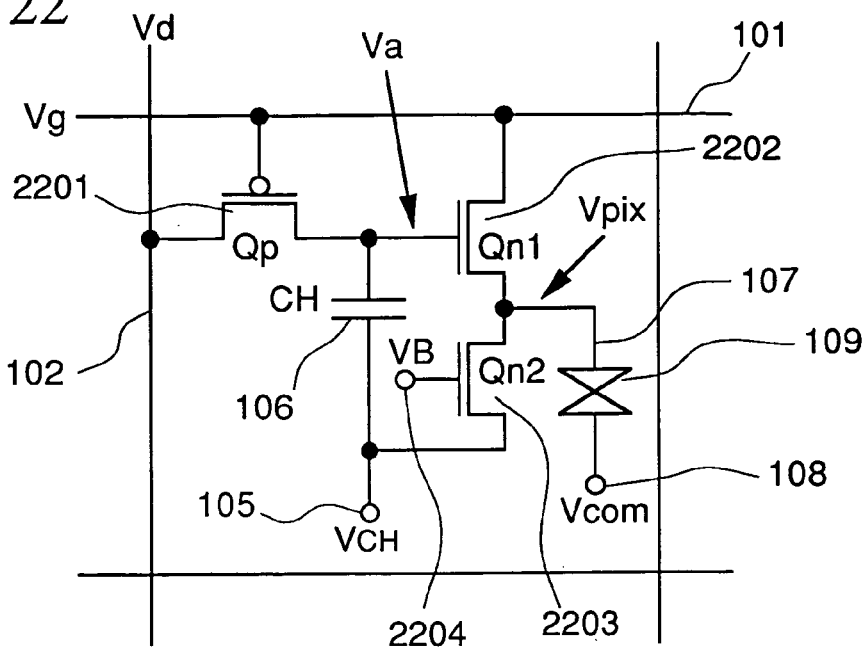
FIG. 22 is a diagram showing a seventh embodiment of a liquid crystal display device of the present invention.

A seventh embodiment of the present invention will now be described in detail with reference to the figures. FIG. 22 is a diagram showing a seventh embodiment of a liquid crystal display device of the present invention. As shown in the figure, the liquid crystal display device of the present invention comprises: a p-type MOS transistor (Qp) 2201 with a gate electrode connected to a scanning line 101, and one of a source electrode and a drain electrode connected to a signal line 102; a first n-type MOS transistor (Qn1) 2202 with a gate electrode connected to the other of the source electrode and the drain electrode of the p-type MOS transistor (Qp) 2201, and one of a source electrode and a drain electrode connected to the scanning line 101, and the other of the source electrode and the drain electrode connected to a pixel electrode 107; a voltage holding capacitor 106 formed between the gate electrode of the first n-type MOS transistor (Qn1) 2202 and a voltage holding capacitor electrode 105; a second n-type MOS transistor (Qn2) 2203 with a gate electrode connected to a bias power supply VB, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 2201 and the first and second n-type MOS transistors (Qn1) 2202 and (Qn2) 2203 are constituted by p-SiTFTs. The bias power supply VB 2204 for supply to the gate electrode of the second n-type MOS transistor (Qn2) 2203, is set so that a source-drain resistance Rdsn of the second n-type MOS transistor (Qn2) 2203 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn have the relation shown by the following equation:

$$Rdsn \approx Rr,\ Rdsn \approx Rsp \tag{5}$$

Figure 23:
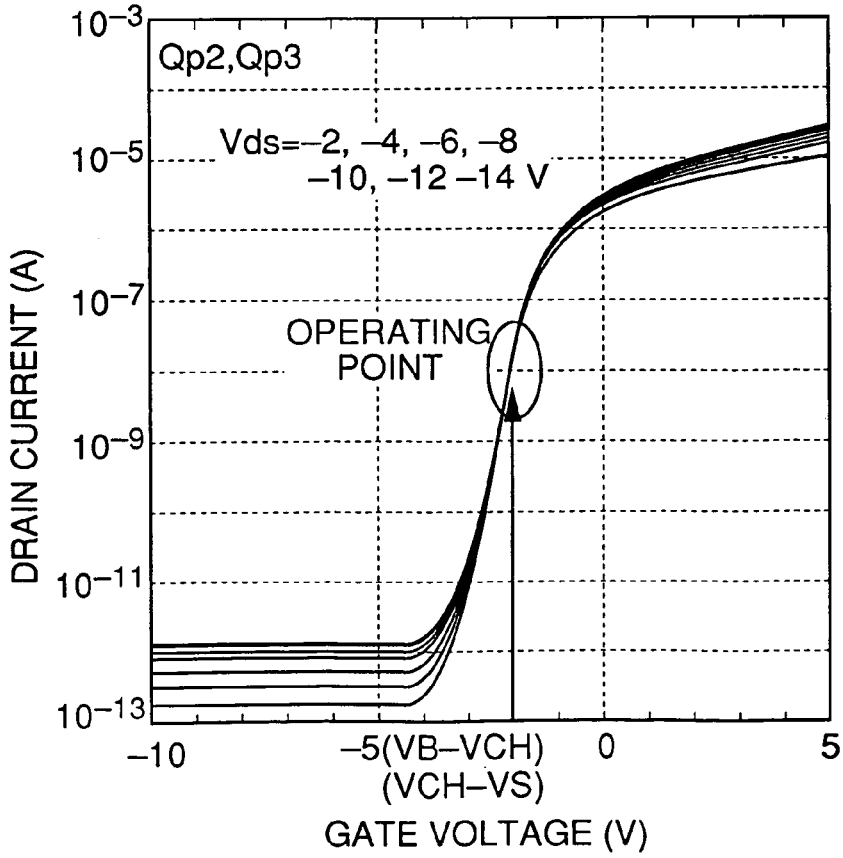
FIG. 23 is a diagram showing an operating point of a MOS type transistor constituting the liquid crystal display device of the present invention.

For example, in the case when the resistance Rsp is 5 GΩ, then a bias power supply VB 2204 such that the source-drain resistance Rdsn does not exceed 1 GΩ is supplied. FIG. 23 shows the drain current-gate current characteristics of the second n-type MOS transistor (Qn2) 2203, and the operating point. With the example in the figure, the gate-source voltage (VB−VCH) of the second n-type MOS transistor (Qn2) 2203 is set to around 3V. For example, the voltage holding capacitor voltage VCH is set to 0V, and VB is set to 3V. As a result, when the drain current of the second n-type MOS transistor (Qn2) 2203 becomes around 1E-8 (A) and the source-drain voltage Vdsn is 10V, then the source-drain resistance Rdsn becomes 1 GΩ. Furthermore, even if the second n-type MOS transistor (Qn2) 2203 is operated in the weakly inverted region with the source-drain voltage Vdsn changing from 2 to 14V, the drain current is approximately constant. The second n-type MOS transistor (Qn2) 2203 is operated as the bias current power supply for the case where the first n-type MOS transistor (Qn1) 2202 is operated as an analog amplifier.

The above described drive method for the liquid crystal display device of the seventh embodiment shown in FIG. 22 is the same as the drive method for the liquid crystal display device of the sixth embodiment shown beforehand in FIG. 15. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 19, while in the case where a TN liquid crystal is driven, these are the same as those shown in FIG. 20.

That is to say, if the liquid crystal display device shown in FIG. 22 is used, then as with the sixth embodiment, the fluctuations of the pixel voltage Vpix accompanying the response of the liquid crystal can be eliminated, enabling a desired gradation to be obtained for each one field.

Moreover, with the liquid crystal display device shown in FIG. 22, the construction is such that the scanning voltage is used as the power supply for the first n-type MOS transistor (Qn1) 2202 which operates as an analog amplifier, and as the reset power supply, and resetting of the amplifier is performed by the first n-type MOS transistor (Qn1) 2202 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 2201 and the first and second n-type MOS transistors (Qn1) 2202 and (Qn2) 2203 were formed from p-SiTFTs. However these may be formed from other thin film transistors such as a-SiTFTs or CdSeTFTs. Moreover these may be formed from single crystal silicon transistors.

When the above described liquid crystal display device and drive method of the seventh embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 24:
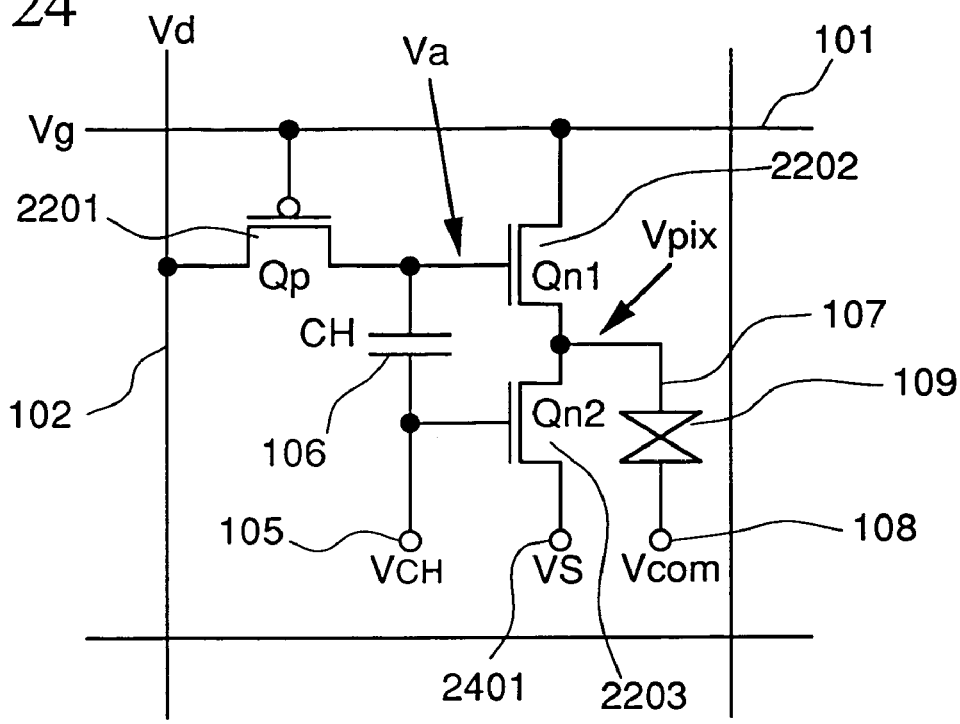
FIG. 24 is a diagram showing an eighth embodiment of a liquid crystal display device of the present invention.

An eighth embodiment of the present invention will now be described in detail with reference to the figures. FIG. 24 is a diagram showing an eighth embodiment of a liquid crystal display device of the present invention. As shown in the figure, the liquid crystal display device of the present invention comprises: a p-type MOS transistor (Qp) 2201 with a gate electrode connected to a scanning line 101, and one of a source electrode and a drain electrode connected to a signal line 102; a first n-type MOS transistor (Qn1) 2202 with a gate electrode connected to the other of the source electrode and the drain electrode of the p-type MOS transistor (Qp) 2201, and one of a source electrode and a drain electrode connected to the scanning line 101, and the other of the source electrode and the drain electrode connected to a pixel electrode 107; a voltage holding capacitor 106 formed between the gate electrode of the first n-type MOS transistor (Qn1) 2202 and a voltage holding capacitor electrode 105; a second n-type MOS transistor (Qn2) 2203 with a gate electrode connected to the voltage holding capacitor electrode 105, a source electrode connected to a source power supply VS 2401, and a drain electrode connected to the pixel electrode 107; and a liquid crystal 109 which is to be switched, disposed between the pixel electrode 107 and an opposing electrode 108. Here the p-type MOS transistor (Qp) 2201 and the first and second n-type MOS transistors (Qn1) 2202 and (Qn2) 2203 are constituted by p-SiTFTs.

The source power supply VS 2401 for supply to the source electrode of the second n-type MOS transistor (Qn2) 2203, is set so that the source-drain resistance Rdsn of the second n-type MOS transistor (Qn2) 2203 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previous equation (5). For example, in the case when the resistance Rsp is 5 GΩ, then a source power supply VS 2401 such that the source-drain resistance Rdsn does not exceed 1 GΩ is supplied. The operating point for the second n-type MOS transistor (Qn2) 2203 is the same as the operating point shown in FIG. 23. That is, with the example in the figure, the gate-source voltage (VCH−VS) of the second n-type MOS transistor (Qn2) 2203 is set to around 3V. For example, the voltage holding capacitor voltage VCH is set to 3V, and VS is set to 0V. As a result, when the drain current of the second n-type MOS transistor (Qn2) 2203 becomes around 1E-8 (A) and the source-drain voltage Vdsn is 10V, then the source-drain resistance Rdsn becomes 1 GΩ. Furthermore, even if the second n-type MOS transistor (Qn2) 2203 is operated in the weakly inverted region with the source-drain voltage Vdsn changing from 2 to 14V, the drain current is approximately constant. The second n-type MOS transistor (Qn2) 2203 is operated as the bias current power supply for the case where the first n-type MOS transistor (Qn1) 2202 is operated as an analog amplifier.

The above described drive method for the liquid crystal display device of the eighth embodiment shown in FIG. 24 is the same as the drive method for the liquid crystal display device of the sixth and seventh embodiments shown beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 19, while in the case where a TN liquid crystal is driven, these are the same as those shown in FIG. 20.

That is to say, if the liquid crystal display device shown in FIG. 24 is used, then as with the sixth and seventh embodiments, the fluctuations of the pixel voltage Vpix accompanying the response of the liquid crystal can be eliminated, enabling a desired gradation to be obtained for each one field.

Moreover, with the liquid crystal display device shown in FIG. 24, the construction is such that the scanning voltage is used as the power supply for the first n-type MOS transistor (Qn1) 2202 which operates as an analog amplifier, and as the reset power supply, and resetting of the amplifier is performed by the first n-type MOS transistor (Qn1) 2202 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 2201 and the first and second n-type MOS transistors (Qn1) 2202 and (Qn2) 2203 were formed from p-SiTFTs. However these may be formed from other thin film transistors such as a-SiTFTs or CdSeTFTs. Moreover these may be formed from single crystal silicon transistors.

When the above described liquid crystal display device and drive method of the eighth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 25:
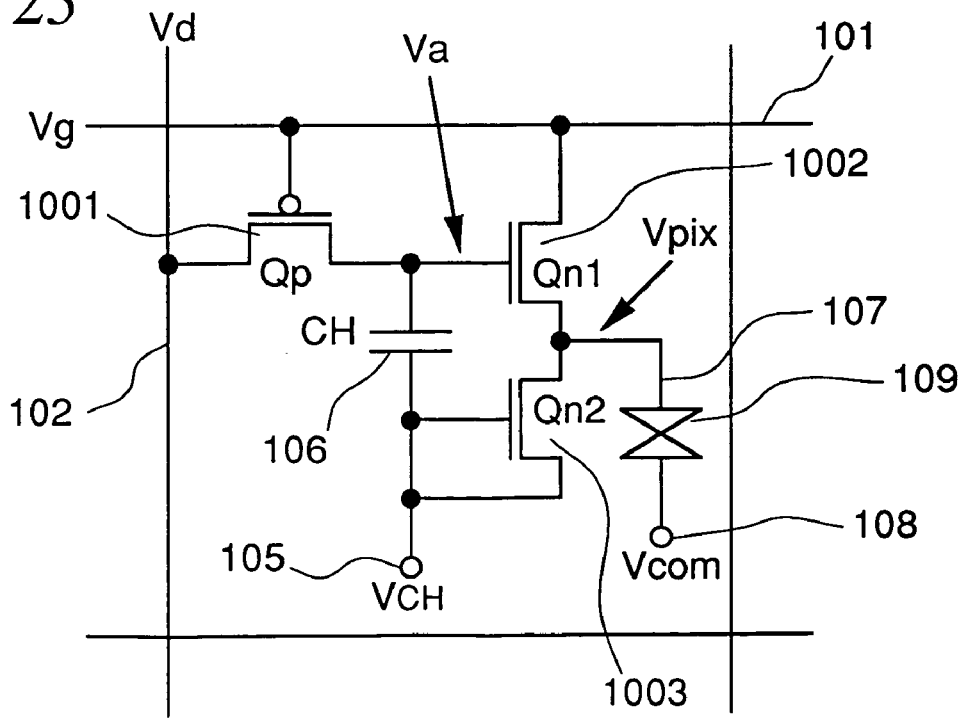
FIG. 25 is a diagram showing a ninth embodiment of a liquid crystal display device of the present invention.

A ninth embodiment of the present invention will now be described in detail with reference to the figures. FIG. 25 is a diagram showing a ninth embodiment of a liquid crystal display device of the present invention. As shown in the figure, the liquid crystal display device of the present invention comprises: a p-type MOS transistor (Qp) 2201 with a gate electrode connected to a scanning line 101, and one of a source electrode and a drain electrode connected to a signal line 102; a first n-type MOS transistor (Qn1) 2202 with a gate electrode connected to the other of the source electrode and the drain electrode of the p-type MOS transistor (Qp) 2201, and one of a source electrode and a drain electrode connected to the scanning line 101, and the other of the source electrode and the drain electrode connected to a pixel electrode 107; a voltage holding capacitor 106 formed between the gate electrode of the first n-type MOS transistor (Qn1) 2202 and a voltage holding capacitor electrode 105; a second n-type MOS transistor (Qn2) 2203 with a gate electrode and a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 2201 and the first and second n-type MOS transistors (Qn1) 2202 and (Qn2) 2203 are constituted by p-SiTFTs.

Figure 26:
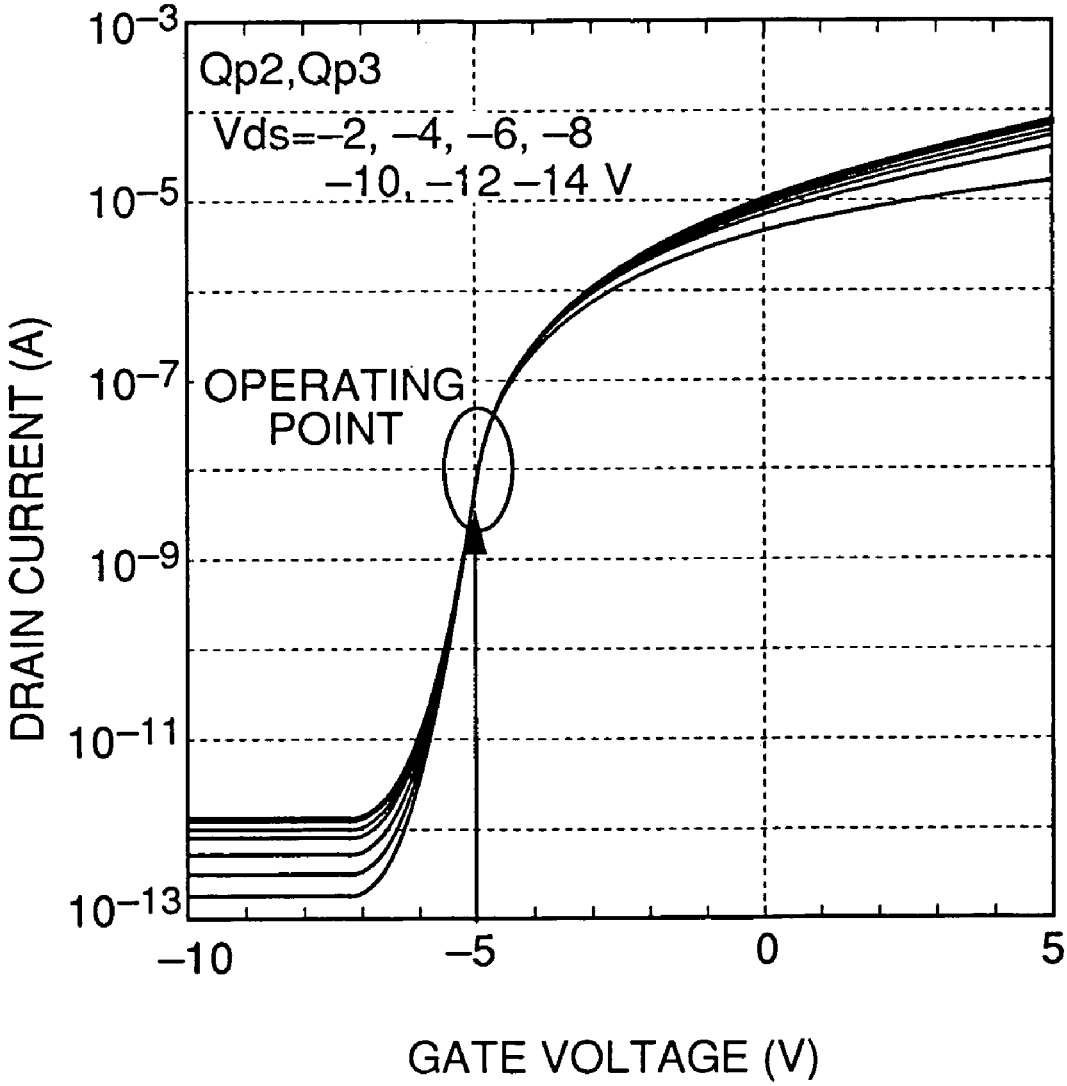
FIG. 26 is a diagram showing an operating point of a MOS type transistor constituting the liquid crystal display device of the resent invention.

Furthermore, since the gate electrode and the source electrode of the second n-type MOS transistor (Qn2) 2203 are both connected to the voltage holding capacitor electrode 105, then the gate-source voltage Vgsn of the second n-type MOS transistor (Qn2) 2203 becomes 0V. Under this bias condition, so that the source-drain resistance Rdsn of the second n-type MOS transistor (Qn2) 2203 satisfies the beforementioned equation (5), the threshold value voltage of the second n-type MOS transistor (Qn2) 2203 is shift controlled to the negative side by channel-dose. FIG. 26 shows the drain current-gate voltage characteristics of the second n-type MOS transistor (Qn2) 2203, and the operating point. As shown in the figure, the threshold value voltage is shift controlled to the negative side by channel-dose so that when the gate-source voltage is 0V, the drain current becomes approximately 1E-8 (A). As a result, when the drain current of the second n-type MOS transistor (Qn2) 2203 becomes around 1E-8 (A) and the source-drain voltage Vdsn is 10V, then the source-drain resistance Rdsn becomes 1 GΩ. Furthermore, even if the second n-type MOS transistor (Qn2) 2203 is operated in the weakly inverted region with the source-drain voltage Vdsn changing from 2 to 14V, the drain current is approximately constant. The second n-type MOS transistor (Qn2) 2203 is operated as the bias current power supply for the case where the first n-type MOS transistor (Qn1) 2202 is operated as an analog amplifier.

With the ninth embodiment, the bias power supply VB 2204, and the source power supply VS 2501 necessary in the seventh and eighth embodiments are not necessary. However a channel-dose forming step is additionally required.

The above described drive method for the liquid crystal display device of the ninth embodiment shown in FIG. 25 is the same as the drive method for the liquid crystal display device of the sixth through eighth embodiments shown beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 19, while in the case where a TN liquid crystal is driven, these are the same as those shown in FIG. 20.

That is to say, if the liquid crystal display device shown in FIG. 25 is used, then as with the sixth through eighth embodiments, the fluctuations of the pixel voltage Vpix accompanying the response of the liquid crystal can be eliminated, enabling a desired gradation to be obtained for each one field.

Moreover, with the liquid crystal display device shown in FIG. 25, the construction is such that the scanning voltage is used as the power supply for the first n-type MOS transistor (Qn1) 2202 which operates as an analog amplifier, and as the reset power supply, and resetting of the amplifier is performed by the first n-type MOS transistor (Qn1) 2202 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 2201 and the first and second n-type MOS transistors (Qn1) 2202 and (Qn2) 2203 were formed from p-SiTFTs. However these may be formed from other thin film transistors such as a-SiTFTs or CdSeTFTs. Moreover these may be formed from single crystal silicon transistors.

When the above described liquid crystal display device and drive method of the ninth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 27:
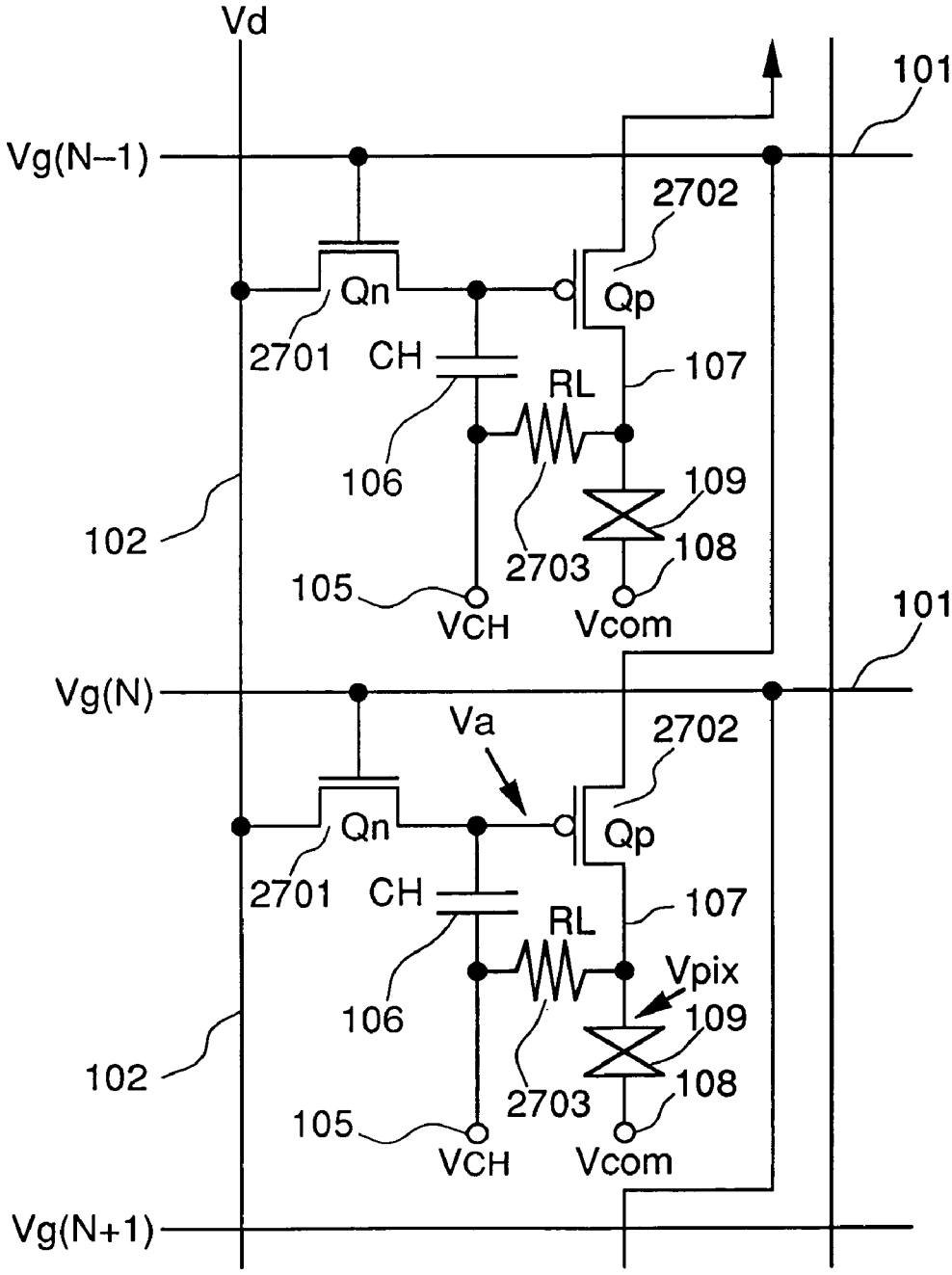
FIG. 27 is a diagram showing a tenth embodiment of a liquid crystal display device of the present invention.

A tenth embodiment of the present invention will now be described in detail with reference to the figures. FIG. 27 is a diagram showing a tenth embodiment of a liquid crystal display device of the present invention. As shown in the figure, the liquid crystal display device of the present invention comprises: an n-type MOS transistor (Qn) 2701 with a gate electrode connected to an Nth (where N is an integer of two or more) scanning line 2705, and one of a source electrode and a drain electrode connected to a signal line 102; a p-type MOS transistor (Qp) 2702 with a gate electrode connected to the other of the source electrode and the drain electrode of the n-type MOS transistor (Qn) 2701, and one of a source electrode and a drain electrode connected to an (N−1)th scanning line 2704, and the other of the source electrode and the drain electrode connected to a pixel electrode 107; a voltage holding capacitor 106 formed between the gate electrode of the p-type MOS transistor (Qp) 2702 and a voltage holding capacitor electrode 105; a resistor RL 2703 connected between the pixel electrode 107 and the voltage holding capacitor electrode 105; and a liquid crystal 109 which is to be switched, disposed between the pixel electrode 107 and an opposing electrode 108. Here the n-type MOS transistor (Qn) 2701 and the p-type MOS transistor (Qp) 2702 are constituted by p-SiTFTs.

The value of the resistor RL 2703, as with the second embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 2703, have the relation shown by the previously mentioned equation (1).

For example, in the case when the resistance Rsp is 5 GΩ, then the value of the resistor RL 2703 is set to a value of around 1 GΩ. A value of 1 GΩ which is a large resistance not used in normal semiconductor integrated circuits, is formed from a semiconductor thin film or a semiconductor thin film which has been doped with impurities, as explained in the second embodiment.

That is to say, the construction and manufacturing method for the case where the resistor RL 2703 is formed from a lightly doped p-type semiconductor thin film (p−) are the same as shown in FIG. 4. Moreover, the construction and manufacturing method for the case where the resistor RL 2703 is formed from a semiconductor thin film (i layer) which has not been doped with impurities are the same as shown in FIG. 5. Furthermore, the construction and manufacturing method for the case where the resistor RL 2703 is formed from an n-type semiconductor thin film (n−) are the same as shown in FIG. 6. In the above, the description has been for the case where the resistor RL 2703 shown in FIG. 27 is formed from a semiconductor thin film or a semiconductor thin film doped with impurities. However provided the resistance satisfies equation (1), then other materials may be employed.

Figure 28:
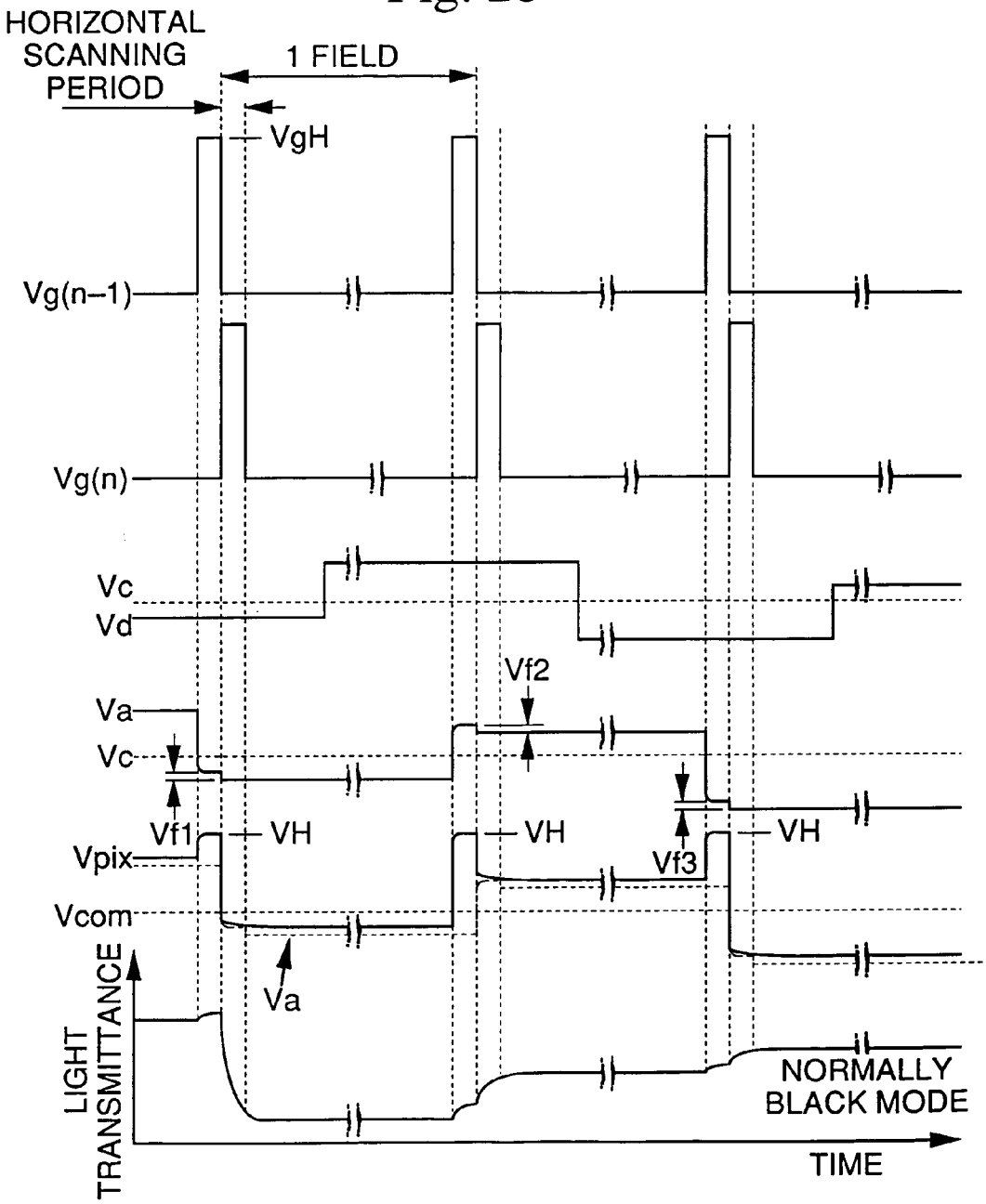
FIG. 28 is a diagram illustrating a drive method for the liquid crystal display device of the present invention.

As follows is a description of the drive method for the liquid crystal display device using the pixel construction shown in FIG. 27. FIG. 28 shows the timing chart, and the change in light transmittance of the liquid crystal, for a gate scanning voltage Vg, a data signal voltage Vd, a gate voltage Va of the p-type MOS transistor (Qp) 2702, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 27. Here the example is given for when the liquid crystal operates in a normally black mode, becoming dark when a voltage is not applied.

As shown in the figure, in the period where the (N−1)th gate scanning voltage Vg (N−1) becomes a high level VgH, the pixel electrode 107 attains the reset state due to the gate scanning voltage VgH being transferred through the p-type MOS transistor (Qp) 2702. Here as described below, the p-type MOS transistor (Qp) 2702 operates as a source follower type analog amplifier, after the selection period of the (N−1)th scanning line is completed. However due to the pixel voltage Vpix becoming VgH in the selection period of the (N−1)th scanning line, the resetting of the p-type MOS transistor (Qp) 2702 is performed.

Then in the period where the Nth gate scanning voltage Vg (N) becomes a high level VgH, the n-type MOS transistor (Qn) 2701 comes on, and the data signal Vd input to the signal line is transferred to the gate electrode of the p-type MOS transistor (Qp) 2702 through the n-type MOS transistor (Qn) 2701. When the horizontal scanning period is completed and the gate scanning voltage Vg becomes a low level, the n-type MOS transistor (Qn) 2701 goes off, and the data signal transferred to the gate electrode of the p-type MOS transistor (Qp) 2702 is held by the voltage holding capacitor 105. At this time, with the gate input voltage Va of the p-type MOS transistor (Qp) 2702, at the time when the n-type MOS transistor (Qn) 2701 goes off, a voltage shift referred to as a feed-through voltage occurs through the capacitance between the gate and the source of the n-type MOS transistor (Qn) 2701. In FIG. 28 this is shown by Vf1, Vf2 and Vf3. The amount of this voltage shift Vf1, Vf2 and Vf3 can be made smaller by designing the value for the voltage holding capacitor 105 to be large. The gate input voltage Va of the p-type MOS transistor (Qp) 2702 is held until the Nth gate scanning voltage Vg again becomes a high level in the subsequent field period and the n-type MOS transistor (Qn) 2701 is selected.

On the other hand, the p-type MOS transistor (Qp) 2702, on completion of resetting in the (N−1)th horizontal scanning period, operates from the (N)th horizontal scanning period and thereafter as a source follower type analog amplifier with the pixel electrode 107 as the source electrode. At this time, in order to operate the p-type MOS transistor (Qp) 2702 as an analog amplifier, a voltage at least higher than (Vdmax−Vtp) is supplied to the voltage holding capacitor electrode 105. Here Vdmax is the maximum value of the data signal voltage Vd, while Vtp is the threshold value voltage of the p-type MOS transistor (Qp) 2702. The p-type MOS transistor (Qp) 2702, during the period in the subsequent field up until the (N−1)th gate scanning voltage becomes VgH to thus execute reset, can output an analog gradation voltage corresponding to the held gate input voltage Va. This output voltage changes depending on the transconductance gmp of the p-type MOS transistor (Qp) 2702 and the value of the resistor RL 2703, however it is generally represented by the previously mentioned equation (2).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 28, it becomes possible to obtain a desired gradation for each one field.

Furthermore, with the liquid crystal display device of the present invention, the construction is such that the (N−1)th scanning line voltage is used as the power supply for the p-type MOS transistor (Qp) 2702 which operates as an analog amplifier, and as the reset power supply, and resetting of the amplifier is performed by the p-type MOS transistor (Qp) 2702 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Moreover, with the abovementioned embodiment, it was noted that the n-type MOS transistor (Qn) 2701 and the p-type MOS transistor (Qp) 2702 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 28 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 27, the p-type MOS transistor (Qp) 2702 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the tenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 29:
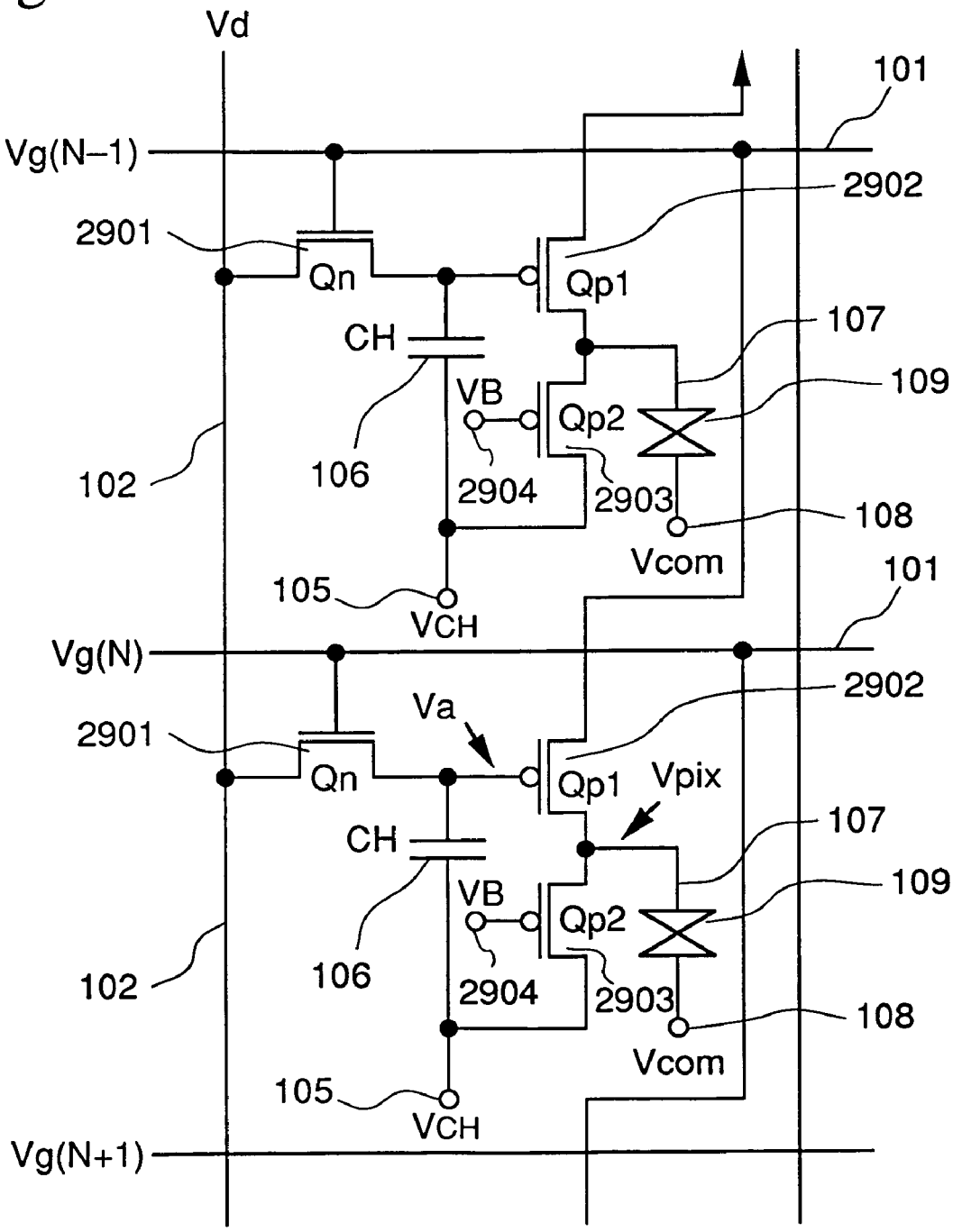
FIG. 29 is a diagram showing an eleventh embodiment of a liquid crystal display device of the present invention.

An eleventh embodiment of the present invention will now be described in detail with reference to the figures. FIG. 29 is a diagram showing an eleventh embodiment of a liquid crystal display device of the present invention. As shown in the figure, the liquid crystal display device of the present invention comprises: an n-type MOS transistor (Qn) 2901 with a gate electrode connected to an Nth scanning line 2705, and one of a source electrode and a drain electrode connected to a signal line 102; a first p-type MOS transistor (Qp1) 2902 with a gate electrode connected to the other of the source electrode and the drain electrode of the n-type MOS transistor (Qn) 2901, and one of a source electrode and a drain electrode connected to an (N−1)th scanning line 2704, and the other of the source electrode and the drain electrode connected to a pixel electrode 107; a voltage holding capacitor 106 formed between the gate electrode of the first p-type MOS transistor (Qp1) 2902 and a voltage holding capacitor electrode 105; a second p-type MOS transistor (Qp2) 2903 with a gate electrode connected to a bias power supply VB 2904, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the n-type MOS transistor (Qn) 2901 and the first and second p-type MOS transistors (Qp1) 2902 and (Qp2) 2903 are constituted by p-SiTFTs. Moreover, the bias power supply VB 2904 for supply to the gate electrode of the second p-type MOS transistor (Qp2) 2903, is set so that a source-drain resistance Rdsp of the second p-type MOS transistor (Qp2) 2903 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previously mentioned equation (3).

For example, in the case when the resistance Rsp is 5 GΩ, then a bias power supply VB 2904 such that the source-drain resistance Rdsp does not exceed 1 GΩ is supplied. At this time, the drain current-gate current characteristics of the second p-type MOS transistor (Qp2) 2903, and the operating point are the same as shown in FIG. 11. That is, with the example in FIG. 11, the gate-source voltage (VB−VCH) of the second p-type MOS transistor (Qp2) 2903 is set to around −3V. As a result, when the drain current of the second p-type MOS transistor (Qp2) 2903 becomes around 1E-8 (A) and the source-drain voltage Vdsp is −10V, then the source-drain resistance Rdsp becomes 1 GΩ. Furthermore, even if the second p-type MOS transistor (Qp2) 2903 is operated in the weakly inverted region with the source-drain voltage Vdsp changing from −2 to −14V, the drain current is approximately constant. The second p-type MOS transistor (Qp2) 2903 is operated as the bias current power supply for the case where the first p-type MOS transistor (Qp1) 2902 is operated as an analog amplifier.

The above described drive method for the liquid crystal display device of the eleventh embodiment shown in FIG. 29 is the same as the drive method for the liquid crystal display device of the tenth embodiment explained beforehand with reference to FIG. 28. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 28. Moreover, also in the case where a TN liquid crystal is driven using the liquid crystal display device shown in FIG. 29, this can be driven with the same drive method as shown in FIG. 28.

That is to say, if the liquid crystal display device shown in FIG. 29 is used, then as with the tenth embodiment, the fluctuations of the pixel voltage Vpix accompanying the response of the liquid crystal can be eliminated, enabling a desired gradation to be obtained for each one field.

Moreover, with the liquid crystal display device shown in FIG. 29, the construction is such that the (N−1)th scanning line voltage is used as the power supply for the first p-type MOS transistor (Qp1) 2902 which operates as an analog amplifier, and as the reset power supply, and resetting of the amplifier is performed by the first p-type MOS transistor (Qp1) 2902 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 2901 and the first and second p-type MOS transistors (Qp1) 2902 and (Qp2) 2903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the eleventh embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 30:
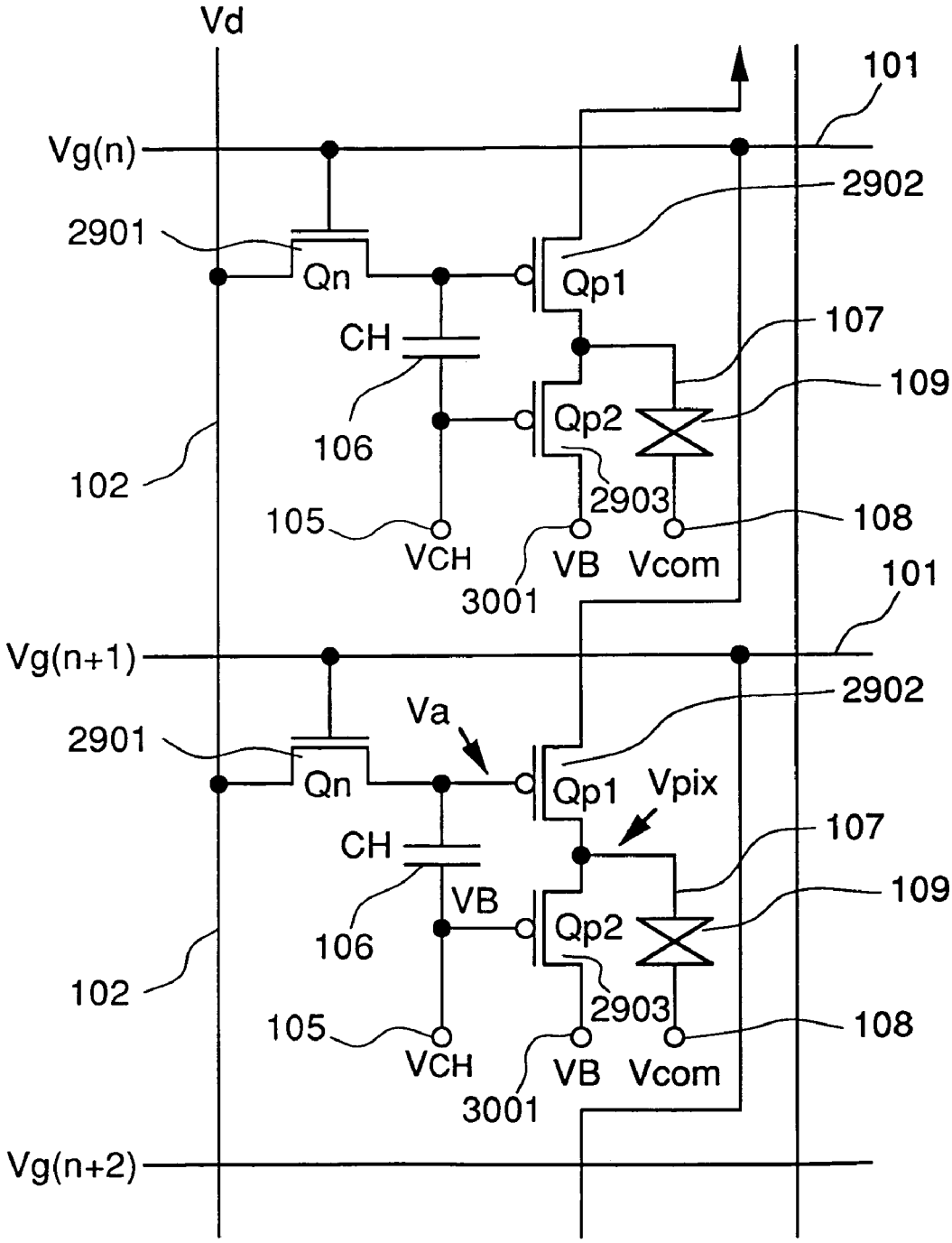
FIG. 30 is a diagram showing a twelfth embodiment of a liquid crystal display device of the present invention.

A twelfth embodiment of the present invention will now be described in detail with reference to the figures. FIG. 30 is a diagram showing a twelfth embodiment of a liquid crystal display device of the present invention. As shown in the figure, the liquid crystal display device of the present invention comprises: an n-type MOS transistor (Qn) 2901 with a gate electrode connected to an Nth scanning line 2705, and one of a source electrode and a drain electrode connected to a signal line 102; a first p-type MOS transistor (Qp1) 2902 with a gate electrode connected to the other of the source electrode and the drain electrode of the n-type MOS transistor (Qn) 2901, and one of a source electrode and a drain electrode connected to an (N−1)th scanning line 2704, and the other of the source electrode and the drain electrode connected to a pixel electrode 107; a voltage holding capacitor 106 formed between the gate electrode of the first p-type MOS transistor (Qp1) 2902 and a voltage holding capacitor electrode 105; a second p-type MOS transistor (Qp2) 2903 with a gate electrode connected to the voltage holding capacitor electrode 105, a source electrode connected to a source power supply VS 3001, and a drain electrode connected to the pixel electrode 107; and a liquid crystal 109 which is to be switched, disposed between the pixel electrode 107 and an opposing electrode 108. Here the n-type MOS transistor (Qn) 2901 and the first and second p-type MOS transistors (Qp1) 2902 and (Qp2) 2903 are constituted by p-SiTFTs.

The source power supply VS 3001 for supply to the source electrode of the second p-type MOS transistor (Qp2) 2903, is set so that the source-drain resistance Rdsp of the second p-type MOS transistor (Qp2) 2903 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previous equation (3). For example, in the case when the resistance Rsp is 5 GΩ, then a source power supply VS 3001 such that the source-drain resistance Rdsp does not exceed 1 GΩ is supplied. The operating point for the second p-type MOS transistor (Qp2) 2903 is the same as the operating point shown in FIG. 11. That is, with the example in the figure, the gate-source voltage (VCH−VS) of the second p-type MOS transistor (Qp2) 2903 is set to around −3V. As a result, when the drain current of the second p-type MOS transistor (Qp2) 2903 becomes around 1E-8 (A) and the source-drain voltage Vdsp is −10V, then the source-drain resistance Rdsp becomes 1 GΩ. Furthermore, even if the second p-type MOS transistor (Qp2) 2903 is operated in the weakly inverted region with the source-drain voltage Vdsp changing from −2 to −14V, the drain current is approximately constant. The second p-type MOS transistor (Qp2) 2903 is operated as the bias current power supply for the case where the first p-type MOS transistor (Qp1) 2902 is operated as an analog amplifier.

The above described drive method for the liquid crystal display device of the twelfth embodiment shown in FIG. 30 is the same as the drive method for the liquid crystal display device of the tenth and eleventh embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 28. Moreover, also in the case where a TN liquid crystal is driven using the liquid crystal display device shown in FIG. 30, this can be driven with the same drive method as shown in FIG. 28.

That is to say, if the liquid crystal display device shown in FIG. 30 is used, then as with the tenth and eleventh embodiments, the fluctuations of the pixel voltage Vpix accompanying the response of the liquid crystal can be eliminated, enabling a desired gradation to be obtained for each one field.

Moreover, with the liquid crystal display device shown in FIG. 30, the construction is such that the (N−1)th scanning line voltage is used as the power supply for the first p-type MOS transistor (Qp1) 2902 which operates as an analog amplifier, and as the reset power supply, and resetting of the amplifier is performed by the first p-type MOS transistor (Qp1) 2902 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 2901 and the first and second p-type MOS transistors (Qp1) 2902 and (Qp2) 2903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twelfth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 31:
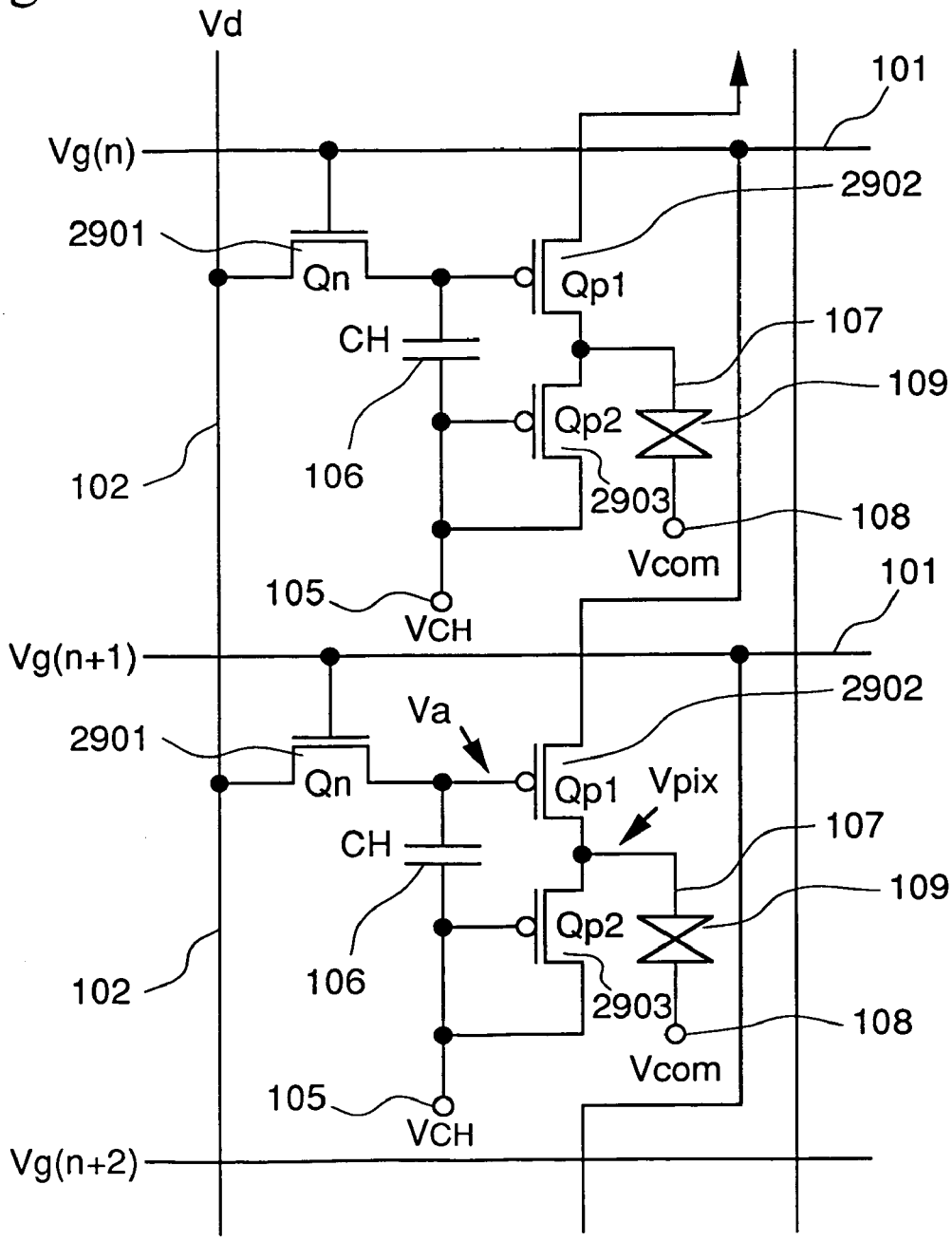
FIG. 31 is a diagram showing a thirteenth embodiment of a liquid crystal display device of the present invention.

A thirteenth embodiment of the present invention will now be described in detail with reference to the figures. FIG. 31 is a diagram showing a thirteenth embodiment of a liquid crystal display device of the present invention. As shown in the figure, the liquid crystal display device of the present invention comprises: an n-type MOS transistor (Qn) 2901 with a gate electrode connected to an Nth scanning line 2705, and one of a source electrode and a drain electrode connected to a signal line 102, a first p-type MOS transistor (Qp1) 2902 with a gate electrode connected to the other of the source electrode and the drain electrode of the n-type MOS transistor (Qn) 2901, and one of a source electrode and a drain electrode connected to an (N−1)th scanning line 2705, and the other of the source electrode and the drain electrode connected to a pixel electrode 107; a voltage holding capacitor 106 formed between the gate electrode of the first p-type MOS transistor (Qp1) 2902 and a voltage holding capacitor electrode 105; a second p-type MOS transistor (Qp2) 2903 with a gate electrode and source electrode connected to the voltage holding capacitor electrode 105, and a drain electrode connected to the pixel electrode 107; and a liquid crystal 109 which is to be switched, disposed between the pixel electrode 107 and an opposing electrode 108. Here the n-type MOS transistor (Qn) 2901 and the first and second p-type MOS transistors (Qp1) 2902 and (Qp2) 2903 are constituted by p-SiTFTs.

Furthermore, since the gate electrode and the source electrode of the second p-type MOS transistor (Qp2) 2903 are both connected to the voltage holding capacitor electrode 105, then the gate-source voltage Vgsp of the second p-type MOS transistor (Qp2) 2903 becomes 0V. Under this bias condition, so that the source-drain resistance Rdsp of the second p-type MOS transistor (Qp2) 2903 satisfies the beforementioned equation (3), the threshold value voltage of the second p-type MOS transistor (Qp2) 2903 is shift controlled to the positive side by channel-dose. At this time, the drain current-gate voltage characteristics of the second p-type MOS transistor (Qp2) 1003, and the operating point are the same as shown in FIG. 14. That is, as shown in FIG. 14, the threshold value voltage is shift controlled to the positive side by channel-dose so that when the gate-source voltage is 0V, the drain current becomes approximately 1E-8 (A). As a result, when the drain current of the second p-type MOS transistor (Qp2) 2903 becomes around 1E-8 (A) and the source-drain voltage Vdsp is −10V, then the source-drain resistance Rdsp becomes 1 GΩ. Furthermore, even if the second p-type MOS transistor (Qp2) 2903 is operated in the weakly inverted region with the source-drain voltage Vdsp changing from −2 to −14V, the drain current is approximately constant. The second p-type MOS transistor (Qp2) 2903 is operated as the bias current power supply for the case where the first p-type MOS transistor (Qp1) 2902 is operated as an analog amplifier.

With the thirteenth embodiment, the bias power supply VB 2904, and the source power supply VS 3001 necessary in the eleventh and twelfth embodiments are not necessary. However a channel-dose forming step is additionally required.

The above described drive method for the liquid crystal display device of the thirteenth embodiment shown in FIG. 31 is the same as the drive method for the liquid crystal display device of the tenth through twelfth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 28. Moreover, also in the case where a TN liquid crystal is driven using the liquid crystal display device shown in FIG. 31, this can be driven with the same drive method as shown in FIG. 28.

That is to say, if the liquid crystal display device shown in FIG. 31 is used, then as with the tenth through twelfth embodiments, the fluctuations of the pixel voltage Vpix accompanying the response of the liquid crystal can be eliminated, enabling a desired gradation to be obtained for each one field.

Moreover, with the liquid crystal display device shown in FIG. 31, the construction is such that the (N−1)th scanning line voltage is used as the power supply for the first p-type MOS transistor (Qp1) 2902 which operates as an analog amplifier, and as the reset power supply, and resetting of the amplifier is performed by the first p-type MOS transistor (Qp1) 2902 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the n-type MOS transistor (Qn) 2901 and the first and second p-type MOS transistors (Qp1) 2902 and (Qp2) 2903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the thirteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 32:
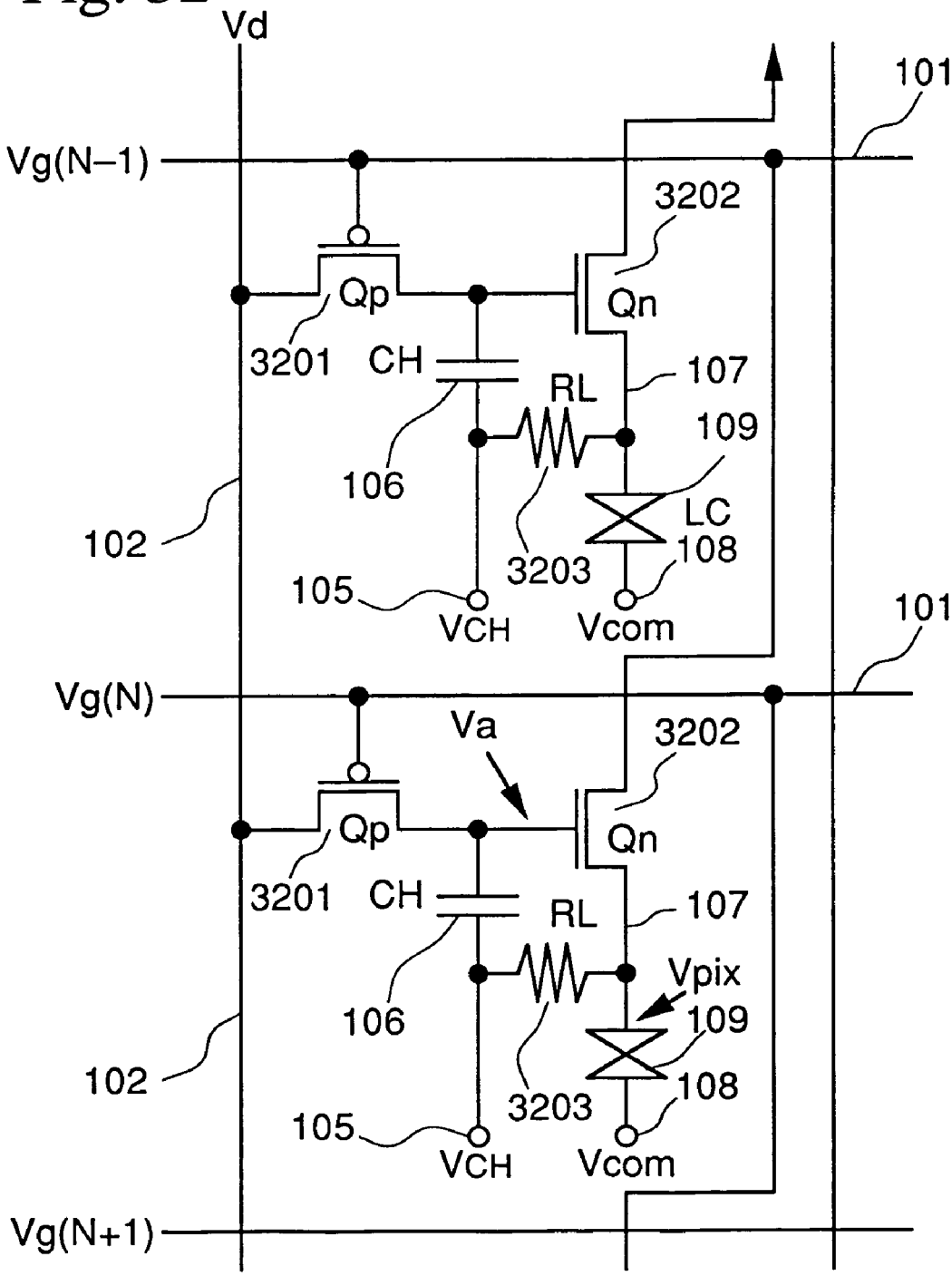
FIG. 32 is a diagram showing a fourteenth embodiment of a liquid crystal display device of the present invention.

A fourteenth embodiment of the present invention will now be described in detail with reference to the figures. FIG. 32 is a diagram showing a fourteenth embodiment of a liquid crystal display device of the present invention. As shown in the figure, the liquid crystal display device of the present invention comprises: a p-type MOS transistor (Qp) 3201 with a gate electrode connected to an Nth scanning line 2705, and one of a source electrode and a drain electrode connected to a signal line 102; an n-type MOS transistor (Qn) 3202 with a gate electrode connected to the other of the source electrode and the drain electrode of the p-type MOS transistor (Qp) 3201, and one of a source electrode and a drain electrode connected to the (N−1)th scanning line 2704, and the other of the source electrode and the drain electrode connected to a pixel electrode 107; a voltage holding capacitor 106 formed between the gate electrode of the n-type MOS transistor (Qn) 3202 and a voltage holding capacitor electrode 105; a resistor RL 3203 connected between the pixel electrode 107 and the voltage holding capacitor electrode 105; and a liquid crystal 109 which is to be switched, disposed between the pixel electrode 107 and an opposing electrode 108. Here the p-type MOS transistor (Qp) 3201 and the n-type MOS transistor (Qn) 3202 are constituted by p-SiTFTs.

Moreover, the value of the resistor RL 3203, as with the sixth embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 3203, have the relation shown by the previously mentioned equation (1).

For example, in the case when the resistance Rsp is 5 GΩ, then the value of the resistor RL 3203 is set to a value of around 1 GΩ. A value of 1 GΩ which is a large resistance not used in normal semiconductor integrated circuits, is formed from a semiconductor thin film or a semiconductor thin film which has been doped with impurities, as explained in the sixth embodiment.

That is to say, the construction and manufacturing method for the case where the resistor RL 3203 is formed from a lightly doped n-type semiconductor thin film (n−) are the same as shown in FIG. 16. Moreover, the construction and manufacturing method for the case where the resistor RL 3203 is formed from a semiconductor thin film (i layer) which has not been doped with impurities are the same as shown in FIG. 17. Furthermore, the construction and manufacturing method for the case where the resistor RL 3203 is formed from a p-type semiconductor thin film (p−) are the same as shown in FIG. 18. In the above, the description has been for the case where the resistor RL 3203 shown in FIG. 32 is formed from a semiconductor thin film or a semiconductor thin film doped with impurities. However provided the resistance satisfies equation (1), then other materials may be employed.

Figure 33:
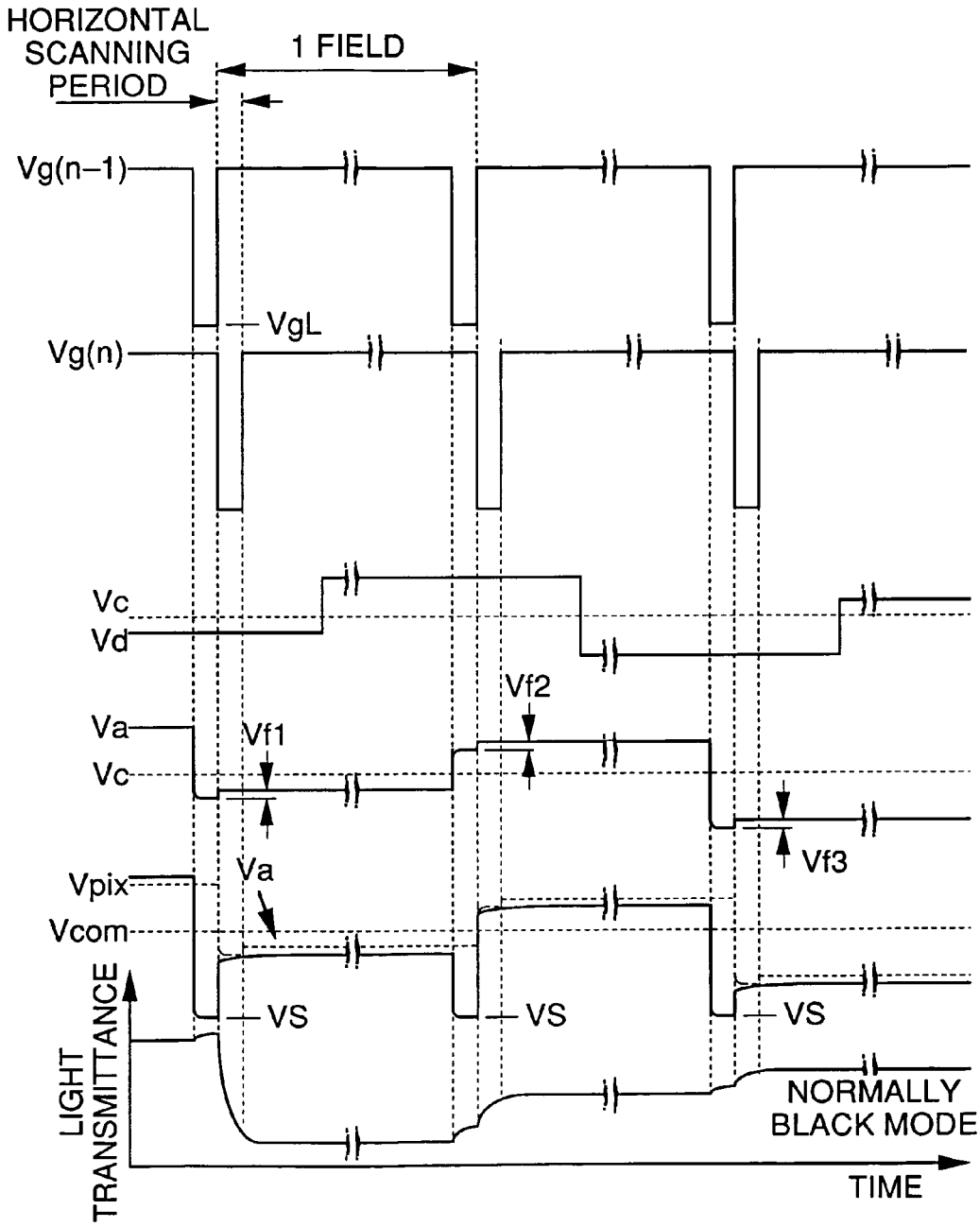
FIG. 33 is a diagram illustrating a drive method for the liquid crystal display device of the present invention.

As follows is a description of the drive method for the liquid crystal display device using the pixel construction shown in FIG. 32. FIG. 33 shows the timing chart, and the change in light transmittance of the liquid crystal, for a gate scanning voltage Vg, a data signal voltage Vd, a gate voltage Va of the n-type MOS transistor (Qn) 3202, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 32. Here the example is given for when the liquid crystal operates in a normally black mode, becoming dark when a voltage is not applied.

As shown in the figure, in the period where the (N−1)th gate scanning voltage Vg (N−1) becomes a low level VgL, the pixel electrode 107 attains the reset state due to the gate scanning voltage VgL being transferred through the n-type MOS transistor (Qn) 3202. Here as described below, the n-type MOS transistor (Qn) 3202 operates as a source follower type analog amplifier, after the selection period of the (N−1)th scanning line is completed. However due to the pixel voltage Vpix becoming VgL in the selection period of the (N−1)th scanning line, the resetting of the n-type MOS transistor (Qn) 3202 is performed.

Then in the period where the Nth gate scanning voltage Vg (N) becomes a low level VgL, the p-type MOS transistor (Qp) 3201 comes on, and the data signal Vd input to the signal line is transferred to the gate electrode of the n-type MOS transistor (Qn) 3202 through the p-type MOS transistor (Qp) 3201. When the horizontal scanning period is completed and the gate scanning voltage Vg becomes a high level, the p-type MOS transistor (Qp) 3201 goes off, and the data signal transferred to the gate electrode of the n-type MOS transistor (Qn) 3202 is held by the voltage holding capacitor 105. At this time, with the gate input voltage Va of the n-type MOS transistor (Qn) 3202, at the time when the p-type MOS transistor (Qp) 3201 goes off, a voltage shift referred to as a feed-through voltage occurs through the capacitance between the gate and the source of the p-type MOS transistor (Qp) 3201. In FIG. 33 this is shown by Vf1, Vf2 and Vf3. The amount of this voltage shift Vf1, Vf2 and Vf3 can be made smaller by designing the value for the voltage holding capacitor 105 to be large. The gate input voltage Va of the n-type MOS transistor (Qn) 3202 is held until the Nth gate scanning voltage Vg again becomes a low level in the subsequent field period and the p-type MOS transistor (Qp) 3201 is selected.

On the other hand, the n-type MOS transistor (Qn) 3202, on completion of resetting in the (N−1)th horizontal scanning period, operates from (N)th horizontal scanning period and thereafter as a source follower type analog amplifier with the pixel electrode 107 as the source electrode. At this time, in order to operate the n-type MOS transistor (Qn) 3202 as an analog amplifier, a voltage at least lower than (Vdmin−Vtn) is supplied to the voltage holding capacitor electrode 105. Here Vdmin is the minimum value of the data signal voltage Vd, while Vtn is the threshold value voltage of the n-type MOS transistor (Qn) 3202. The n-type MOS transistor (Qn) 3202, during the period in the subsequent field up until the (N−1)th gate scanning voltage becomes VgL to thus execute reset, can output an analog gradation voltage corresponding to the held gate input voltage Va. This output voltage changes depending on the transconductance gmn of the n-type MOS transistor (Qn) 3202 and the value of the resistor RL 3203, however it is generally represented by the previously mentioned equation (4).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 33, it becomes possible to obtain a desired gradation for each one field.

Furthermore, with the liquid crystal display device of the present invention, the construction is such that the (N−1)th scanning line voltage is used as the power supply for the n-type MOS transistor (Qn) 3202 which operates as an analog amplifier, and as the reset power supply, and resetting of the amplifier is performed by the n-type MOS transistor (Qn) 3202 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Moreover, with the abovementioned embodiment, it was noted that the p-type MOS transistor (Qp) 3201 and the n-type MOS transistor (Qn) 3202 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 33 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 32, the n-type MOS transistor (Qn) 3202 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the fourteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 34:
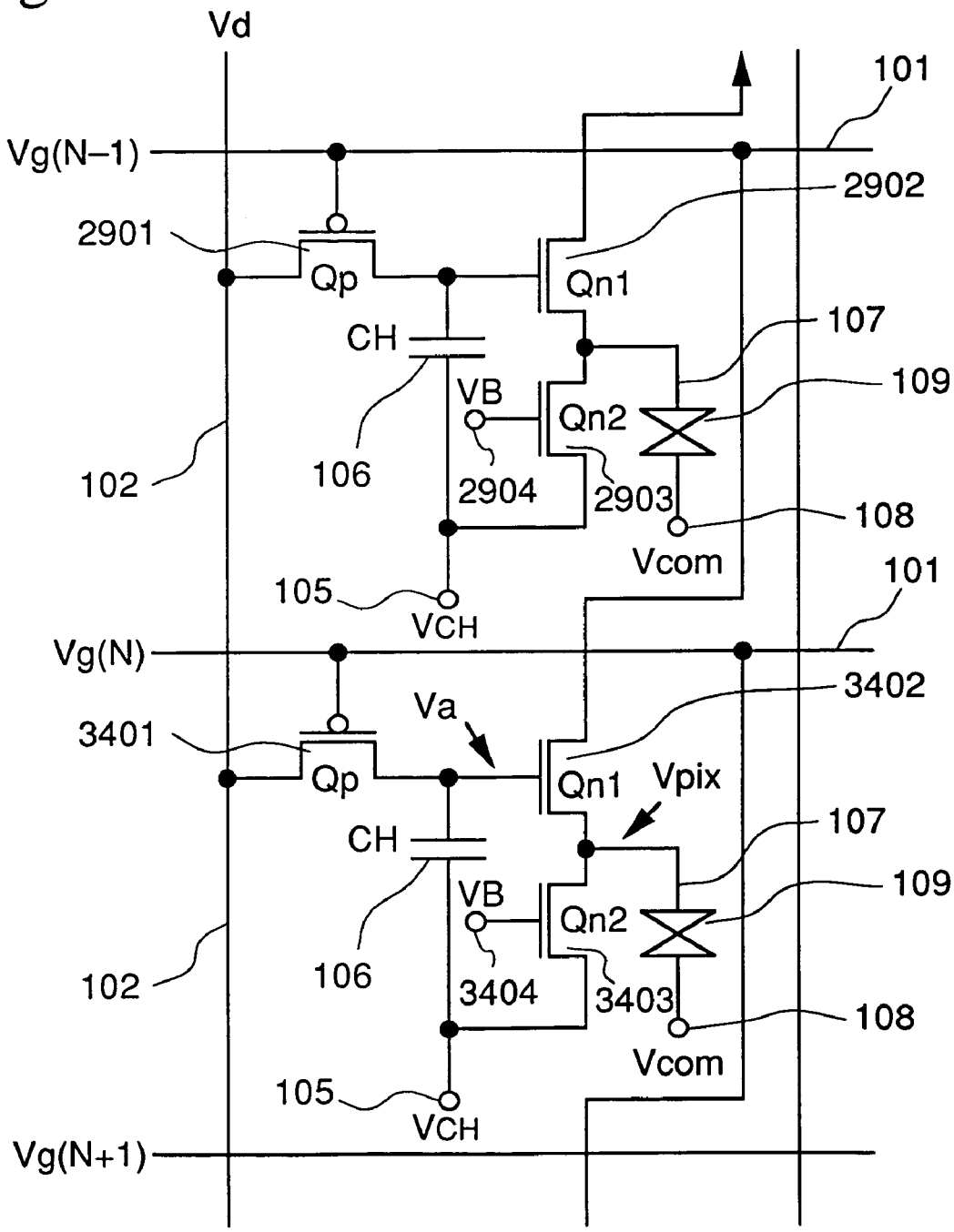
FIG. 34 is a diagram showing a fifteenth embodiment of a liquid crystal display device of the present invention.

A fifteenth embodiment of the present invention will now be described in detail with reference to the figures. FIG. 34 is a diagram showing a fifteenth embodiment of a liquid crystal display device of the present invention. As shown in the figure, the liquid crystal display device of the present invention comprises: a p-type MOS transistor (Qp) 3401 with a gate electrode connected to an Nth scanning line 2705, and one of a source electrode and a drain electrode connected to a signal line 102; a first n-type MOS transistor (Qn1) 3402 with a gate electrode connected to the other of the source electrode and the drain electrode of the p-type MOS transistor (Qp) 3401, and one of a source electrode and a drain electrode connected to an (N−1)th scanning line 2704, and the other of the source electrode and the drain electrode connected to a pixel electrode 107; a voltage holding capacitor 106 formed between the gate electrode of the first n-type MOS transistor (Qn1) 3402 and a voltage holding capacitor electrode 105; a second n-type MOS transistor (Qn2) 3403 with a gate electrode connected to a bias power supply VB 3404, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 3401 and the first and second n-type MOS transistors (Qn1) 3402 and (Qn2) 3403 are constituted by p-SiTFTs. Moreover, the bias power supply VB 3404 for supply to the gate electrode of the second n-type MOS transistor (Qn2) 3403, is set so that a source-drain resistance Rdsn of the second n-type MOS transistor (Qn2) 3403 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previously mentioned equation (5)

For example, in the case when the resistance Rsn is 5 GΩ, then a bias power supply VB 3404 such that the source-drain resistance Rdsn does not exceed 1 GΩ is supplied. At this time, the drain current-gate current characteristics of the second n-type MOS transistor (Qn2) 3403, and the operating point are the same as shown in FIG. 23. That is, with the example in FIG. 23, the gate-source voltage (VB−VCH) of the second n-type MOS transistor (Qn2) 3403 is set to around 3V. As a result, when the drain current of the second n-type MOS transistor (Qn2) 3403 becomes around 1E-8 (A) and the source-drain voltage Vdsn is 10V, then the source-drain resistance Rdsn becomes 1 GΩ. Furthermore, even if the second n-type MOS transistor (Qn2) 3403 is operated in the weakly inverted region with the source-drain voltage Vdsn changing from 2 to 14V, the drain current is approximately constant. The second n-type MOS transistor (Qn2) 3403 is operated as the bias current power supply for the case where the first n-type MOS transistor (Qn1) 3402 is operated as an analog amplifier.

The above described drive method for the liquid crystal display device of the fifteenth embodiment shown in FIG. 34 is the same as the drive method for the liquid crystal display device of the fourteenth embodiment explained beforehand with reference to FIG. 33. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 33. Moreover, also in the case where a TN liquid crystal is driven using the liquid crystal display device shown in FIG. 34, this can be driven with the same drive method as shown in FIG. 33.

That is to say, if the liquid crystal display device shown in FIG. 34 is used, then as with the fourteenth embodiment, the fluctuations of the pixel voltage Vpix accompanying the response of the liquid crystal can be eliminated, enabling a desired gradation to be obtained for each one field.

Moreover, with the liquid crystal display device shown in FIG. 34, the construction is such that the (N−1)th scanning line voltage is used as the power supply for the first n-type MOS transistor (Qn1) 3402 which operates as an analog amplifier, and as the reset power supply, and resetting of the amplifier is performed by the first n-type MOS transistor (Qn1) 3402 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 3401 and the first and second n-type MOS transistors (Qn1) 3402 and (Qn2) 3403 were formed from p-SiTFTs. However these may be formed from other thin film transistors such as a-SiTFTs or CdSeTFTs. Furthermore, these may be formed from single crystal silicon transistors.

Figure 35:
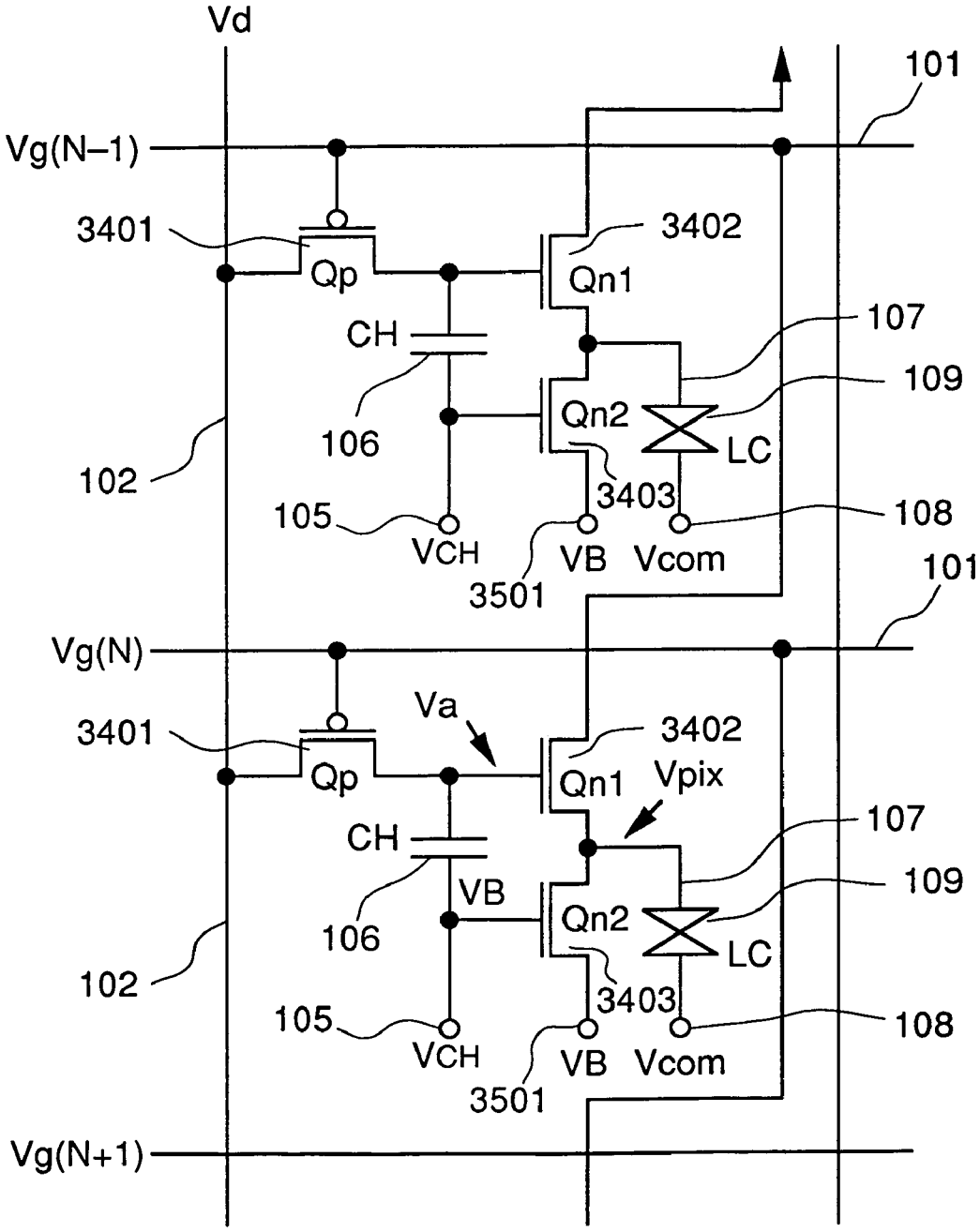
FIG. 35 is a diagram showing a sixteenth embodiment of a liquid crystal display device of the present invention.

When the above described liquid crystal display device and drive method of the fifteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used. A sixteenth embodiment of the present invention will now be described in detail with reference to the figures. FIG. 35 is a diagram showing a sixteenth embodiment of a liquid crystal display device of the present invention. As shown in the figure, the liquid crystal display device of the present invention comprises: a p-type MOS transistor (Qp) 3401 with a gate electrode connected to an Nth scanning line 2705, and one of a source electrode and a drain electrode connected to a signal line 102; a first n-type MOS transistor (Qn1) 3402 with a gate electrode connected to the other of the source electrode and the drain electrode of the p-type MOS transistor (Qp) 3401, and one of a source electrode and a drain electrode connected to an (N−1)th scanning line 2704, and the other of the source electrode and the drain electrode connected to a pixel electrode 107; a voltage holding capacitor 106 formed between the gate electrode of the first n-type MOS transistor (Qn1) 3402 and a voltage holding capacitor electrode 105; a second n-type MOS transistor (Qn2) 3403 with a gate electrode connected to the voltage holding capacitor electrode 105, a source electrode connected to a source power supply VS 3501, and a drain electrode connected to the pixel electrode 107; and a liquid crystal 109 which is to be switched, disposed between the pixel electrode 107 and an opposing electrode 108. Here the p-type MOS transistor (Qp) 3401 and the first and second n-type MOS transistors (Qn1) 3402 and (Qn2) 3403 are constituted by p-SiTFTs.

The source power supply VS 3501 for supply to the source electrode of the second n-type MOS transistor (Qn2) 3403, is set so that the source-drain resistance Rdsn of the second n-type MOS transistor (Qn2) 3403 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previous equation (5). For example, in the case when the resistance Rsn is 5 GΩ, then a source power supply VS 3501 such that the source-drain resistance Rdsn does not exceed 1 GΩ is supplied. The operating point for the second n-type MOS transistor (Qn2) 3403 is the same as the operating point shown in FIG. 23. That is, with the example in the FIG. 23, the gate-source voltage (VCH−VS) of the second n-type MOS transistor (Qn2) 3403 is set to around 3V. As a result, when the drain current of the second n-type MOS transistor (Qn2) 3403 becomes around 1E-8 (A) and the source-drain voltage Vdsn is 10V, then the source-drain resistance Rdsn becomes 1 GΩ. Furthermore, even if the second n-type MOS transistor (Qn2) 3403 is operated in the weakly inverted region with the source-drain voltage Vdsn changing from 2 to 14V, the drain current is approximately constant. The second n-type MOS transistor (Qn2) 3403 is operated as the bias current power supply for the case where the first n-type MOS transistor (Qn1) 3402 is operated as an analog amplifier.

The above described drive method for the liquid crystal display device of the sixteenth embodiment shown in FIG. 35 is the same as the drive method for the liquid crystal display device of the fourteenth and fifteenth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 33. Moreover, also in the case where a TN liquid crystal is driven using the liquid crystal display device shown in FIG. 35, this can be driven with the same drive method as shown in FIG. 33.

That is to say, if the liquid crystal display device shown in FIG. 35 is used, then as with the fourteenth and fifteenth embodiments, the fluctuations of the pixel voltage Vpix accompanying the response of the liquid crystal can be eliminated, enabling a desired gradation to be obtained for each one field.

Moreover, with the liquid crystal display device shown in FIG. 35, the construction is such that the (N−1)th scanning line voltage is used as the power supply for the first n-type MOS transistor (Qn1) 3402 which operates as an analog amplifier, and as the reset power supply, and resetting of the amplifier is performed by the first n-type MOS transistor (Qn1) 3402 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 3401 and the first and second n-type MOS transistors (Qn1) 3402 and (Qn2) 3403 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the sixteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 36:
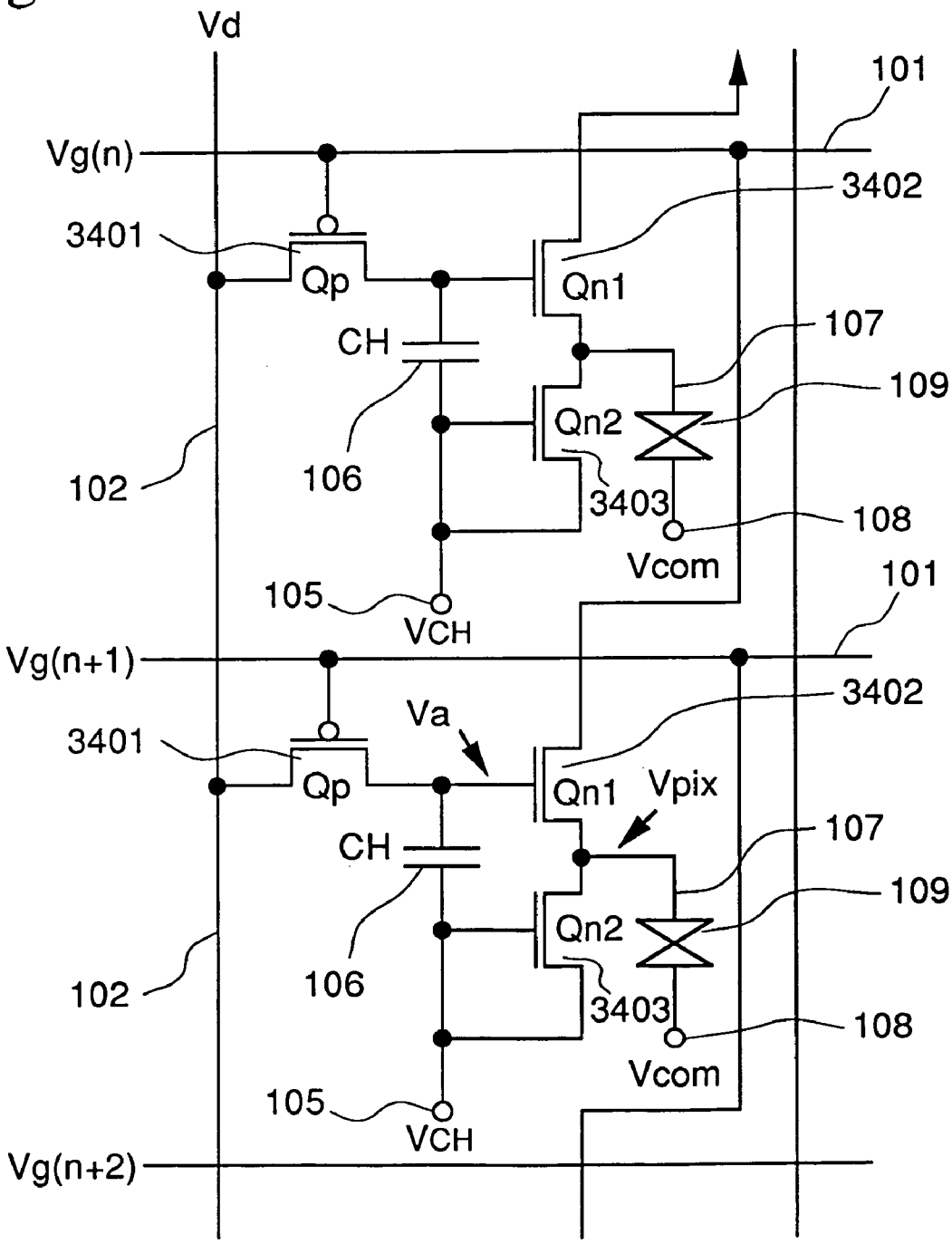
FIG. 36 is a diagram showing a seventeenth embodiment of a liquid crystal display device of the present invention.

A seventeenth embodiment of the present invention will now be described in detail with reference to the figures. FIG. 36 is a diagram showing a seventeenth embodiment of a liquid crystal display device of the present invention. As shown in the figure, the liquid crystal display device of the present invention comprises: a p-type MOS transistor (Qp) 3401 with a gate electrode connected to an Nth scanning line 2705, and one of a source electrode and a drain electrode connected to a signal line 102; a first n-type MOS transistor (Qn1) 3402 with a gate electrode connected to the other of the source electrode and the drain electrode of the p-type MOS transistor (Qp) 3401, and one of a source electrode and a drain electrode connected to an (N−1)th scanning line 2704, and the other of the source electrode and the drain electrode connected to a pixel electrode 107; a voltage holding capacitor 106 formed between the gate electrode of the first n-type MOS transistor (Qn1) 3402 and a voltage holding capacitor electrode 105; a second n-type MOS transistor (Qn2) 3403 with a gate electrode and source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 3401 and the first and second n-type MOS transistors (Qn1) 3402 and (Qn2) 3403 are constituted by p-SiTFTs.

Furthermore, since the gate electrode and the source electrode of the second n-type MOS transistor (Qn2) 3403 are both connected to the voltage holding capacitor electrode 105, then the gate-source voltage Vgsn of the second n-type MOS transistor (Qn2) 3403 becomes 0V. Under this bias condition, so that the source-drain resistance Rdsn of the second n-type MOS transistor (Qn2) 3403 satisfies the beforementioned equation (5), the threshold value voltage of the second n-type MOS transistor (Qn2) 3403 is shift controlled to the negative side by channel-dose. At this time, the drain current-gate voltage characteristics of the second p-type MOS transistor (Qp2) 1003, and the operating point are the same as shown in FIG. 26. That is, as shown in FIG. 26, the threshold value voltage is shift controlled to the negative side by channel-dose so that when the gate-source voltage is 0V, the drain current becomes approximately 1E-8 (A). As a result, when the drain current of the second n-type MOS transistor (Qn2) 3403 becomes around 1E-8 (A) and the source-drain voltage Vdsn is 10V, then the source-drain resistance Rdsn becomes 1 GΩ. Furthermore, even if the second n-type MOS transistor (Qn2) 3403 is operated in the weakly inverted region with the source-drain voltage Vdsn changing from 2 to 14V, the drain current is approximately constant. The second n-type MOS transistor (Qn2) 3403 is operated as the bias current power supply for the case where the first n-type MOS transistor (Qn1) 3402 is operated as an analog amplifier.

With the seventh embodiment, the bias power supply VB 3404, and the source power supply VS 3501 necessary in the fifteenth and sixteenth embodiments are not necessary. However a channel-dose forming step is additionally required.

The above described drive method for the liquid crystal display device of the seventeenth embodiment shown in FIG. 36 is the same as the drive method for the liquid crystal display device of the fourteenth through sixteenth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 33. Moreover, also in the case where a TN liquid crystal is driven using the liquid crystal display device shown in FIG. 36, this can be driven with the same drive method as shown in FIG. 33.

That is to say, if the liquid crystal display device shown in FIG. 36 is used, then as with the fourteenth through sixteenth embodiments, the fluctuations of the pixel voltage Vpix accompanying the response of the liquid crystal can be eliminated, enabling a desired gradation to be obtained for each one field.

Moreover, with the liquid crystal display device shown in FIG. 36, the construction is such that the (N−1)th scanning line voltage is used as the power supply for the first n-type MOS transistor (Qn1) 3402 which operates as an analog amplifier, and as the reset power supply, and resetting of the amplifier is performed by the first n-type MOS transistor (Qn1) 3402 itself. Therefore wiring and circuits such as a power supply lead, a reset power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 3401 and the first and second n-type MOS transistors (Qn1) 3402 and (Qn2) 3403 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the seventh embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 37:
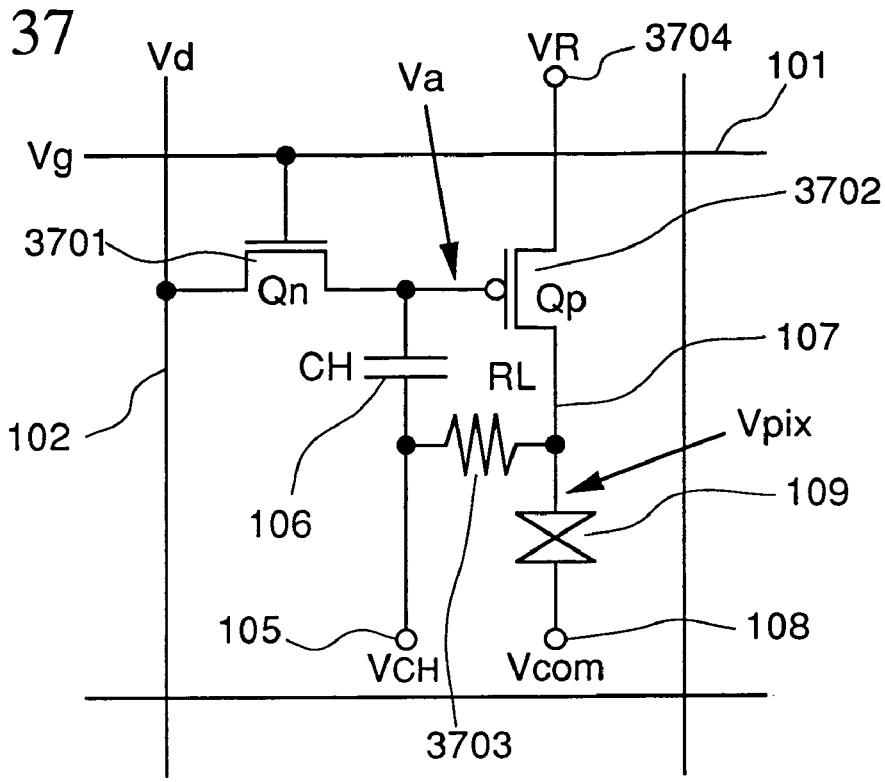
FIG. 37 is a diagram showing an eighteenth embodiment of a liquid crystal display device of the present invention.

An eighteenth embodiment of the present invention will now be described in detail with reference to the figures. FIG. 37 is a diagram showing an eighteenth embodiment of a liquid crystal display device of the present invention. As shown in the figure, the liquid crystal display device of the present invention comprises: an n-type MOS transistor (Qn) 3701 with a gate electrode connected to a scanning line 101, and one of a source electrode and a drain electrode connected to a signal line 102; a p-type MOS transistor (Qp) 3702 with a gate electrode connected to the other of the source electrode and the drain electrode of the n-type MOS transistor (Qn) 3701, and one of a source electrode and a drain electrode connected to a reset pulse power supply VR 3704, and the other of the source electrode and the drain electrode connected to a pixel electrode 107; a voltage holding capacitor 106 formed between the gate electrode of the p-type MOS transistor (Qp) 3702 and a voltage holding capacitor electrode 105; a resistor RL 3703 connected between the pixel electrode 107 and the voltage holding capacitor electrode 105; and a liquid crystal 109 which is to be switched, disposed between the pixel electrode 107 and an opposing electrode 108. Here the n-type MOS transistor (Qn) 3701 and the p-type MOS transistor (Qp) 3702 are constituted by p-SiTFTs.

Moreover, the value of the resistor RL 3703, as with the second embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 3703, have the relation shown by the previously mentioned equation (1).

For example, in the case when the resistance Rsp is 5 GΩ, then the value of the resistor RL 3703 is set to a value of around 1 GΩ. A value of 1 GΩ which is a large resistance not used in normal semiconductor integrated circuits, is formed from a semiconductor thin film or a semiconductor thin film which has been doped with impurities, as explained in the second embodiment.

That is to say, the construction and manufacturing method for the case where the resistor RL 3703 is formed from a lightly doped p-type semiconductor thin film (p−) are the same as shown in FIG. 4. Moreover, the construction and manufacturing method for the case where the resistor RL 3703 is formed from a semiconductor thin film (i layer) which has not been doped with impurities are the same as shown in FIG. 5. Furthermore, the construction and manufacturing method for the case where the resistor RL 3703 is formed from an n-type semiconductor thin film (n−) are the same as shown in FIG. 6. In the above, the description has been for the case where the resistor RL 3703 shown in FIG. 37 is formed from a semiconductor thin film or a semiconductor thin film doped with impurities. However provided the resistance satisfies equation (1), then other materials may be employed.

Figure 38:
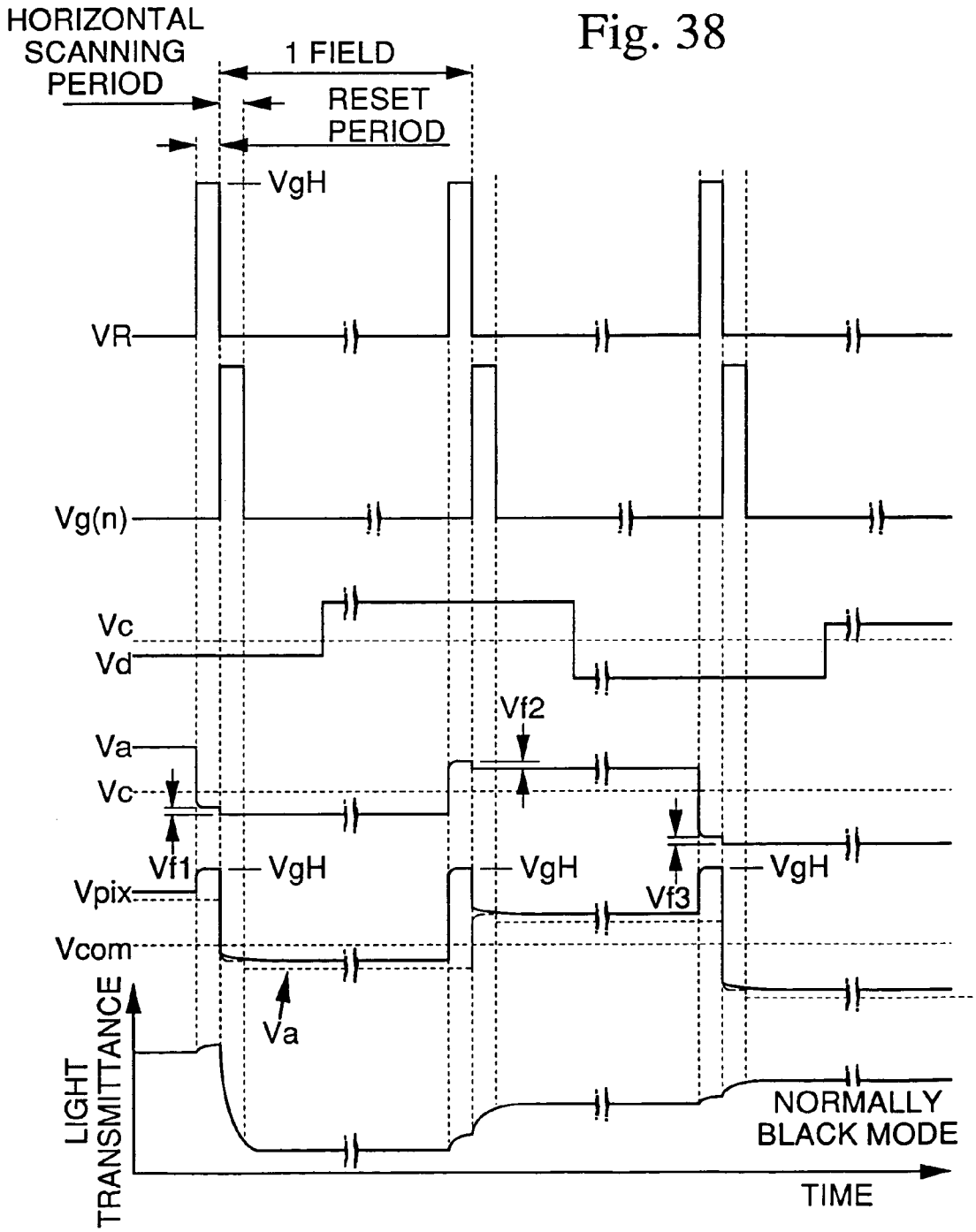
FIG. 38 is a diagram illustrating a drive method for the liquid crystal display device of the present invention.

As follows is a description of the drive method for the liquid crystal display device using the pixel construction shown in FIG. 37. FIG. 38 shows the timing chart, and the change in light transmittance of the liquid crystal, for a gate scanning voltage Vg, a data signal voltage Vd, a gate voltage Va of the p-type MOS transistor (Qp) 3702, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 37. Here the example is given for when the liquid crystal operates in a normally black mode, becoming dark when a voltage is not applied.

As shown in the figure, in the period where the reset pulse voltage VR becomes a high level VgH, the pixel electrode 107 attains the reset state due to the gate scanning voltage VgH being transferred through the p-type MOS transistor (Qp) 3702. Here as described below, the p-type MOS transistor (Qp) 3702 operates as a source follower type analog amplifier, after the reset pulse voltage VR becomes a low level. However, due to the pixel voltage Vpix becoming VgH in the period where the reset pulse voltage VR is a high level, the resetting of the p-type MOS transistor (Qp) 3702 is performed.

Then in the period immediately after the period where the reset pulse voltage VR becomes a high level VgH, where the gate scanning voltage Vg becomes a high level VgH, the n-type MOS transistor (Qn) 3701 comes on, and the data signal Vd input to the signal line is transferred to the gate electrode of the p-type MOS transistor (Qp) 3702 through the n-type MOS transistor (Qn) 3701. When the horizontal scanning period is completed and the gate scanning voltage Vg becomes a low level, the n-type MOS transistor (Qn) 3701 goes off, and the data signal transferred to the gate electrode of the p-type MOS transistor (Qp) 3702 is held by the voltage holding capacitor 105. At this time, with the gate input voltage Va of the p-type MOS transistor (Qp) 3702, at the time when the n-type MOS transistor (Qn) 3701 goes off, a voltage shift referred to as a feed-through voltage occurs through the capacitance between the gate and the source of the n-type MOS transistor (Qn) 3701. In FIG. 38 this is shown by Vf1, Vf2 and Vf3. The amount of this voltage shift Vf1, Vf2 and Vf3 can be made smaller by designing the value for the voltage holding capacitor 105 to be large. The gate input voltage Va of the p-type MOS transistor (Qp) 3702 is held until the gate scanning voltage Vg again becomes a high level in the subsequent field period and the n-type MOS transistor (Qn) 3701 is selected.

On the other hand, the p-type MOS transistor (Qp) 3702, on completion of resetting in the reset period where the reset pulse voltage VR becomes a high level, operates from the horizontal scanning period and thereafter as a source follower type analog amplifier with the pixel electrode 107 as the source electrode. At this time, in order to operate the p-type MOS transistor (Qp) 3702 as an analog amplifier, a voltage at least higher than (Vdmax−Vtp) is supplied to the voltage holding capacitor electrode 105. Here Vdmax is the maximum value of the data signal voltage Vd, while Vtp is the threshold value voltage of the p-type MOS transistor (Qp) 3702. The p-type MOS transistor (Qp) 3702, during the period until the reset pulse voltage VR in the next field becomes VgH to thus execute reset, can output an analog gradation voltage corresponding to the held gate input voltage Va. This output voltage changes depending on the transconductance gmp of the p-type MOS transistor (Qp) 3702 and the value of the resistor RL 3703, however it is generally represented by the previously mentioned equation (2).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 38, it becomes possible to obtain a desired gradation for each one field.

Furthermore, with the above drive method, the reset period is provided before the horizontal scanning period. However, it is also possible to drive such that the reset period and the horizontal scanning period have the same timing. In this case, selection of the pixel and the resetting of the p-type MOS transistor (Qp) 3702 are performed at the same time.

Moreover, with the liquid crystal display device of the present invention, the construction is such that resetting of the p-type MOS transistor (Qp) 3702 which operates as an analog amplifier is performed by the p-type MOS transistor (Qp) 3702 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the second and tenth embodiments, this has the advantage that the delay of the scanning pulse signal accompanying resetting of the amplifier can be eliminated.

Moreover, with the abovementioned embodiment, it was noted that the n-type MOS transistor (Qn) 3701 and the p-type MOS transistor (Qp) 3702 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 38 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 37, the p-type MOS transistor (Qp) 3702 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the eighteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 39:
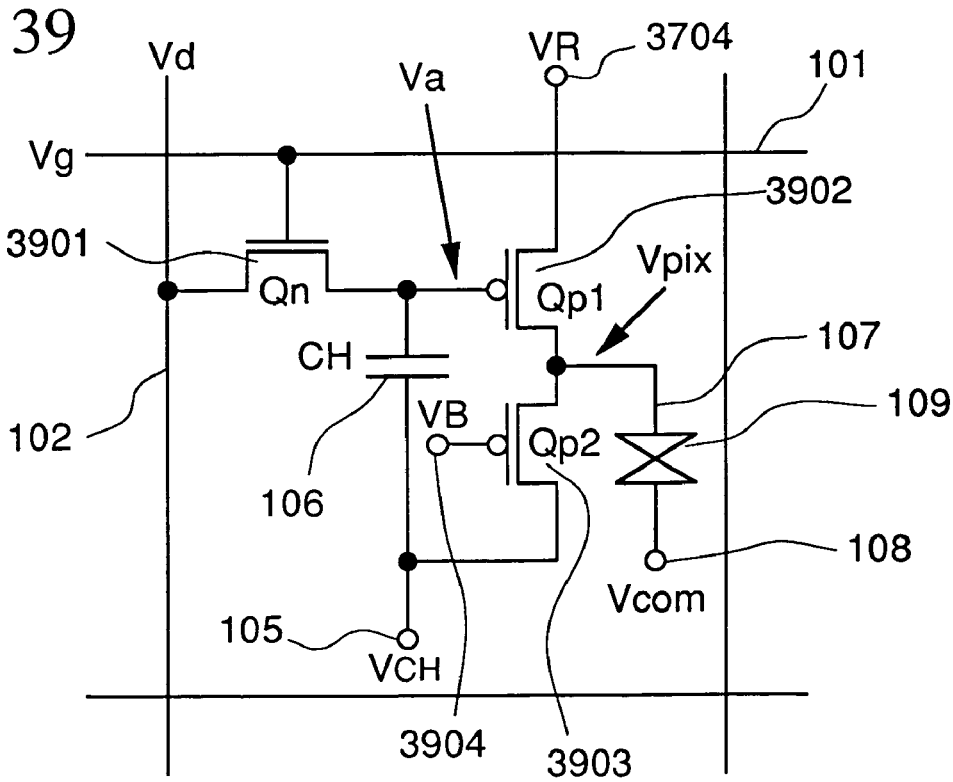
FIG. 39 is a diagram showing a nineteenth embodiment of a liquid crystal display device of the present invention.

A nineteenth embodiment of the present invention will now be described in detail with reference to the figures. FIG. 39 is a diagram showing a nineteenth embodiment of a liquid crystal display device of the present invention. As shown in the figure, the liquid crystal display device of the present invention comprises: an n-type MOS transistor (Qn) 3901 with a gate electrode connected to a scanning line 101, and one of a source electrode and a drain electrode connected to a signal line 102; a first p-type MOS transistor (Qp1) 3902 with a gate electrode connected to the other of the source electrode and the drain electrode of the n-type MOS transistor (Qn) 3901, and one of a source electrode and a drain electrode connected to a reset pulse power supply VR 3704, and the other of the source electrode and the drain electrode connected to a pixel electrode 107; a voltage holding capacitor 106 formed between the gate electrode of the first p-type MOS transistor (Qp1) 3902 and a voltage holding capacitor electrode 105; a second p-type MOS transistor (Qp2) 3903 with a gate electrode connected to a bias power supply VB 3904, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the n-type MOS transistor (Qn) 3901 and the first and second p-type MOS transistors (Qp1) 3902 and (Qp2) 3903 are constituted by p-SiTFTs. Moreover, the bias power supply VB 3904 for supply to the gate electrode of the second p-type MOS transistor (Qp2) 3903, is set so that a source-drain resistance Rdsp of the second p-type MOS transistor (Qp2) 3903 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previously mentioned equation (3).

For example, in the case when the resistance Rsp is 5 GΩ, then a bias power supply VB 3904 such that the source-drain resistance Rdsp does not exceed 1 GΩ is supplied. At this time, the drain current-gate current characteristics of the second p-type MOS transistor (Qp2) 3903, and the operating point are the same as shown in FIG. 11. That is, with the example in FIG. 11, the gate-source voltage (VB−VCH) of the second p-type MOS transistor (Qp2) 3903 is set to around −3V. As a result, when the drain current of the second p-type MOS transistor (Qp2) 3903 becomes around 1E-8 (A) and the source-drain voltage Vdsp is −10V, then the source-drain resistance Rdsp becomes 1 GΩ. Furthermore, even if the second p-type MOS transistor (Qp2) 3903 is operated in the weakly inverted region with the source-drain voltage Vdsp changing from −2 to −14V, the drain current is approximately constant. The second p-type MOS transistor (Qp2) 3903 is operated as the bias current power supply for the case where the first p-type MOS transistor (Qp1) 3902 is operated as an analog amplifier.

The above described drive method for the liquid crystal display device of the nineteenth embodiment shown in FIG. 39 is the same as the drive method for the liquid crystal display device of the eighteenth embodiment shown beforehand with reference to FIG. 38. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 38. Moreover, also in the case where a TN liquid crystal is driven using the liquid crystal display device shown in FIG. 39, this can be driven with the same drive method as shown in FIG. 38.

That is to say, if the liquid crystal display device shown in FIG. 39 is used, then as with the eighteenth embodiment, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first p-type MOS transistor (Qp) 3902 are performed at the same time.

Moreover, with the liquid crystal display device shown in FIG. 39, the construction is such that resetting of the first p-type MOS transistor (Qp1) 3902 which operates as an analog amplifier, is performed by the first p-type MOS transistor (Qp1) 3902 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the third and eleventh embodiments, this has the advantage that the delay of the scanning pulse signal accompanying resetting of the amplifier can be eliminated.

Moreover, with the abovementioned embodiment, it was noted that the n-type MOS transistor (Qn) 3901 and the first and second p-type MOS transistors (Qp1) 3902 and (Qp2) 3903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the nineteenth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 40:
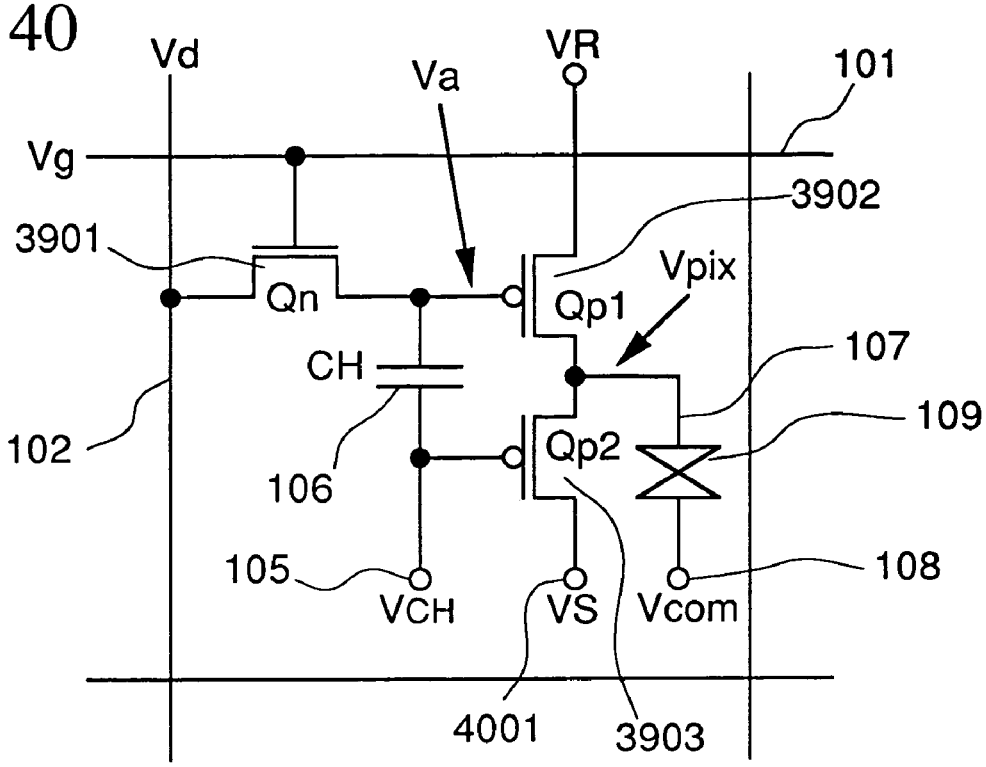
FIG. 40 is a diagram showing a twentieth embodiment of a liquid crystal display device of the present invention.

A twentieth embodiment of the present invention will now be described in detail with reference to the figures. FIG. 40 is a diagram showing a twentieth embodiment of a liquid crystal display device of the present invention. As shown in the figure, the liquid crystal display device of the present invention comprises: an n-type MOS transistor (Qn) 3901 with a gate electrode connected to a scanning line 101, and one of a source electrode and a drain electrode connected to a signal line 102; a first p-type MOS transistor (Qp1) 3902 with a gate electrode connected to the other of the source electrode and the drain electrode of the n-type MOS transistor (Qn) 3901, and one of a source electrode and a drain electrode connected to a reset pulse power supply VR 3704, and the other of the source electrode and the drain electrode connected to a pixel electrode 107; a voltage holding capacitor 106 formed between the gate electrode of the first p-type MOS transistor (Qp1) 3902 and a voltage holding capacitor electrode 105; a second p-type MOS transistor (Qp2) 3903 with a gate electrode connected to the voltage holding capacitor electrode 105, a source electrode connected to a source power supply VS 4001, and a drain electrode connected to the pixel electrode 107; and a liquid crystal 109 which is to be switched, disposed between the pixel electrode 107 and an opposing electrode 108. Here the n-type MOS transistor (Qn) 3901 and the first and second p-type MOS transistors (Qp1) 3902 and (Qp2) 3903 are constituted by p-SiTFTs.

Moreover, the source power supply VS 4001 for supply to the gate electrode of the second p-type MOS transistor (Qp2) 3903, is set so that a source-drain resistance Rdsp of the second p-type MOS transistor (Qp2) 3903 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previously mentioned equation (3). For example, in the case when the resistance Rsp is 5 GΩ, then a source power supply VS 4001 such that the source-drain resistance Rdsp does not exceed 1 GΩ is supplied. The operating point for the second p-type MOS transistor (Qp2) 3903 is the same as the beforementioned operating point shown in FIG. 11. That is, with the example in FIG. 11, the gate-source voltage (VCH−VS) of the second p-type MOS transistor (Qp2) 3903 is set to around −3V. As a result, when the drain current of the second p-type MOS transistor (Qp2) 3903 becomes around 1E-8 (A) and the source-drain voltage Vdsp is −10V, then the source-drain resistance Rdsp becomes 1 GΩ. Furthermore, even if the second p-type MOS transistor (Qp2) 3903 is operated in the weakly inverted region with the source-drain voltage Vdsp changing from −2 to −14V, the drain current is approximately constant. The second p-type MOS transistor (Qp2) 3903 is operated as the bias current power supply for the case where the first p-type MOS transistor (Qp1) 3902 is operated as an analog amplifier.

The above described drive method for the liquid crystal display device of the twentieth embodiment shown in FIG. 40 is the same as the drive method for the liquid crystal display device of the eighteenth and nineteenth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 38. Moreover, also in the case where a TN liquid crystal is driven using the liquid crystal display device shown in FIG. 40, this can be driven with the same drive method as shown in FIG. 38.

That is to say, if the liquid crystal display device shown in FIG. 40 is used, then as with the eighteenth and nineteenth embodiments, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first p-type MOS transistor (Qp1) 3902 are performed at the same time.

Moreover, with the liquid crystal display device shown in FIG. 40, the construction is such that resetting of the first p-type MOS transistor (Qp1) 3902 which operates as an analog amplifier, is performed by the first p-type MOS transistor (Qp1) 3902 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the fourth and twelfth embodiments, this has the advantage that the delay of the scanning pulse signal accompanying resetting of the amplifier can be eliminated.

Moreover, with the abovementioned embodiment, it was noted that the n-type MOS transistor (Qn) 3901 and the first and second p-type MOS transistors (Qp1) 3902 and (Qp2) 3903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twentieth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 41:
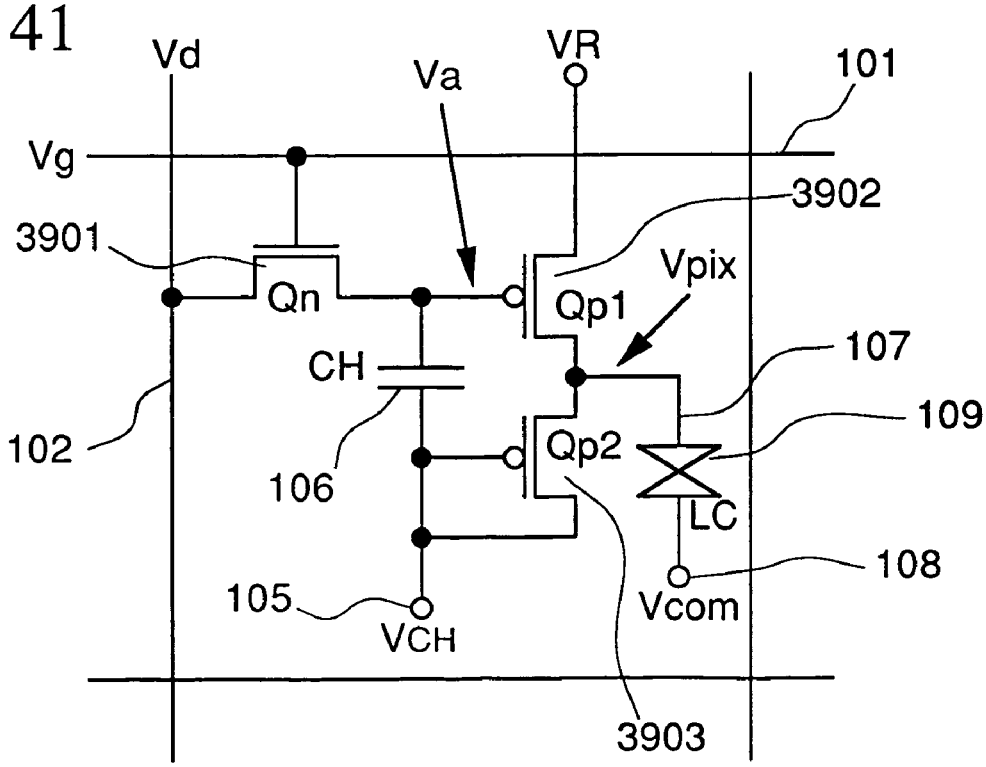
FIG. 41 is a diagram showing a twenty first embodiment of a liquid crystal display device of the present invention.

A twenty first embodiment of the present invention will now be described in detail with reference to the figures. FIG. 41 is a diagram showing a twenty first embodiment of a liquid crystal display device of the present invention. As shown in the figure, the liquid crystal display device of the present invention comprises: an n-type MOS transistor (Qn) 3901 with a gate electrode connected to a scanning line 101, and one of a source electrode and a drain electrode connected to a signal line 102; a first p-type MOS transistor (Qp1) 3902 with a gate electrode connected to the other of the source electrode and the drain electrode of the n-type MOS transistor (Qn) 3901, and one of a source electrode and a drain electrode connected to a reset pulse power supply VR 3704, and the other of the source electrode and the drain electrode connected to a pixel electrode 107; a voltage holding capacitor 106 formed between the gate electrode of the first p-type MOS transistor (Qp1) 3902 and a voltage holding capacitor electrode 105; a second p-type MOS transistor (Qp2) 3903 with a gate electrode and a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the n-type MOS transistor (Qn) 3901 and the first and second p-type MOS transistors (Qp1) 3902 and (Qp2) 3903 are constituted by p-SiTFTs.

Furthermore, since the gate electrode and the source electrode of the second p-type MOS transistor (Qp2) 3903 are both connected to the voltage holding capacitor electrode 105, then the gate-source voltage Vgsp of the second p-type MOS transistor (Qp2) 3903 becomes 0V. Under this bias condition, so that the source-drain resistance Rdsp of the second p-type MOS transistor (Qp2) 3903 satisfies the beforementioned equation (3), the threshold value voltage of the second p-type MOS transistor (Qp2) 3903 is shift controlled to the positive side by channel-dose. At this time, the drain current-gate current characteristics of the second p-type MOS transistor (Qp2) 3903, and the operating point are the same as shown in FIG. 14. That is, with the example in FIG. 14, the threshold value voltage is shift controlled to the positive side by channel-dose so that when the gate-source voltage is 0V, the drain current becomes approximately 1E-8 (A). As a result, when the drain current of the second p-type MOS transistor (Qp2) 3903 becomes around 1E-8 (A) and the source-drain voltage Vdsp is −10V, then the source-drain resistance Rdsp becomes 1 GΩ. Furthermore, even if the second p-type MOS transistor (Qp2) 3903 is operated in the weakly inverted region with the source-drain voltage Vdsp changing from −2 to −14V, the drain current is approximately constant. The second p-type MOS transistor (Qp2) 3903 is operated as the bias current power supply for the case where the first p-type MOS transistor (Qp1) 3902 is operated as an analog amplifier.

With the twenty first embodiment, the bias power supply VB 3904, and the source power supply VS 4001 necessary in the nineteenth and twentieth embodiments are not necessary. However a channel-dose forming step is additionally required.

The above described drive method for the liquid crystal display device of the twenty first embodiment shown in FIG. 41 is the same as the drive method for the liquid crystal display device of the eighteenth through twentieth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 38. Moreover, also in the case where a TN liquid crystal is driven using the liquid crystal display device shown in FIG. 41, this can be driven with the same drive method as shown in FIG. 38.

That is to say, if the liquid crystal display device shown in FIG. 41 is used, then as with the eighteenth through twentieth embodiments, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first p-type MOS transistor (Qp1) 3902 are performed at the same time.

Moreover, with the liquid crystal display device shown in FIG. 41, the construction is such that resetting of the first p-type MOS transistor (Qp1) 3902 which operates as an analog amplifier, is performed by the first p-type MOS transistor (Qp1) 3902 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the fifth and thirteenth embodiments, this has the advantage that the delay of the scanning pulse signal accompanying resetting of the amplifier can be eliminated.

Moreover, with the abovementioned embodiment, it was noted that the n-type MOS transistor (Qn) 3901 and the first and second p-type MOS transistors (Qp1) 3902 and (Qp2) 3903 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty first embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 42:
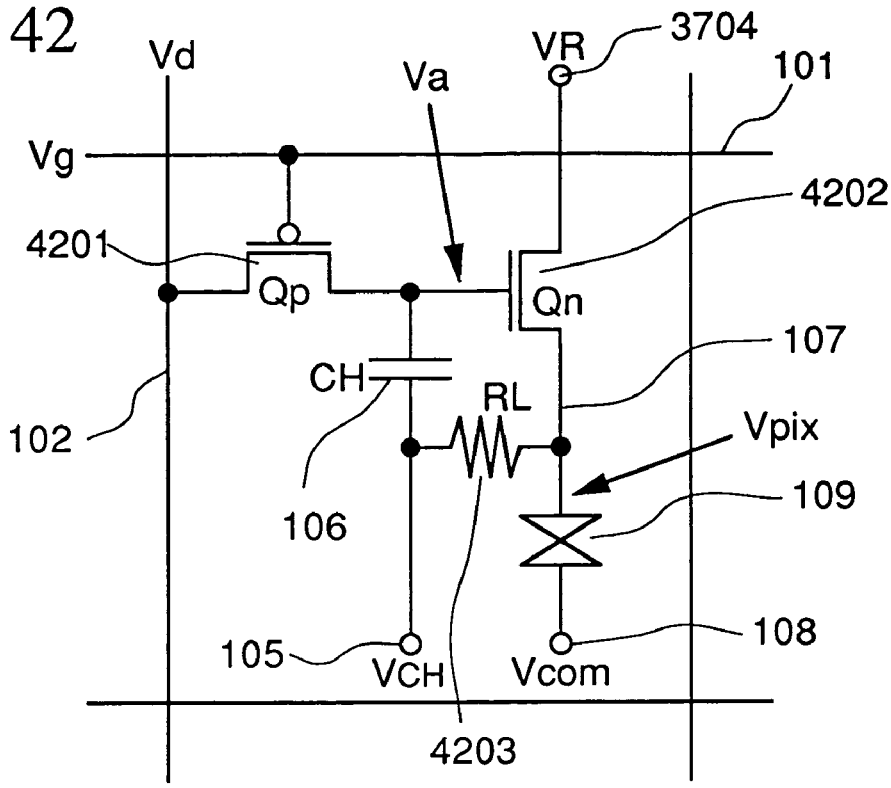
FIG. 42 is a diagram showing a twenty second embodiment of a liquid crystal display device of the present invention.

A twenty second embodiment of the present invention will now be described in detail with reference to the figures. FIG. 42 is a diagram showing a twenty second embodiment of a liquid crystal display device of the present invention. As shown in the figure, the liquid crystal display device of the present invention comprises: a p-type MOS transistor (Qp) 4201 with a gate electrode connected to a scanning line 101, and one of a source electrode and a drain electrode connected to a signal line 102; an n-type MOS transistor (Qn) 4202 with a gate electrode connected to the other of the source electrode and the drain electrode of the p-type MOS transistor (Qp) 4201, and one of a source electrode and a drain electrode connected to a reset pulse power supply VR 3704, and the other of the source electrode and the drain electrode connected to a pixel electrode 107; a voltage holding capacitor 106 formed between the gate electrode of the n-type MOS transistor (Qn) 4202 and a voltage holding capacitor electrode 105; a resistor RL 4203 connected between the pixel electrode 107 and the voltage holding capacitor electrode 105; and a liquid crystal 109 which is to be switched, disposed between the pixel electrode 107 and an opposing electrode 108. Here the p-type MOS transistor (Qp) 4201 and the n-type MOS transistor (Qn) 4202 are constituted by p-SiTFTs.

Moreover, the value of the resistor RL 4203, as with the sixth embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 4203, have the relation shown by the previously mentioned equation (1).

For example, in the case when the resistance Rsp is 5 GΩ, then the value of the resistor RL 4203 is set to a value of around 1 GΩ. A value of 1 GΩ which is a large resistance not used in normal semiconductor integrated circuits, is formed from a semiconductor thin film or a semiconductor thin film which has been doped with impurities, as explained in the second embodiment.

That is to say, the construction and manufacturing method for the case where the resistor RL 4203 is formed from a lightly doped n-type semiconductor thin film (n−) are the same as shown in FIG. 16. Moreover, the construction and manufacturing method for the case where the resistor RL 4203 is formed from a semiconductor thin film (i layer) which has not been doped with impurities are the same as shown in FIG. 17. Furthermore, the construction and manufacturing method for the case where the resistor RL 4203 is formed from a lightly doped p-type semiconductor thin film (p−) are the same as shown in FIG. 18. In the above, the description has been for the case where the resistor RL 4203 shown in FIG. 42 is formed from a semiconductor thin film or a semiconductor thin film doped with impurities. However provided the resistance satisfies equation (1), then other materials may be employed.

Figure 43:
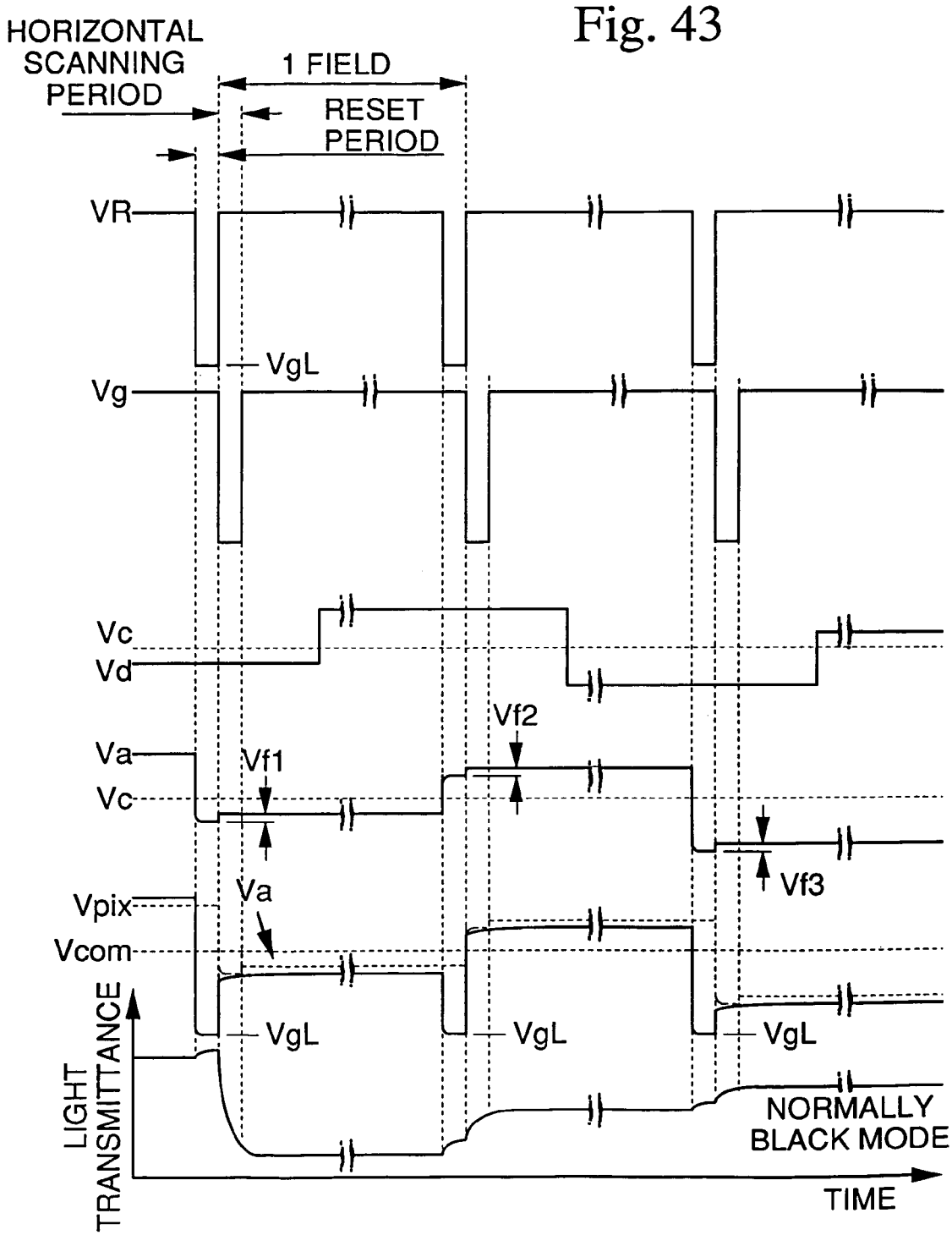
FIG. 43 is a diagram illustrating a drive method for the liquid crystal display device of the present invention.

As follows is a description of the drive method for the liquid crystal display device using the pixel construction shown in FIG. 42. FIG. 43 shows the timing chart, and the change in light transmittance of the liquid crystal, for a gate scanning voltage Vg, a data signal voltage Vd, a gate voltage Va of the n-type MOS transistor (Qn) 4202, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 42. Here the example is given for when the liquid crystal operates in a normally black mode, becoming dark when a voltage is not applied.

As shown in the figure, in the period where the reset pulse voltage VR becomes a low level VgL, the pixel electrode 107 attains the reset state due to the gate scanning voltage VgL being transferred through the n-type MOS transistor (Qn) 4202. Here as described below, the n-type MOS transistor (Qn) 4202 operates as a source follower type analog amplifier, after the reset pulse voltage VR becomes a high level. However, due to the pixel voltage Vpix becoming VgL in the period where the reset pulse voltage VR is a low level, the resetting of the n-type MOS transistor (Qn) 4202 is performed.

Then in the period immediately after the period where the reset pulse voltage VR becomes a low level VgL, where the gate scanning voltage Vg becomes a low level VgL, the p-type MOS transistor (Qp) 4201 comes on, and the data signal Vd input to the signal line is transferred to the gate electrode of the n-type MOS transistor (Qn) 4202 through the p-type MOS transistor (Qp) 4201. When the horizontal scanning period is completed and the gate scanning voltage Vg becomes a high level, the p-type MOS transistor (Qp) 4201 goes off, and the data signal transferred to the gate electrode of the n-type MOS transistor (Qn) 4202 is held by the voltage holding capacitor 105. At this time, with the gate input voltage Va of the n-type MOS transistor (Qn) 4202, at the time when the p-type MOS transistor (Qp) 4201 goes off, a voltage shift referred to as a feed-through voltage occurs through the capacitance between the gate and the source of the p-type MOS transistor (Qp) 4201. In FIG. 43 this is shown by Vf1, Vf2 and Vf3. The amount of this voltage shift Vf1, Vf2 and Vf3 can be made smaller by designing the value for the voltage holding capacitor 105 to be large. The gate input voltage Va of the n-type MOS transistor (Qn) 4202 is held until the gate scanning voltage Vg again becomes a low level in the subsequent field period and the p-type MOS transistor (Qp) 4201 is selected.

On the other hand, the n-type MOS transistor (Qn) 4202, on completion of resetting in the reset period where the reset pulse voltage VR becomes a low level VgL, operates from the horizontal scanning period and thereafter as a source follower type analog amplifier with the pixel electrode 107 as the source electrode. At this time, in order to operate the n-type MOS transistor (Qn) 4202 as an analog amplifier, a voltage at least lower than (Vdmin-Vtn) is supplied to the voltage holding capacitor electrode 105. Here Vdmin is the minimum value of the data signal voltage Vd, while Vtn is the threshold value voltage of the n-type MOS transistor (Qn) 4202. The n-type MOS transistor (Qn) 4202, during the period until the reset pulse voltage VR in the next field becomes VgL to thus execute reset, can output an analog gradation voltage corresponding to the held gate input voltage Va. This output voltage changes depending on the transconductance gmn of the n-type MOS transistor (Qn) 4202 and the value of the resistor RL 4203, however it is generally represented by the previously mentioned equation (4).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 43, it becomes possible to obtain a desired gradation for each one field.

Furthermore, with the above drive method, the reset period is provided before the horizontal scanning period. However, it is also possible to drive such that the reset period and the horizontal scanning period have the same timing. In this case, selection of the pixel and the resetting of the n-type MOS transistor (Qn) 4202 are performed at the same time.

Moreover, with the liquid crystal display device of the present invention, the construction is such that resetting of the n-type MOS transistor (Qn) 4202 which operates as an analog amplifier is performed by the n-type MOS transistor (Qn) 4202 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the sixth and fourteenth embodiments, this has the advantage that the delay of the scanning pulse signal accompanying resetting of the amplifier can be eliminated.

Moreover, with the abovementioned embodiment, it was noted that the p-type MOS transistor (Qp) 4201 and the n-type MOS transistor (Qn) 4202 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 43 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 42, the n-type MOS transistor (Qn) 4202 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the twenty second embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 44:
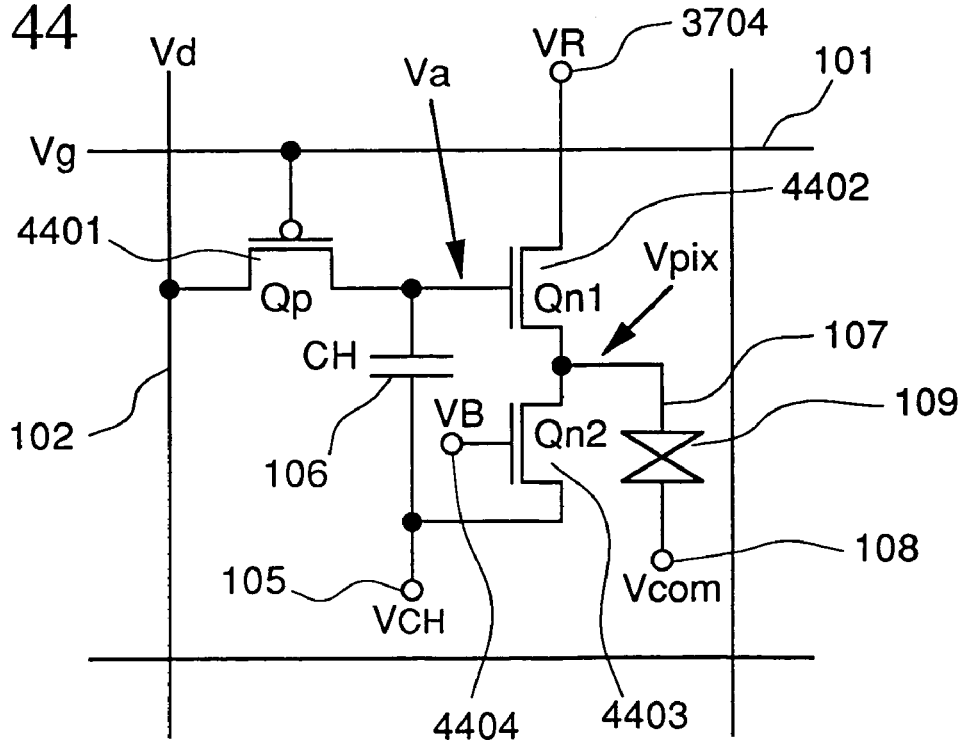
FIG. 44 is a diagram showing a twenty third embodiment of a liquid crystal display device of the present invention.

A twenty third embodiment of the present invention will now be described in detail with reference to the figures. FIG. 44 is a diagram showing a twenty third embodiment of a liquid crystal display device of the present invention. As shown in the figure, the liquid crystal display device of the present invention comprises: a p-type MOS transistor (Qp) 4401 with a gate electrode connected to a scanning line 101, and one of a source electrode and a drain electrode connected to a signal line 102; a first n-type MOS transistor (Qn1) 4402 with a gate electrode connected to the other of the source electrode and the drain electrode of the p-type MOS transistor (Qp) 4401, and one of a source electrode and a drain electrode connected to a reset pulse power supply VR 3704, and the other of the source electrode and the drain electrode connected to a pixel electrode 107; a voltage holding capacitor 106 formed between the gate electrode of the first n-type MOS transistor (Qn1) 4402 and a voltage holding capacitor electrode 105; a second n-type MOS transistor (Qn2) 4403 with a gate electrode connected to a bias power supply VB 4404, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 4401 and the first and second n-type MOS transistors (Qn1) 4402 and (Qn2) 4403 are constituted by p-SiTFTs. Moreover, the bias power supply VB 4404 for supply to the gate electrode of the second n-type MOS transistor (Qn2) 4403, is set so that a source-drain resistance Rdsn of the second n-type MOS transistor (Qn2) 4403 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previously mentioned equation (5).

For example, in the case when the resistance Rsp is 5 GΩ, then a bias power supply VB 4404 such that the source-drain resistance Rdsn does not exceed 1 GΩ is supplied. At this time, the drain current-gate current characteristics of the second n-type MOS transistor (Qn2) 4403, and the operating point are the same as shown in FIG. 23. That is, with the example in FIG. 23, the gate-source voltage (VB−VCH) of the second n-type MOS transistor (Qn2) 4403 is set to around 3V. As a result, when the drain current of the second n-type MOS transistor (Qn2) 4403 becomes around 1E-8 (A) and the source-drain voltage Vdsn is 10V, then the source-drain resistance Rdsn becomes 1 GΩ. Furthermore, even if the second n-type MOS transistor (Qn2) 4403 is operated in the weakly inverted region with the source-drain voltage Vdsn changing from 2 to 14V, the drain current is approximately constant. The second n-type MOS transistor (Qn2) 4403 is operated as the bias current power supply for the case where the first n-type MOS transistor (Qn1) 4402 is operated as an analog amplifier.

The above described drive method for the liquid crystal display device of the twenty third embodiment shown in FIG. 44 is the same as the drive method for the liquid crystal display device of the twenty second embodiment shown beforehand with reference to FIG. 43. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 43. Moreover, also in the case where a TN liquid crystal is driven using the liquid crystal display device shown in FIG. 44, this can be driven with the same drive method as shown in FIG. 43.

That is to say, if the liquid crystal display device shown in FIG. 44 is used, then as with the twenty second embodiment, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first n-type MOS transistor (Qn1) 4402 are performed at the same time.

Moreover, with the liquid crystal display device shown in FIG. 44, the construction is such that resetting of the first n-type MOS transistor (Qn1) 4402 which operates as an analog amplifier, is performed by the first n-type MOS transistor (Qn1) 4402 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR 3704 is provided separately, then compared to the liquid crystal display device described in the seventh and fifteenth embodiments, this has the advantage that the delay of the scanning pulse signal accompanying resetting of the amplifier can be eliminated.

Moreover, with the abovementioned embodiment, it was noted that the p-type MOS transistor (Qp) 4401 and the first and second n-type MOS transistors (Qn1) 4402 and (Qn2) 4403 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty third embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 45:
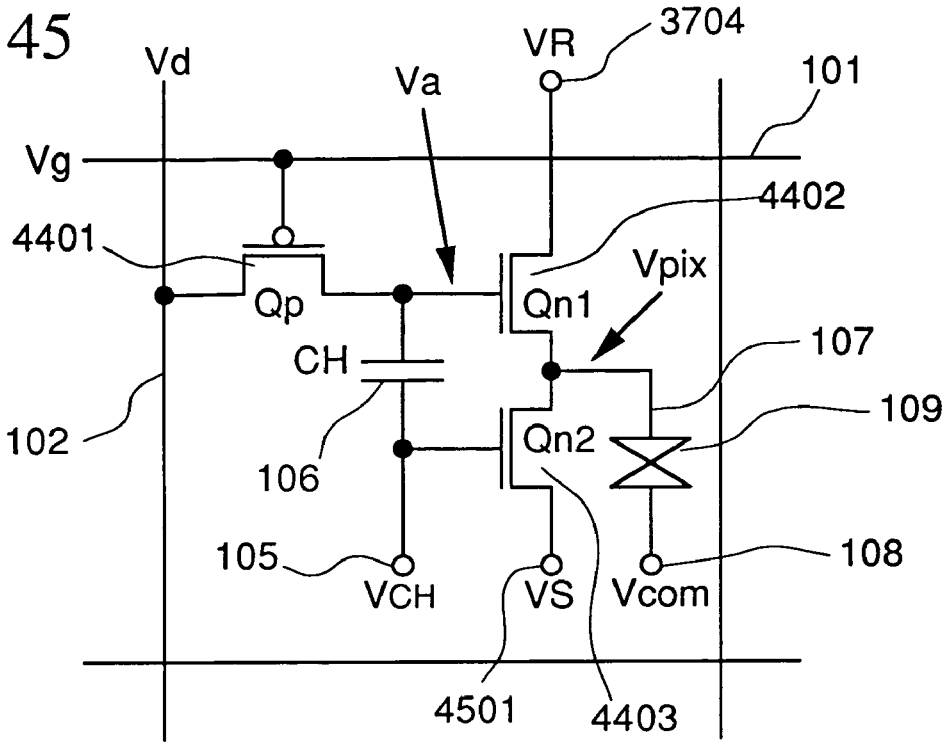
FIG. 45 is a diagram showing a twenty fourth embodiment of a liquid crystal display device of the present invention.

A twenty fourth embodiment of the present invention will now be described in detail with reference to the figures. FIG. 45 is a diagram showing a twenty fourth embodiment of a liquid crystal display device of the present invention. As shown in the figure, the liquid crystal display device of the present invention comprises: a p-type MOS transistor (Qp) 4401 with a gate electrode connected to a scanning line 101, and one of a source electrode and a drain electrode connected to a signal line 102; a first n-type MOS transistor (Qn1) 4402 with a gate electrode connected to the other of the source electrode and the drain electrode of the p-type MOS transistor (Qp) 4401, and one of a source electrode and a drain electrode connected to a reset pulse power supply VR 3704, and the other of the source electrode and the drain electrode connected to a pixel electrode 107; a voltage holding capacitor 106 formed between the gate electrode of the first n-type MOS transistor (Qn1) 4402 and a voltage holding capacitor electrode 105; a second n-type MOS transistor (Qn2) 4403 with a gate electrode connected to the voltage holding capacitor electrode 105, a source electrode connected to a source power supply VS 4501, and a drain electrode connected to the pixel electrode 107; and a liquid crystal 109 which is to be switched, disposed between the pixel electrode 107 and an opposing electrode 108. Here the p-type MOS transistor (Qp) 4401 and the first and second n-type MOS transistors (Qn1) 4402 and (Qn2) 4403 are constituted by p-SiTFTs.

Moreover, the source power supply VS 4501 for supply to the gate electrode of the second n-type MOS transistor (Qn2) 4403, is set so that a source-drain resistance Rdsn of the second n-type MOS transistor (Qn2) 4403 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previously mentioned equation (5). For example, in the case when the resistance Rsp is 5 GΩ, then a source power supply VS 4501 such that the source-drain resistance Rdsn does not exceed 1 GΩ is supplied. The operating point for the second n-type MOS transistor (Qn2) 4403 is the same as the beforementioned operating point shown in FIG. 23. That is, with the example in FIG. 23, the gate-source voltage (VCH–VS) of the second n-type MOS transistor (Qn2) 4403 is set to around 3V. As a result, when the drain current of the second n-type MOS transistor (Qn2) 4403 becomes around 1E-8 (A) and the source-drain voltage Vdsn is 10V, then the source-drain resistance Rdsn becomes 1 GΩ. Furthermore, even if the second n-type MOS transistor (Qn2) 4403 is operated in the weakly inverted region with the source-drain voltage Vdsn changing from 2 to 14V, the drain current is approximately constant. The second n-type MOS transistor (Qn2) 4403 is operated as the bias current power supply for the case where the first n-type MOS transistor (Qn1) 4402 is operated as an analog amplifier.

The above described drive method for the liquid crystal display device of the twenty fourth embodiment shown in FIG. 45 is the same as the drive method for the liquid crystal display device of the twenty second and twenty third embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 43. Moreover, also in the case where a TN liquid crystal is driven using the liquid crystal display device shown in FIG. 45, this can be driven with the same drive method as shown in FIG. 43.

That is to say, if the liquid crystal display device shown in FIG. 45 is used, then as with the twenty second and twenty third embodiments, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first n-type MOS transistor (Qn1) 4402 are performed at the same time.

Moreover, with the liquid crystal display device shown in FIG. 45, the construction is such that resetting of the first n-type MOS transistor (Qn1) 4402 which operates as an analog amplifier, is performed by the first n-type MOS transistor (Qn1) 4402 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the eighth and sixteenth embodiments, this has the advantage that the delay of the scanning pulse signal accompanying resetting of the amplifier can be eliminated.

Moreover, with the abovementioned embodiment, it was noted that the p-type MOS transistor (Qp) 4401 and the first and second n-type MOS transistors (Qn1) 4402 and (Qn2) 4403 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty fourth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 46:
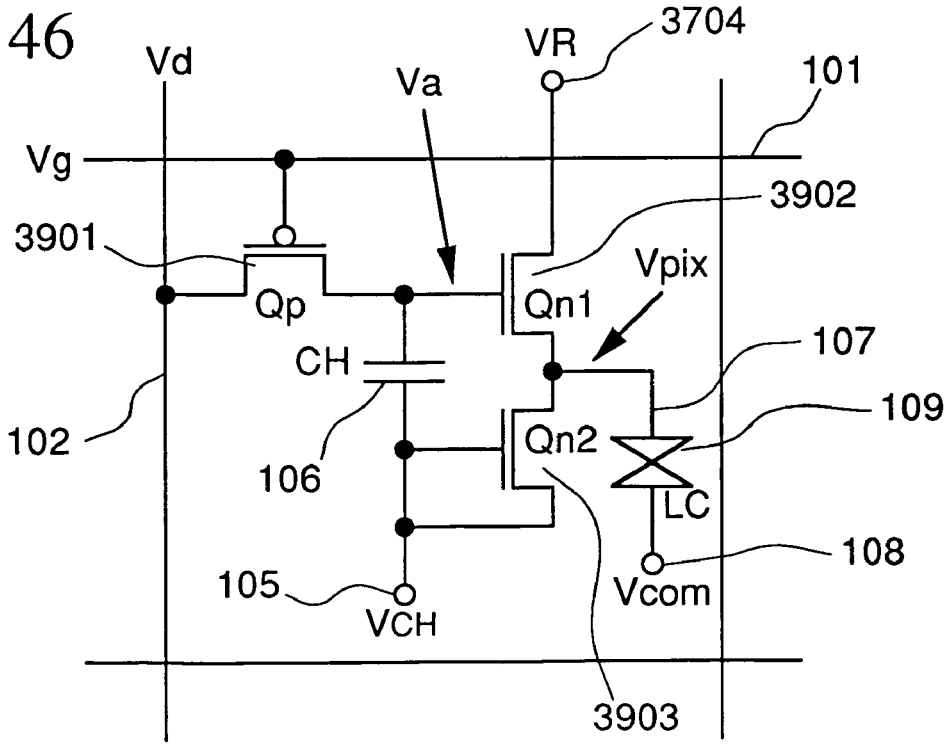
FIG. 46 is a diagram showing a twenty fifth embodiment of a liquid crystal display device of the present invention.

A twenty fifth embodiment of the present invention will now be described in detail with reference to the figures. FIG. 46 is a diagram showing a twenty fifth embodiment of a liquid crystal display device of the present invention. As shown in the figure, the liquid crystal display device of the present invention comprises: a p-type MOS transistor (Qp) 4401 with a gate electrode connected to a scanning line 101, and one of a source electrode and a drain electrode connected to a signal line 102; a first n-type MOS transistor (Qn1) 4402 with a gate electrode connected to the other of the source electrode and the drain electrode of the p-type MOS transistor (Qp) 4401, and one of a source electrode and a drain electrode connected to a reset pulse power supply VR 3704, and the other of the source electrode and the drain electrode connected to a pixel electrode 107; a voltage holding capacitor 106 formed between the gate electrode of the first n-type MOS transistor (Qn1) 4402 and a voltage holding capacitor electrode 105; a second n-type MOS transistor (Qn2) 4403 with a gate electrode and a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the p-type MOS transistor (Qp) 4401 and the first and second n-type MOS transistors (Qn1) 4402 and (Qn2) 4403 are constituted by p-SiTFTs.

Furthermore, since the gate electrode and the source electrode of the second n-type MOS transistor (Qn2) 4403 are both connected to the voltage holding capacitor electrode 105, then the gate-source voltage Vgsn of the second n-type MOS transistor (Qn2) 4403 becomes 0V. Under this bias condition, so that the source-drain resistance Rdsn of the second n-type MOS transistor (Qn2) 4403 satisfies the beforementioned equation (5), the threshold value voltage of the second n-type MOS transistor (Qn2) 4403 is shift controlled to the negative side by channel-dose. At this time, the drain current-gate current characteristics of the second n-type MOS transistor (Qn2) 4403, and the operating point are the same as shown in FIG. 26. That is, with the example in FIG. 26, the threshold value voltage is shift controlled to the negative side by channel-dose so that when the gate-source voltage is 0V, the drain current becomes approximately 1E-8 (A). As a result, when the drain current of the second n-type MOS transistor (Qn2) 4403 becomes around 1E-8 (A) and the source-drain voltage Vdsn is 10V, then the source-drain resistance Rdsn becomes 1 GΩ. Furthermore, even if the second n-type MOS transistor (Qn2) 4403 is operated in the weakly inverted region with the source-drain voltage Vdsn changing from 2 to 14V, the drain current is approximately constant. The second n-type MOS transistor (Qn2) 4403 is operated as the bias current power supply for the case where the first n-type MOS transistor (Qn1) 4402 is operated as an analog amplifier.

With the twenty fifth embodiment, the bias power supply VB 4404, and the source power supply VS 4501 necessary in the twenty third and twenty fourth embodiments are not necessary. However a channel-dose forming step is additionally required.

The above described drive method for the liquid crystal display device of the twenty fifth embodiment shown in FIG. 46 is the same as the drive method for the liquid crystal display device of the twenty second through twenty fourth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 43. Moreover, also in the case where a TN liquid crystal is driven using the liquid crystal display device shown in FIG. 46, this can be driven with the same drive method as shown in FIG. 43.

That is to say, if the liquid crystal display device shown in FIG. 46 is used, then as with the twenty second through twenty fourth embodiments, the fluctuations of the pixel voltage Vpix accompanying the response of the liquid crystal can be eliminated, enabling a desired gradation to be obtained for each one field.

Furthermore, with the above drive method, the reset period is provided before the horizontal scanning period. However, it is also possible to drive such that the reset period and the horizontal scanning period have the same timing. In this case, selection of the pixel and the resetting of the first n-type MOS transistor (Qn1) 4402 are performed at the same time.

Moreover, with the liquid crystal display device shown in FIG. 46, the construction is such that resetting of the first n-type MOS transistor (Qn1) 4402 which operates as an analog amplifier, is performed by the first n-type MOS transistor (Qn1) 4402 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, with the abovementioned embodiment, it was noted that the p-type MOS transistor (Qp) 4401 and the first and second n-type MOS transistors (Qn1) 4402 and (Qn2) 4403 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty fifth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

A twenty sixth embodiment of the present invention will now be described in detail with reference to the figures. FIG.

47 is a diagram showing a twenty sixth embodiment of a liquid crystal display device of the present invention. As shown in the figure, the liquid crystal display device of the present invention comprises: a first n-type MOS transistor (Qn1) 4701 with a gate electrode connected to a scanning line 101, and one of a source electrode and a drain electrode connected to a signal line 102; a second n-type MOS transistor (Qn2) 4702 with a gate electrode connected to the other of the source electrode and the drain electrode of the first n-type MOS transistor (Qn1) 4701, and one of a source electrode and a drain electrode connected to a reset pulse power supply VR 3704, and the other of the source electrode and the drain electrode connected to a pixel electrode 107; a voltage holding capacitor 106 formed between the gate electrode of the second n-type MOS transistor (Qn2) 4702 and a voltage holding capacitor electrode 105; a resistor RL 4703 connected between the pixel electrode 107 and the voltage holding capacitor electrode 105; and a liquid crystal 109 which is to be switched, disposed between the pixel electrode 107 and an opposing electrode 108. Here the first and second n-type MOS transistors (Qn1) 4701 and (Qn2) 4702 are constituted by p-SiTFTs.

Moreover, the value of the resistor RL 4703, as with the sixth embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 4703, have the relation shown by the previously mentioned equation (1).

For example, in the case when the resistance Rsp is 5 GΩ, then the value of the resistor RL 4703 is set to a value of around 1 GΩ. A value of 1 GΩ which is a large resistance not used in normal semiconductor integrated circuits, is formed from a semiconductor thin film or a semiconductor thin film which has been doped with impurities, as explained in the second embodiment.

Figure 47:
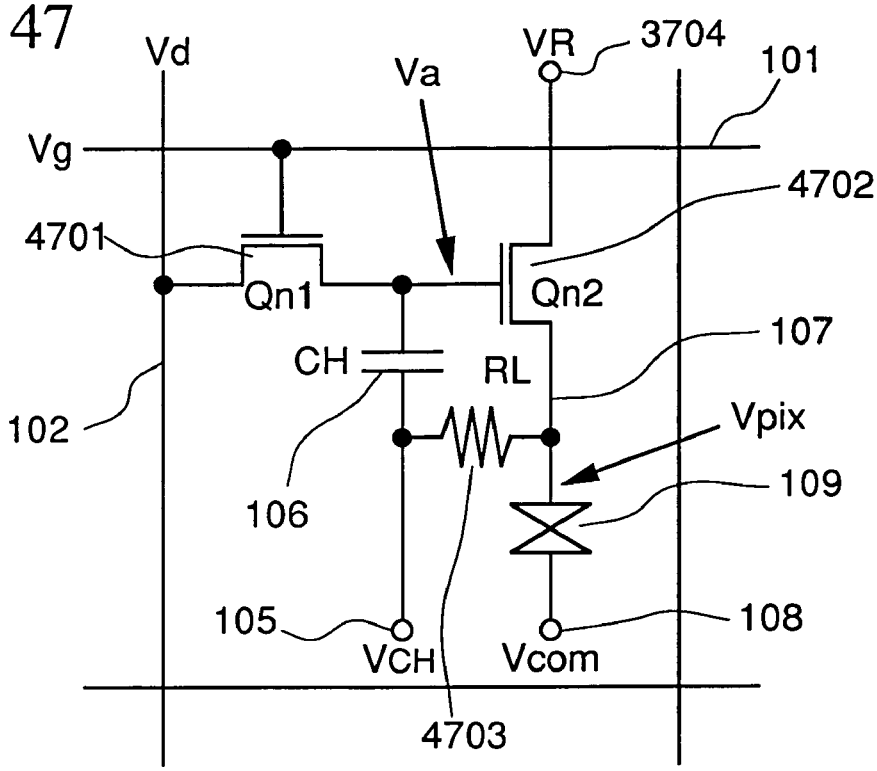
FIG. 47 is a diagram showing a twenty sixth embodiment of a liquid crystal display device of the present invention.

That is to say, the construction and manufacturing method for the case where the resistor RL 4703 is formed from a lightly doped n-type semiconductor thin film (n−) are the same as shown in FIG. 16. Moreover, the construction and manufacturing method for the case where the resistor RL 4703 is formed from a semiconductor thin film (i layer) which has not been doped with impurities are the same as shown in FIG. 17. Furthermore, the construction and manufacturing method for the case where the resistor RL 4703 is formed from a lightly doped p-type semiconductor thin film (p−) are the same as shown in FIG. 18. In the above, the description has been for the case where the resistor RL 4703 shown in FIG. 47 is formed from a semiconductor thin film or a semiconductor thin film doped with impurities. However provided the resistance satisfies equation (1), then other materials may be employed.

Figure 48:
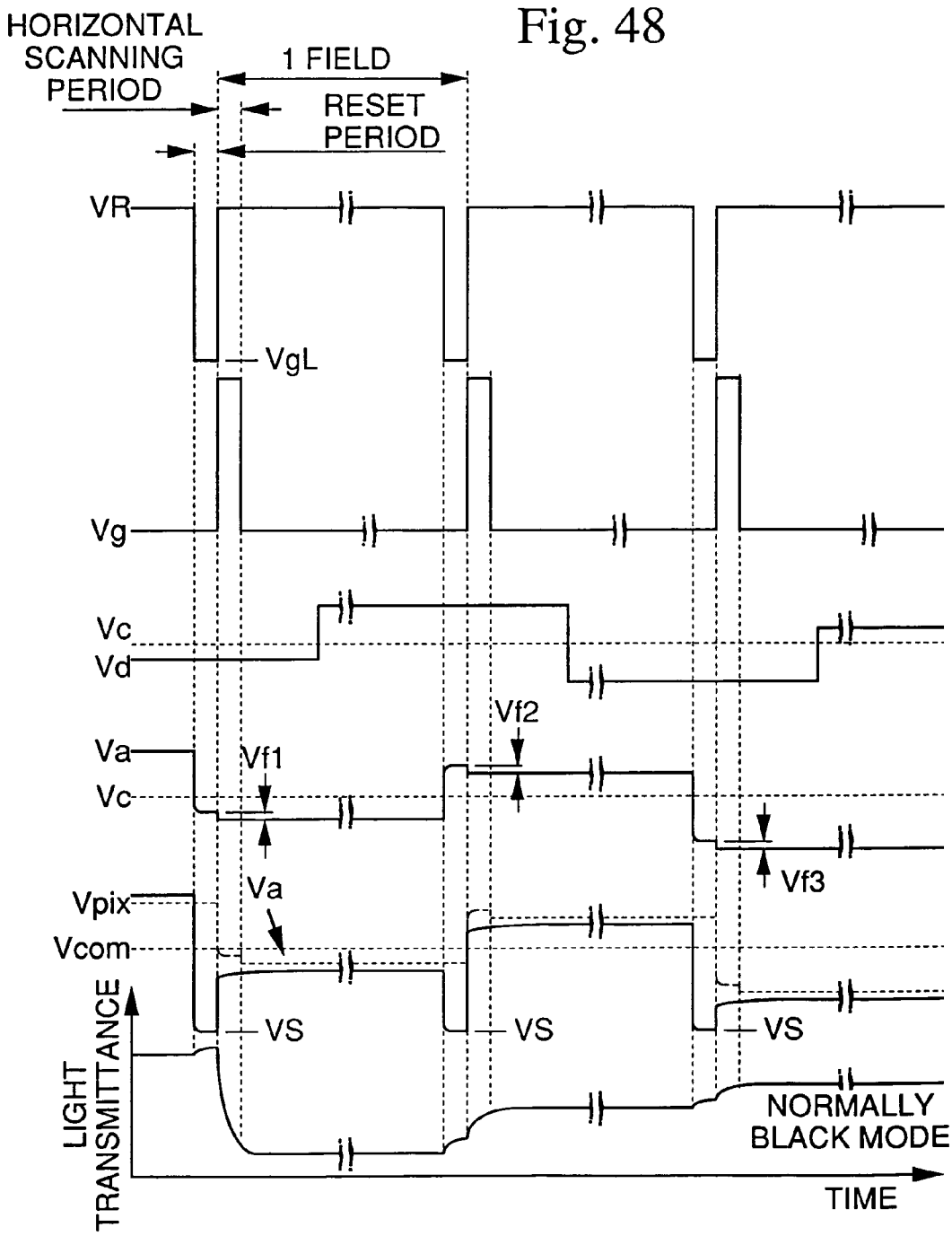
FIG. 48 is a diagram illustrating a drive method for the liquid crystal display device of the present invention.

As follows is a description of the drive method for the liquid crystal display device using the pixel construction shown in FIG. 47. FIG. 48 shows the timing chart, and the change in light transmittance of the liquid crystal, for a gate scanning voltage Vg, a data signal voltage Vd, a gate voltage Va of the second n-type MOS transistor (Qn2) 4702, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 47. Here the example is given for when the liquid crystal operates in a normally black mode, becoming dark when a voltage is not applied.

As shown in the figure, in the period where the reset pulse voltage VR becomes a low level VgL, the pixel electrode 107 attains the reset state due to the gate scanning voltage VgL being transferred through the second n-type MOS transistor (Qn2) 4702. Here as described below, the second n-type MOS transistor (Qn2) 4702 operates as a source follower type analog amplifier, after the reset pulse voltage VR becomes a high level. However, due to the pixel voltage Vpix becoming VgL in the period where the reset pulse voltage VR is a low level, the resetting of the second n-type MOS transistor (Qn2) 4702 is performed.

Then in the period immediately after the period where the reset pulse voltage VR becomes a low level VgL, where the gate scanning voltage Vg becomes a high level VgH, the first n-type MOS transistor (Qn1) 4701 comes on, and the data signal Vd input to the signal line is transferred to the gate electrode of the second n-type MOS transistor (Qn2) 4702 through the first n-type MOS transistor (Qn1) 4701. When the horizontal scanning period is completed and the gate scanning voltage Vg becomes a low level, the first n-type MOS transistor (Qn1) 4701 goes off, and the data signal transferred to the gate electrode of the second n-type MOS transistor (Qn2) 4702 is held by the voltage holding capacitor 105. At this time, with the gate input voltage Va of the second n-type MOS transistor (Qn2) 4702, at the time when the first n-type MOS transistor (Qn1) 4701 goes off, a voltage shift referred to as a feed-through voltage occurs through the capacitance between the gate and the source of the first n-type MOS transistor (Qn1) 4701. In FIG. 48 this is shown by Vf1, Vf2 and Vf3. The amount of this voltage shift Vf1, Vf2 and Vf3 can be made smaller by designing the value for the voltage holding capacitor 105 to be large. The gate input voltage Va of the second n-type MOS transistor (Qn2) 4702 is held until the gate scanning voltage Vg again becomes a low level in the subsequent field period and the first n-type MOS transistor (Qn1) 4701 is selected.

On the other hand, the second n-type MOS transistor (Qn2) 4702, on completion of resetting in the reset period where the reset pulse voltage VR becomes a low level VgL, operates from the horizontal scanning period and thereafter as a source follower type analog amplifier with the pixel electrode 107 as the source electrode. At this time, in order to operate the second n-type MOS transistor (Qn2) 4702 as an analog amplifier, a voltage at least lower than (Vdmin-Vtn) is supplied to the voltage holding capacitor electrode 105. Here Vdmin is the minimum value of the data signal voltage Vd, while Vtn is the threshold value voltage of the second n-type MOS transistor (Qn2) 4702. The second n-type MOS transistor (Qn2) 4702, during the period until the reset pulse voltage VR in the next field becomes VgL to thus execute reset, can output an analog gradation voltage corresponding to the held gate input voltage Va. This output voltage changes depending on the transconductance gmn of the second n-type MOS transistor (Qn2) 4702 and the value of the resistor RL 4703, however it is generally represented by the previously mentioned equation (4).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 48, it becomes possible to obtain a desired gradation for each one field.

Figure 49:
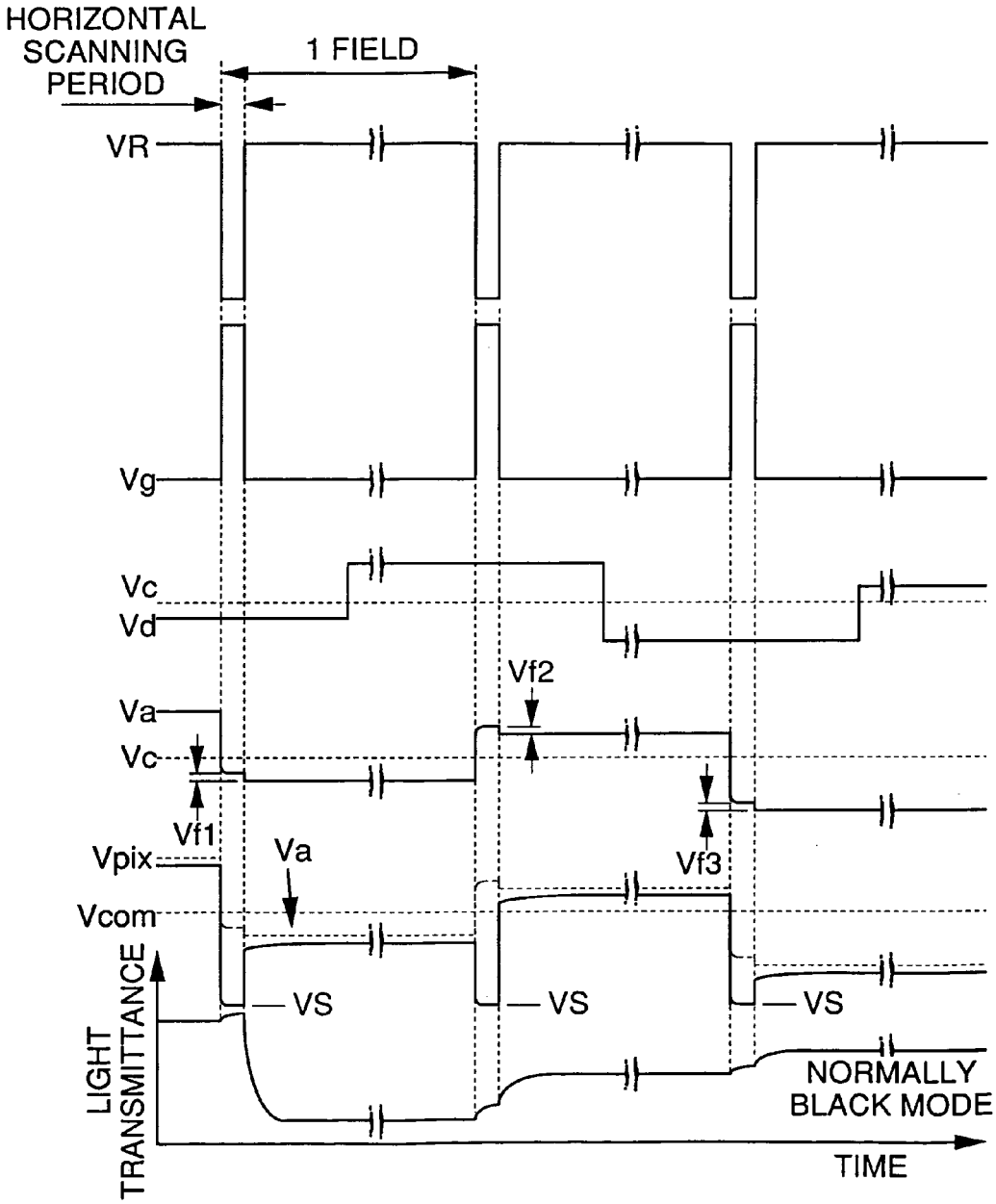
FIG. 49 is a diagram illustrating a drive method for the liquid crystal display device of the present invention.

Furthermore, with the above drive method, the reset period is provided before the horizontal scanning period. However, it is also possible to drive such that the reset period and the horizontal scanning period have the same timing. In this case, selection of the pixel and the resetting of the second n-type MOS transistor (Qn2) 4702 are performed at the same time. The timing chart for this case is shown in FIG. 49.

Moreover, with the liquid crystal display device of the present invention, the construction is such that resetting of the second n-type MOS transistor (Qn2) 4702 which operates as an analog amplifier is performed by the second n-type MOS transistor (Qn2) 4702 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the second and tenth embodiments, this has the advantage that the delay of the scanning pulse signal accompanying resetting of the amplifier can be eliminated.

Moreover, with the present embodiment, since the pixel portion is made from an n-type MOS transistor, there is the advantage that the manufacturing process is simplified.

Furthermore, with the abovementioned embodiment, it was noted that the first n-type MOS transistor (Qn1) 4701 and the second n-type MOS transistor (Qn2) 4702 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 48 and FIG. 49 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 47, the second n-type MOS transistor (Qn2) 4702 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the twenty sixth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 50:
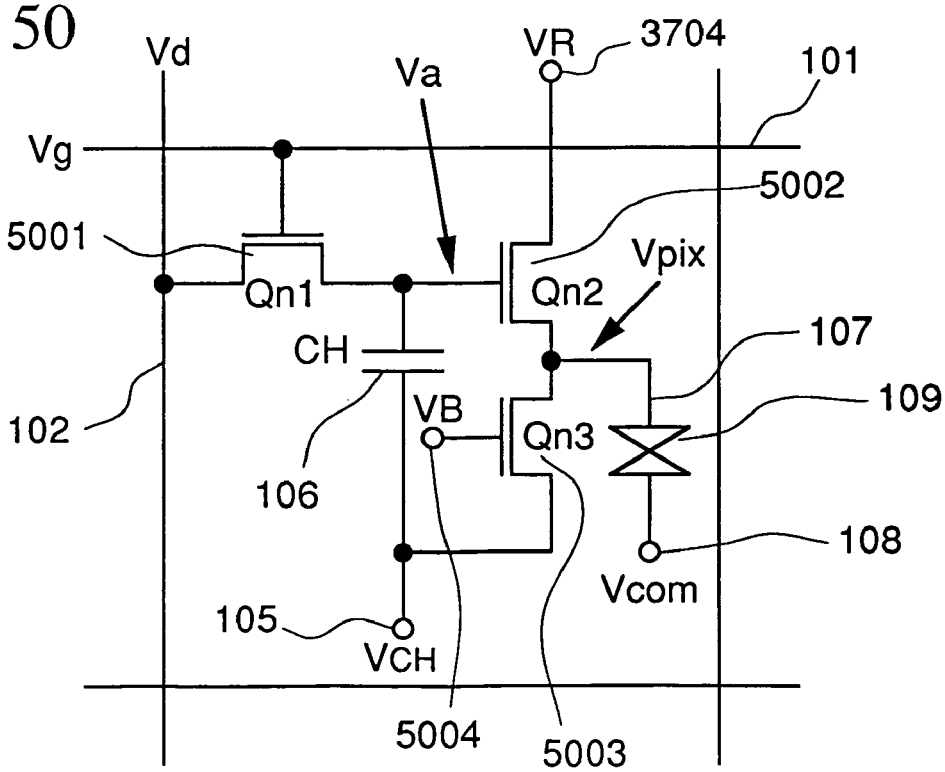
FIG. 50 is a diagram showing a twenty seventh embodiment of a liquid crystal display device of the present invention.

A twenty seventh embodiment of the present invention will now be described in detail with reference to the figures. FIG. 50 is a diagram showing a twenty seventh embodiment of a liquid crystal display device of the present invention. As shown in the figure, the liquid crystal display device of the present invention comprises: a first n-type MOS transistor (Qn1) 5001 with a gate electrode connected to a scanning line 101, and one of a source electrode and a drain electrode connected to a signal line 102; a second n-type MOS transistor (Qn2) 5002 with a gate electrode connected to the other of the source electrode and the drain electrode of the first n-type MOS transistor (Qn1) 5001, and one of a source electrode and a drain electrode connected to a reset pulse power supply VR 3704, and the other of the source electrode and the drain electrode connected to a pixel electrode 107; a voltage holding capacitor 106 formed between the gate electrode of the second n-type MOS transistor (Qn2) 5002 and a voltage holding capacitor electrode 105; a third n-type MOS transistor (Qn3) 5003 with a gate electrode connected to a bias power supply VB 5004, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the first n-type MOS transistor (Qn1) 5001 and the second and third n-type MOS transistors (Qn2) 5002 and (Qn3) 5003 are constituted by p-SiTFTs. Moreover, the bias power supply VB 5004 for supply to the gate electrode of the third n-type MOS transistor (Qn3) 5003, is set so that a source-drain resistance Rdsn of the third n-type MOS transistor (Qn3) 5003 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previously mentioned equation (5).

For example, in the case when the resistance Rsp is 5 GΩ, then a bias power supply VB 5004 such that the source-drain resistance Rdsn does not exceed 1 GΩ is supplied. At this time, the drain current-gate current characteristics of the third n-type MOS transistor (Qn3) 5003, and the operating point are the same as shown in FIG. 23. That is, with the example in FIG. 23, the gate-source voltage (VB−VCH) of the third n-type MOS transistor (Qn3) 5003 is set to around 3V. As a result, when the drain current of the third n-type MOS transistor (Qn3) 5003 becomes around 1E-8 (A) and the source-drain voltage Vdsn is 10V, then the source-drain resistance Rdsn becomes 1 GΩ. Furthermore, even if the third n-type MOS transistor (Qn3) 5003 is operated in the weakly inverted region with the source-drain voltage Vdsn changing from 2 to 14V, the drain current is approximately constant. The third n-type MOS transistor (Qn3) 5003 is operated as the bias current power supply for the case where the second n-type MOS transistor (Qn2) 5002 is operated as an analog amplifier.

The above described drive method for the liquid crystal display device of the twenty seventh embodiment shown in FIG. 50 is the same as the drive method for the liquid crystal display device of the twenty sixth embodiment shown beforehand with reference to FIG. 48 and FIG. 49. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 48 and FIG. 49. Moreover, also in the case where a TN liquid crystal is driven using the liquid crystal display device shown in FIG. 50, this can be driven with the same drive method as shown in FIG. 48 and FIG. 49.

That is to say, if the liquid crystal display device shown in FIG. 50 is used, then as with the twenty sixth embodiment, the fluctuations of the pixel voltage Vpix accompanying the response of the liquid crystal can be eliminated, enabling a desired gradation to be obtained for each one field.

Moreover, with the liquid crystal display device shown in FIG. 50, the construction is such that resetting of the second n-type MOS transistor (Qn2) 5002 which operates as an analog amplifier, is performed by the second n-type MOS transistor (Qn2) 5002 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR 3704 is provided separately, then compared to the liquid crystal display device described in the third and eleventh embodiments, this has the advantage that the delay of the scanning pulse signal accompanying resetting of the amplifier can be eliminated.

Moreover, with the present embodiment, since the pixel portion is made from an n-type MOS transistor, there is the advantage that the manufacturing process is simplified.

Furthermore, with the abovementioned embodiment, it was noted that the first n-type MOS transistor (Qn1) 5001 and the second and third n-type MOS transistors (Qn2) 5002 and (Qn3) 5003 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty seventh embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 51:
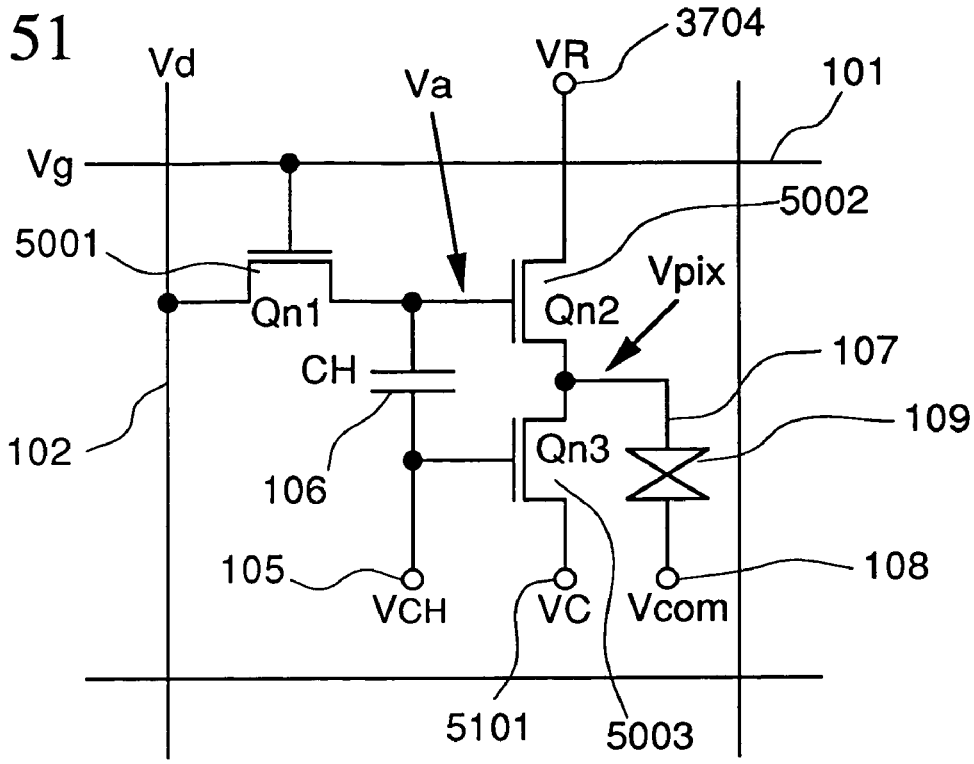
FIG. 51 is a diagram showing a twenty eighth embodiment of a liquid crystal display device of the present invention.

A twenty eighth embodiment of the present invention will now be described in detail with reference to the figures. FIG. 51 is a diagram showing a twenty eighth embodiment of a liquid crystal display device of the present invention. As shown in the figure, the liquid crystal display device of the present invention comprises: a first n-type MOS transistor (Qn1) 5001 with a gate electrode connected to a scanning line 101, and one of a source electrode and a drain electrode connected to a signal line 102; a second n-type MOS transistor (Qn2) 5002 with a gate electrode connected to the other of the source electrode and the drain electrode of the first n-type MOS transistor (Qn1) 5001, and one of a source electrode and a drain electrode connected to a reset pulse power supply VR 3704, and the other of the source electrode and the drain electrode connected to a pixel electrode 107; a voltage holding capacitor 106 formed between the gate electrode of the second n-type MOS transistor (Qn2) 5002 and a voltage holding capacitor electrode 105; a third n-type MOS transistor (Qn3) 5003 with a gate electrode connected to the voltage holding capacitor electrode 105, a source electrode connected to a source power supply VS 5101, and a drain electrode connected to the pixel electrode 107; and a liquid crystal 109 which is to be switched, disposed between the pixel electrode 107 and an opposing electrode 108. Here the first n-type MOS transistor (Qn1) 5001 and the second and third n-type MOS transistors (Qn2) 5002 and (Qn3) 5003 are constituted by p-SiTFTs.

Moreover, the source power supply VS 5101 for supply to the gate electrode of the third n-type MOS transistor (Qn3) 5003, is set so that a source-drain resistance Rdsn of the third n-type MOS transistor (Qn3) 5003 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsn, have the relation shown by the previously mentioned equation (5). For example, in the case when the resistance Rsp is 5 GΩ, then a source power supply VS 5101 such that the source-drain resistance Rdsn does not exceed 1 GΩ is supplied. The operating point for the third n-type MOS transistor (Qn3) 5003 is the same as the beforementioned operating point shown in FIG. 23. That is, with the example in FIG. 23, the gate-source voltage (VCH–VS) of the third n-type MOS transistor (Qn3) 5003 is set to around 3V. As a result, when the drain current of the third n-type MOS transistor (Qn3) 5003 becomes around 1E-8 (A) and the source-drain voltage Vdsn is 10V, then the source-drain resistance Rdsn becomes 1 GΩ. Furthermore, even if the third n-type MOS transistor (Qn3) 5003 is operated in the weakly inverted region with the source-drain voltage Vdsn changing from 2 to 14V, the drain current is approximately constant. The third n-type MOS transistor (Qn3) 5003 is operated as the bias current power supply for the case where the second n-type MOS transistor (Qn2) 5002 is operated as an analog amplifier.

The above described drive method for the liquid crystal display device of the twenty eighth embodiment shown in FIG. 51 is the same as the drive method for the liquid crystal display device of the twenty sixth and twenty seventh embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 48 and FIG. 49. Moreover, also in the case where a TN liquid crystal is driven using the liquid crystal display device shown in FIG. 51, this can be driven with the same drive method as shown in FIG. 48 and FIG. 49.

That is to say, if the liquid crystal display device shown in FIG. 51 is used, then as with the twenty sixth and twenty seventh embodiments, the fluctuations of the pixel voltage Vpix accompanying the response of the liquid crystal can be eliminated, enabling a desired gradation to be obtained for each one field.

Moreover, with the liquid crystal display device shown in FIG. 51, the construction is such that resetting of the second n-type MOS transistor (Qn2) 5002 which operates as an analog amplifier, is performed by the second n-type MOS transistor (Qn2) 5002 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the fourth and twelfth embodiments, this has the advantage that the delay of the scanning pulse signal accompanying resetting of the amplifier can be eliminated.

Moreover, with the present embodiment, since the pixel portion is made from an n-type MOS transistor, there is the advantage that the manufacturing process is simplified.

Furthermore, with the abovementioned embodiment, it was noted that the first n-type MOS transistor (Qn1) 5001 and the second and third n-type MOS transistors (Qn2) 5002 and (Qn3) 5003 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty eighth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 52:
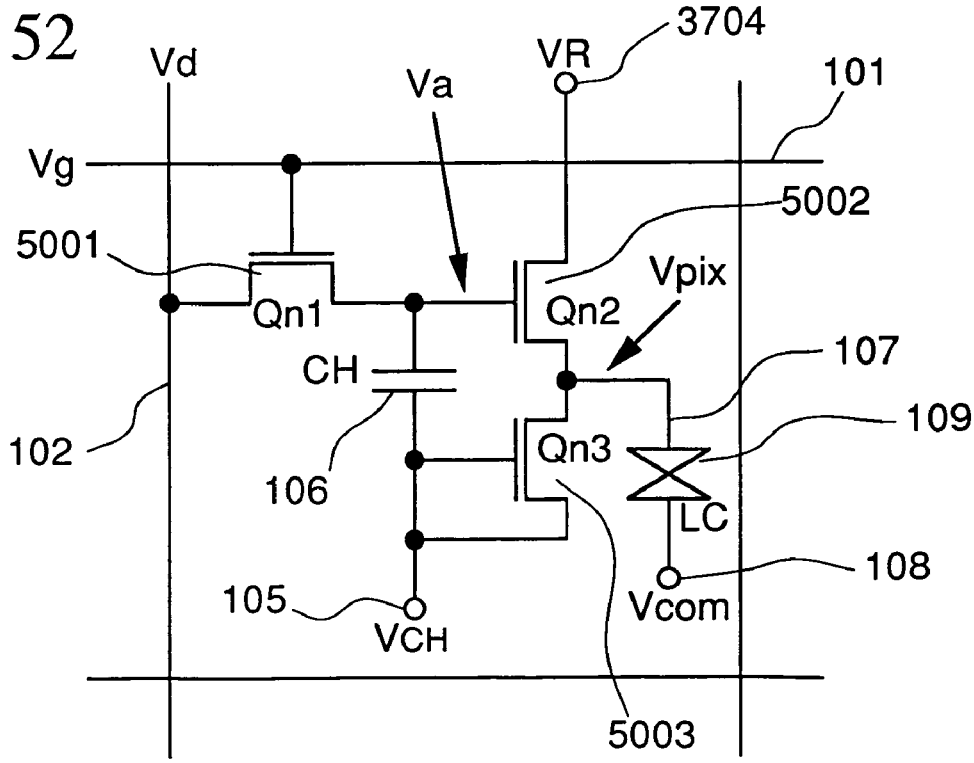
FIG. 52 is a diagram showing a twenty ninth embodiment of a liquid crystal display device of the present invention.

A twenty ninth embodiment of the present invention will now be described in detail with reference to the figures. FIG. 52 is a diagram showing a twenty ninth embodiment of a liquid crystal display device of the present invention. As shown in the figure, the liquid crystal display device of the present invention comprises: a first n-type MOS transistor (Qn1) 5001 with a gate electrode connected to a scanning line 101, and one of a source electrode and a drain electrode connected to a signal line 102; a second n-type MOS transistor (Qn2) 5002 with a gate electrode connected to the other of the source electrode and the drain electrode of the first n-type MOS transistor (Qn1) 5001, and one of a source electrode and a drain electrode connected to a reset pulse power supply VR 3704, and the other of the source electrode and the drain electrode connected to a pixel electrode 107; a voltage holding capacitor 106 formed between the gate electrode of the second n-type MOS transistor (Qn2) 5002 and a voltage holding capacitor electrode 105; a third n-type MOS transistor (Qn3) 5003 with a gate electrode and a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the first n-type MOS transistor (Qn1) 5001 and the second and third n-type MOS transistors (Qn2) 5002 and (Qn3) 5003 are constituted by p-SiTFTs.

Furthermore, since the gate electrode and the source electrode of the third n-type MOS transistor (Qn3) 5003 are both connected to the voltage holding capacitor electrode 105, then the gate-source voltage Vgsn of the third n-type MOS transistor (Qn3) 5003 becomes 0V. Under this bias condition, so that the source-drain resistance Rdsn of the third n-type MOS transistor (Qn3) 5003 satisfies the beforementioned equation (5), the threshold value voltage of the third n-type MOS transistor (Qn3) 5003 is shift controlled to the negative side by channel-dose. At this time, the drain current-gate current characteristics of the third n-type MOS transistor (Qn3) 5003, and the operating point are the same as shown in FIG. 26. That is, with the example in FIG. 26, the threshold value voltage is shift controlled to the negative side by channel-dose so that when the gate-source voltage is 0V, the drain current becomes approximately 1E-8 (A). As a result, when the drain current of the third n-type MOS transistor (Qn3) 5003 becomes around 1E-8 (A) and the source-drain voltage Vdsn is 10V, then the source-drain resistance Rdsn becomes 1 GΩ. Furthermore, even if the third n-type MOS transistor (Qn3) 5003 is operated in the weakly inverted region with the source-drain voltage Vdsn changing from 2 to 14V, the drain current is approximately constant. The third n-type MOS transistor (Qn3) 5003 is operated as the bias current power supply for the case where the second n-type MOS transistor (Qn2) 5002 is operated as an analog amplifier.

With the twenty ninth embodiment, the bias power supply VB 5004, and the source power supply VS 5101 necessary in the twenty seventh and twenty eighth embodiments are not necessary. However a channel-dose forming step is additionally required.

The above described drive method for the liquid crystal display device of the twenty ninth embodiment shown in FIG. 52 is the same as the drive method for the liquid crystal display device of the twenty sixth through twenty eighth embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 48 and FIG. 49. Moreover, also in the case where a TN liquid crystal is driven using the liquid crystal display device shown in FIG. 52, this can be driven with the same drive method as shown in FIG. 48 and FIG. 49.

That is to say, if the liquid crystal display device shown in FIG. 52 is used, then as with the twenty sixth through twenty eighth embodiments, the fluctuations of the pixel voltage Vpix accompanying the response of the liquid crystal can be eliminated, enabling a desired gradation to be obtained for each one field.

Moreover, with the liquid crystal display device shown in FIG. 52, the construction is such that resetting of the second n-type MOS transistor (Qn2) 5002 which operates as an analog amplifier, is performed by the second n-type MOS transistor (Qn2) 5002 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the fifth and thirteenth embodiments, this has the advantage that the delay of the scanning pulse signal accompanying resetting of the amplifier can be eliminated.

Moreover, with the present embodiment, since the pixel portion is made from an n-type MOS transistor, there is the advantage that the manufacturing process is simplified.

Furthermore, with the abovementioned embodiment, it was noted that the first n-type MOS transistor (Qn1) 5001 and the second and third n-type MOS transistors (Qn2) 5002 and (Qn3) 5003 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the twenty ninth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 53:
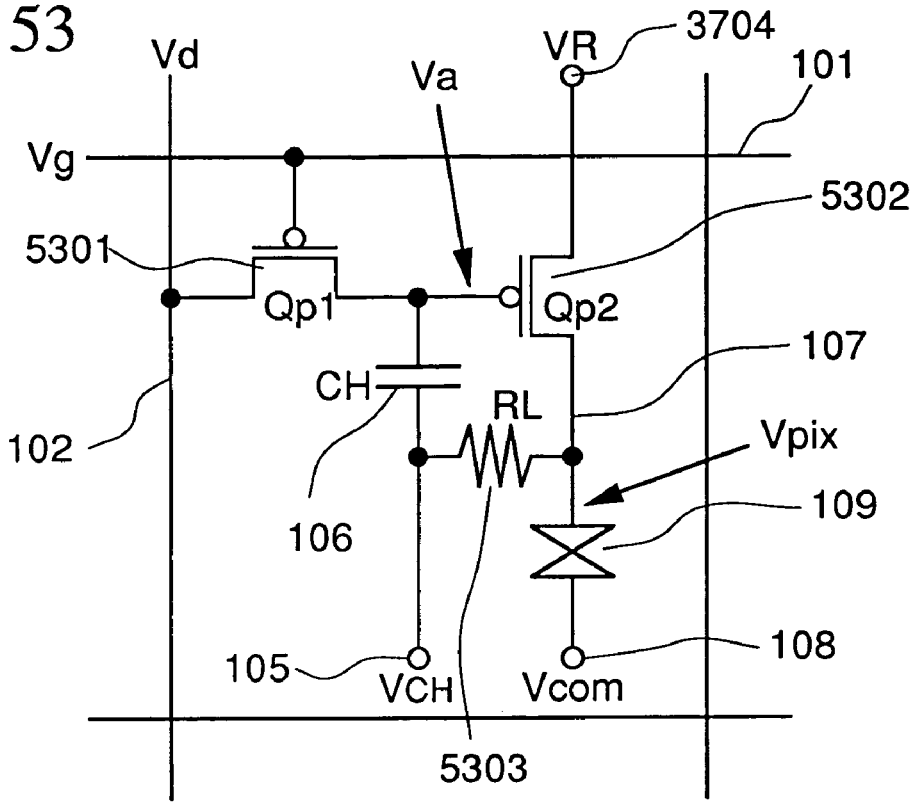
FIG. 53 is a diagram showing a thirtieth embodiment of a liquid crystal display device of the present invention.

A thirtieth embodiment of the present invention will now be described in detail with reference to the figures. FIG. 53 is a diagram showing a thirtieth embodiment of a liquid crystal display device of the present invention. As shown in the figure, the liquid crystal display device of the present invention comprises: a first p-type MOS transistor (Qp1) 5301 with a gate electrode connected to a scanning line 101, and one of a source electrode and a drain electrode connected to a signal line 102; a second p-type MOS transistor (Qp2) 5302 with a gate electrode connected to the other of the source electrode and the drain electrode of the first p-type MOS transistor (Qp1) 5301, and one of a source electrode and a drain electrode connected to a reset pulse power supply VR 3704, and the other of the source electrode and the drain electrode connected to a pixel electrode 107; a voltage holding capacitor 106 formed between the gate electrode of the second p-type MOS transistor (Qp2) 5302 and a voltage holding capacitor electrode 105; a resistor RL 5303 connected between the pixel electrode 107 and the voltage holding capacitor electrode 105; and a liquid crystal 109 which is to be switched, disposed between the pixel electrode 107 and an opposing electrode 108. Here the first and second p-type MOS transistors (Qp1) 5301 and (Qp2) 5302 are constituted by p-SiTFTs.

Moreover, the value of the resistor RL 5303, as with the second embodiment, is set to less than or equal to the value of the resistance component which determines the response time constant of the liquid crystal. That is, the resistances Rr, Rsp in the liquid crystal equivalent circuit shown in FIG. 60 and FIG. 62, and the value of the resistor RL 5303, have the relation shown by the previously mentioned equation (1).

For example, in the case when the resistance Rsp is 5 GΩ, then the value of the resistor RL 5303 is set to a value of around 1 GΩ. A value of 1 GΩ which is a large resistance not used in normal semiconductor integrated circuits, is formed from a semiconductor thin film or a semiconductor thin film which has been doped with impurities, as explained in the second embodiment.

That is to say, the construction and manufacturing method for the case where the resistor RL 5303 is formed from a lightly doped p-type semiconductor thin film (p−) are the same as shown in FIG. 4. Moreover, the construction and manufacturing method for the case where the resistor RL 5303 is formed from a semiconductor thin film (i layer) which has not been doped with impurities are the same as shown in FIG. 5. Furthermore, the construction and manufacturing method for the case where the resistor RL 5303 is formed from a lightly doped n-type semiconductor thin film (n−) are the same as shown in FIG. 6. In the above, the description has been for the case where the resistor RL 5303 shown in FIG. 53 is formed from a semiconductor thin film or a semiconductor thin film doped with impurities. However provided the resistance satisfies equation (1), then other materials may be employed.

Figure 54:
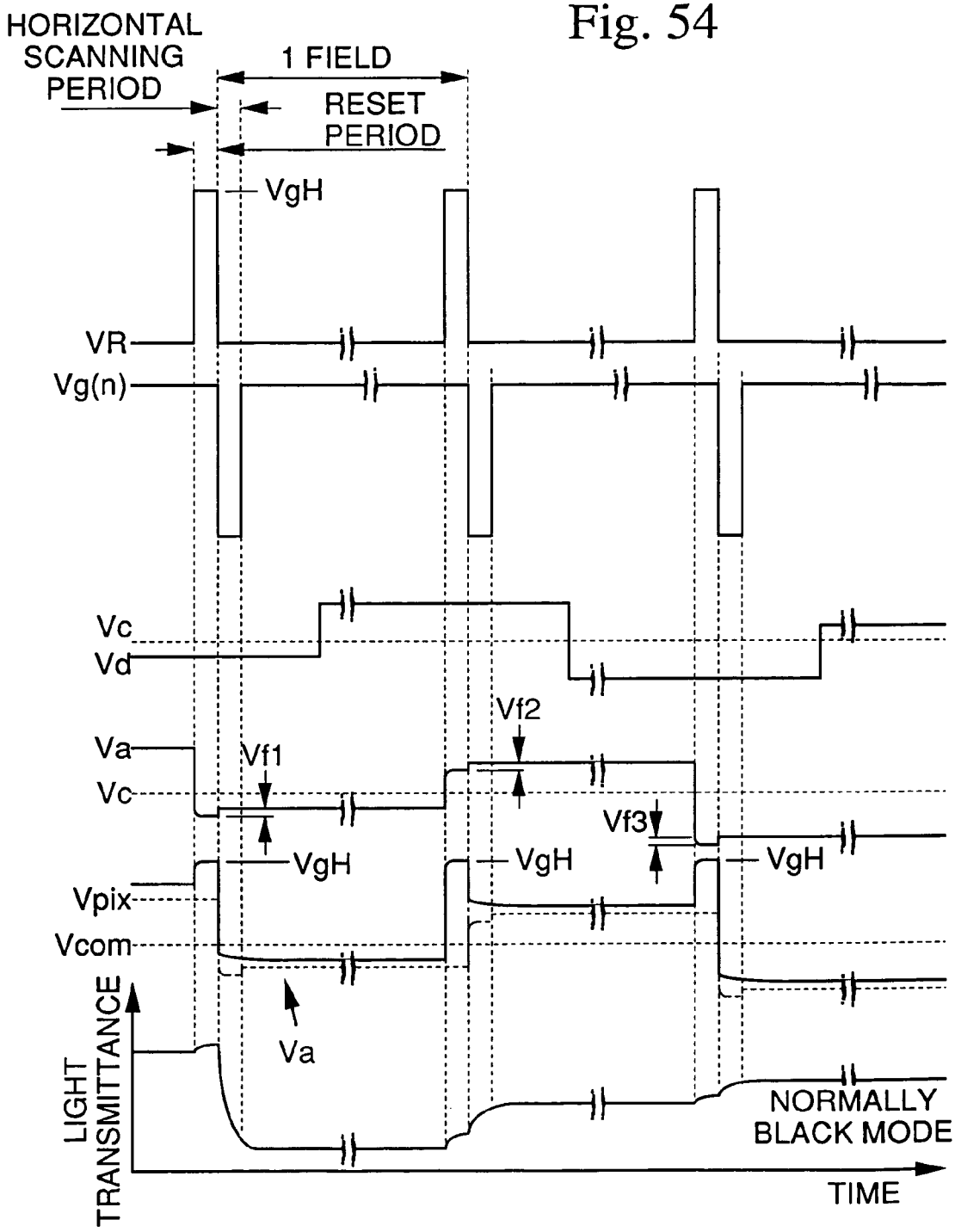
FIG. 54 is a diagram illustrating a drive method for the liquid crystal display device of the present invention.

As follows is a description of the drive method for the liquid crystal display device using the pixel construction shown in FIG. 53. FIG. 54 shows the timing chart, and the change in light transmittance of the liquid crystal, for a gate scanning voltage Vg, a data signal voltage Vd, a gate voltage Va of the second p-type MOS transistor (Qp2) 5302, and a pixel voltage Vpix, for the case where a high speed liquid crystal such as a ferroelectric liquid crystal having polarization, an antiferroelectric liquid crystal, or an OCB mode liquid crystal which responds within one field period, is driven by the pixel construction shown in FIG. 53. Here the example is given for when the liquid crystal operates in a normally black mode, becoming dark when a voltage is not applied.

As shown in the figure, in the period where the reset pulse voltage VR becomes a high level VgH, the pixel electrode 107 attains the reset state due to the gate scanning voltage VgH being transferred through the second p-type MOS transistor (Qp2) 5302. Here as described below, the second p-type MOS transistor (Qp2) 5302 operates as a source follower type analog amplifier, after the reset pulse voltage VR becomes a low level. However, due to the pixel voltage Vpix becoming VgH in the period where the reset pulse voltage VR is a high level, the resetting of the second p-type MOS transistor (Qp2) 5302 is performed.

Then in the period immediately after the period where the reset pulse voltage VR becomes a high level VgH, where the gate scanning voltage Vg becomes a low level VgL, the first p-type MOS transistor (Qp1) 5301 comes on, and the data signal Vd input to the signal line is transferred to the gate electrode of the second p-type MOS transistor (Qp2) 5302 through the first p-type MOS transistor (Qp1) 5301. When the horizontal scanning period is completed and the gate scanning voltage Vg becomes a high level, the first p-type MOS transistor (Qp1) 5301 goes off, and the data signal transferred to the gate electrode of the second p-type MOS transistor (Qp2) 5302 is held by the voltage holding capacitor 105. At this time, with the gate input voltage Va of the second p-type MOS transistor (Qp2) 5302, at the time when the first p-type MOS transistor (Qp1) 5301 goes off, a voltage shift referred to as a feed-through voltage occurs through the capacitance between the gate and the source of the first p-type MOS transistor (Qp1) 5301. In FIG. 54 this is shown by Vf1, Vf2 and Vf3. The amount of this voltage shift Vf1, Vf2 and Vf3 can be made smaller by designing the value for the voltage holding capacitor 105 to be large. The gate input voltage Va of the second p-type MOS transistor (Qp2) 5302 is held until the gate scanning voltage Vg again becomes a low level in the subsequent field period and the first p-type MOS transistor (Qp1) 5301 is selected.

On the other hand, the second p-type MOS transistor (Qp2) 5302, on completion of resetting in the reset period where the reset pulse voltage VR becomes a high level VgH, operates from the horizontal scanning period and thereafter as a source follower type analog amplifier with the pixel electrode 107 as the source electrode. At this time, in order to operate the second p-type MOS transistor (Qp2) 5302 as an analog amplifier, a voltage at least higher than (Vdmax−Vtp) is supplied to the voltage holding capacitor electrode 105. Here Vdmax is the maximum value of the data signal voltage Vd, while Vtp is the threshold value voltage of the second p-type MOS transistor (Qp2) 5302. The second p-type MOS transistor (Qp2) 5302, during the period until the reset pulse voltage VR in the next field becomes VgH to thus execute reset, can output an analog gradation voltage corresponding to the held gate input voltage Va. This output voltage changes depending on the transconductance gmp of the second p-type MOS transistor (Qp2) 5302 and the value of the resistor RL 5303, however it is generally represented by the previously mentioned equation (2).

By using the liquid crystal display device of the present invention as described above, the fluctuations in the pixel voltage Vpix accompanying the response of the liquid crystal as discussed for the conventional technology can be eliminated, and as also shown by the liquid crystal light transmittance in FIG. 54, it becomes possible to obtain a desired gradation for each one field.

Figure 55:
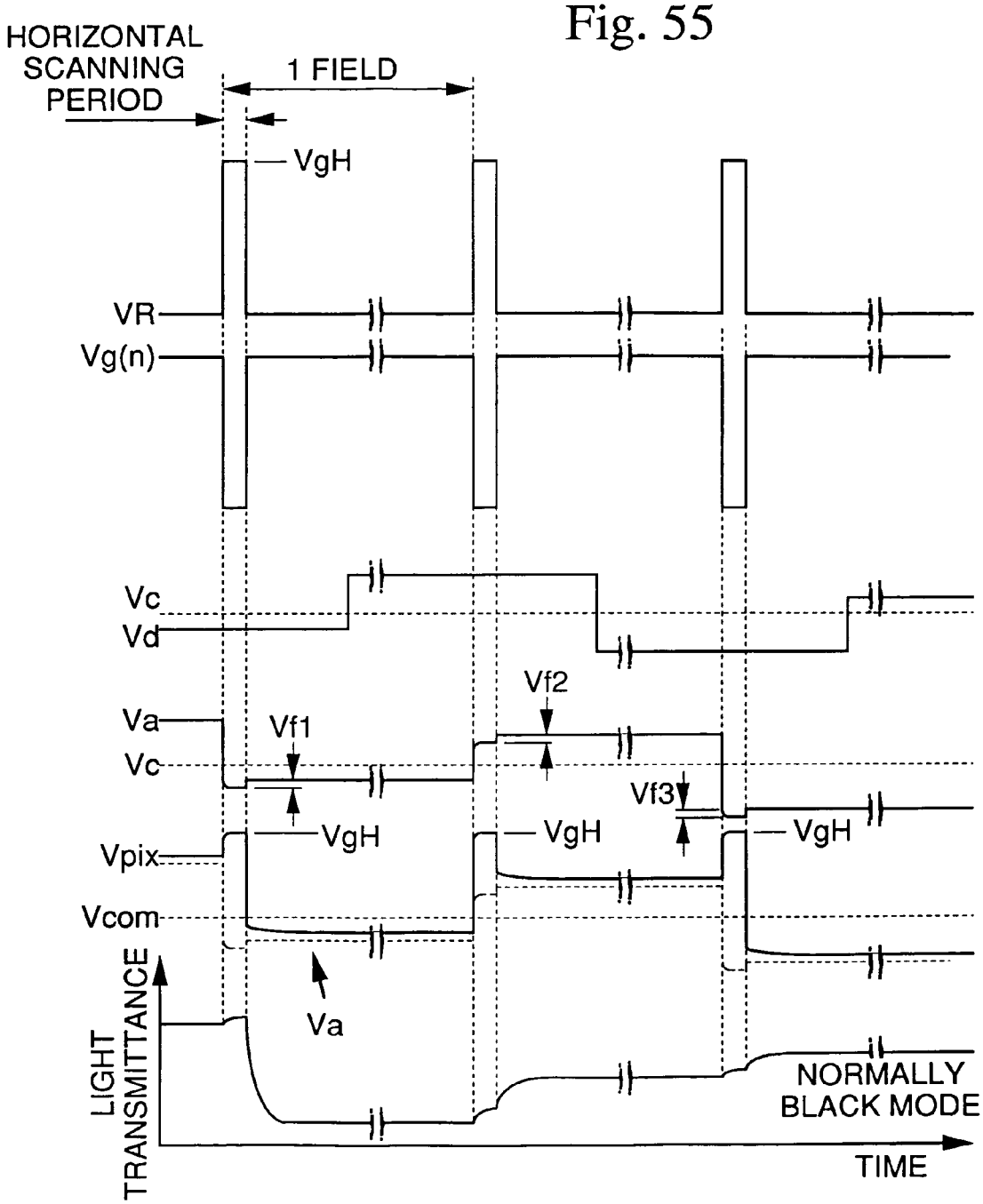
FIG. 55 is a diagram illustrating a drive method for the liquid crystal display device of the present invention.

Furthermore, with the above drive method, the reset period is provided before the horizontal scanning period. However, it is also possible to drive such that the reset period and the horizontal scanning period have the same timing. In this case, selection of the pixel and the resetting of the second p-type MOS transistor (Qp2) 5302 are performed at the same time. The timing chart for this case is shown in FIG. 55.

Moreover, with the liquid crystal display device of the present invention, the construction is such that resetting of the second p-type MOS transistor (Qp2) 5302 which operates as an analog amplifier is performed by the second p-type MOS transistor (Qp2) 5302 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the sixth and fourteenth embodiments, this has the advantage that the delay of the scanning pulse signal accompanying resetting of the amplifier can be eliminated.

Moreover, with the present embodiment, since the pixel portion is made from a p-type MOS transistor, there is the advantage that the manufacturing process is simplified.

Furthermore, with the abovementioned embodiment, it was noted that the first p-type MOS transistor (Qp1) 5301 and the second p-type MOS transistor (Qp2) 5302 were formed from p-SiTFTs. However these may be formed from other thin film transistors such as a-SiTFTs or CdSeTFTs. Furthermore, these may be formed from single crystal silicon transistors.

Driving the TN liquid crystal with a drive method similar to the drive method of FIG. 54 and FIG. 55 is of course also possible. With the conventional liquid crystal display device, the liquid crystal capacitance changes due to the molecules of the TN liquid crystal switching, and as shown in the beforementioned FIG. 61, the pixel voltage Vpix fluctuates, and hence the inherent liquid crystal light transmittance T0 cannot be obtained. On the other hand, with the liquid crystal display device of the present invention shown in FIG. 53, the second p-type MOS transistor (Qp2) 5302 operates as an amplifier, and hence a constant voltage can be applied continuously to the liquid crystal 109 without being influenced by changes in the capacitance of the TN liquid crystal. Therefore the inherent light transmittance can be obtained, and accurate gradation display can be performed.

When the above described liquid crystal display device and drive method of the thirtieth embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 56:
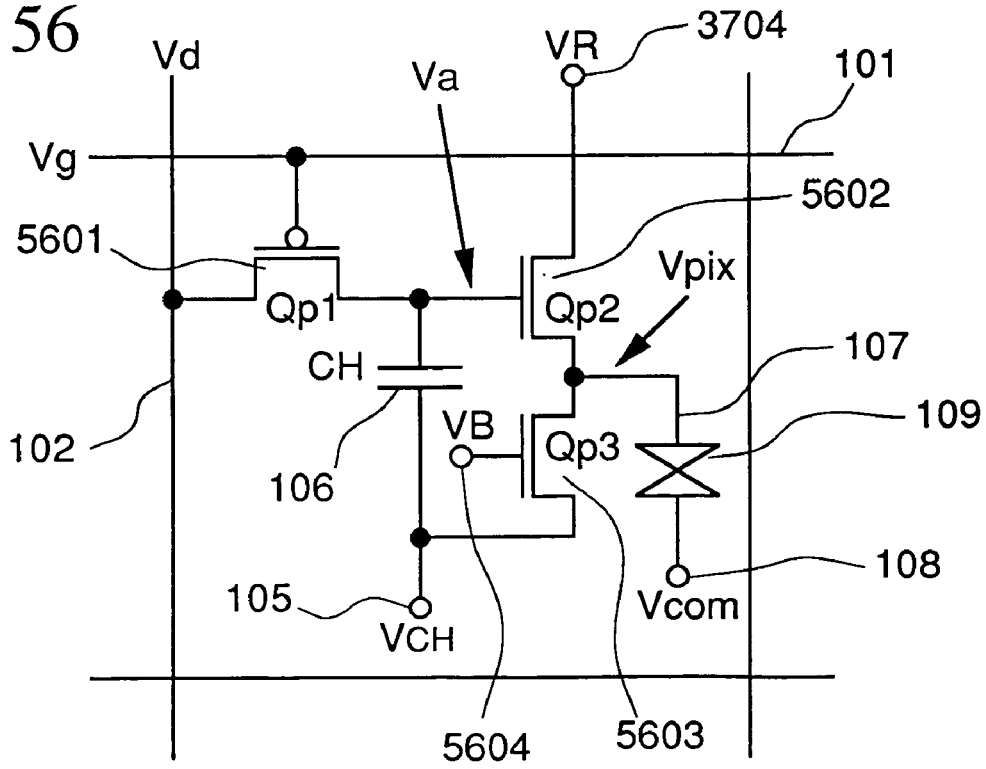
FIG. 56 is a diagram showing a thirty first embodiment of a liquid crystal display device of the present invention.

A thirty first embodiment of the present invention will now be described in detail with reference to the figures. FIG. 56 is a diagram showing a thirty first embodiment of a liquid crystal display device of the present invention. As shown in the figure, the liquid crystal display device of the present invention comprises: a first p-type MOS transistor (Qp1) 5601 with a gate electrode connected to a scanning line 101, and one of a source electrode and a drain electrode connected to a signal line 102; a second p-type MOS transistor (Qp2) 5602 with a gate electrode connected to the other of the source electrode and the drain electrode of the first p-type MOS transistor (Qp1) 5601, and one of a source electrode and a drain electrode connected to a reset pulse power supply VR 3704, and the other of the source electrode and the drain electrode connected to a pixel electrode 107; a voltage holding capacitor 106 formed between the gate electrode of the second p-type MOS transistor (Qp2) 5602 and a voltage holding capacitor electrode 105; a third p-type MOS transistor (Qp3) 5603 with a gate electrode connected to a bias power supply VB 5604, a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the first p-type MOS transistor (Qp1) 5601 and the second and third p-type MOS transistors (Qp2) 5602 and (Qp3) 5603 are constituted by p-SiTFTs. Moreover, the bias power supply VB 5604 for supply to the gate electrode of the third p-type MOS transistor (Qp3) 5603, is set so that a source-drain resistance Rdsp of the third p-type MOS transistor (Qp3) 5603 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previously mentioned equation (3).

For example, in the case when the resistance Rsp is 5 GΩ, then a bias power supply VB 5604 such that the source-drain resistance Rdsp does not exceed 1 GΩ is supplied. At this time, the drain current-gate current characteristics of the third p-type MOS transistor (Qp3) 5603, and the operating point are the same as shown in FIG. 11. That is, with the example in FIG. 11, the gate-source voltage (VB−VCH) of the third p-type MOS transistor (Qp3) 5603 is set to around −3V. As a result, when the drain current of the third p-type MOS transistor (Qp3) 5603 becomes around 1E-8 (A) and the source-drain voltage Vdsp is −10V, then the source-drain resistance Rdsp becomes 1 GΩ. Furthermore, even if the third p-type MOS transistor (Qp3) 5603 is operated in the weakly inverted region with the source-drain voltage Vdsp changing from −2 to −14V, the drain current is approximately constant. The third p-type MOS transistor (Qp3) 5603 is operated as the bias current power supply for the case where the second p-type MOS transistor (Qp2) 5602 is operated as an analog amplifier.

The above described drive method for the liquid crystal display device of the thirty first embodiment shown in FIG. 56 is the same as the drive method for the liquid crystal display device of the thirtieth embodiment shown beforehand with reference to FIG. 54 and FIG. 55. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 54 and FIG. 55. Moreover, also in the case where a TN liquid crystal is driven using the liquid crystal display device shown in FIG. 56, this can be driven with the same drive method as shown in FIG. 54 and FIG. 55.

That is to say, if the liquid crystal display device shown in FIG. 56 is used, then as with the thirtieth embodiment, the fluctuations of the pixel voltage Vpix accompanying the response of the liquid crystal can be eliminated, enabling a desired gradation to be obtained for each one field.

Moreover, with the liquid crystal display device shown in FIG. 56, the construction is such that resetting of the second p-type MOS transistor (Qp2) 5602 which operates as an analog amplifier, is performed by the second p-type MOS transistor (Qp2) 5602 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR 3704 is provided separately, then compared to the liquid crystal display device described in the seventh and fifteenth embodiments, this has the advantage that the delay of the scanning pulse signal accompanying resetting of the amplifier can be eliminated.

Moreover, with the present embodiment, since the pixel portion is made from a p-type MOS transistor, there is the advantage that the manufacturing process is simplified.

Furthermore, with the abovementioned embodiment, it was noted that the first p-type MOS transistor (Qp1) 5601 and the second and third p-type MOS transistors (Qp2) 5602 and (Qp3) 5603 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the thirty first embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 57:
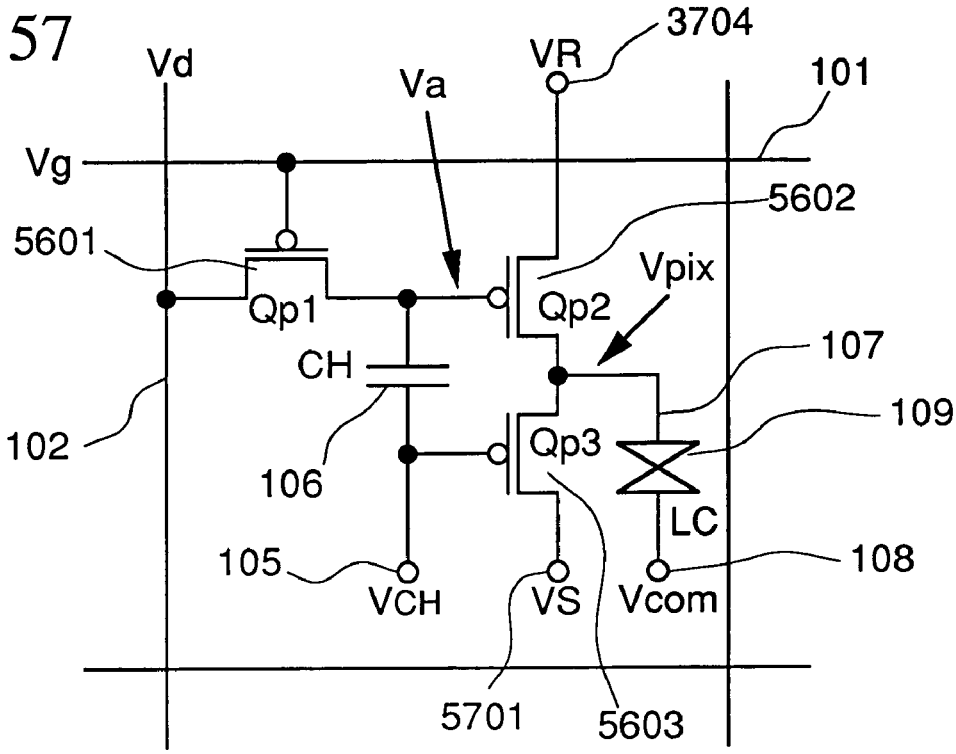
FIG. 57 is a diagram showing a thirty second embodiment of a liquid crystal display device of the present invention.

A thirty second embodiment of the present invention will now be described in detail with reference to the figures. FIG. 57 is a diagram showing a thirty second embodiment of a liquid crystal display device of the present invention. As shown in the figure, the liquid crystal display device of the present invention comprises: a first p-type MOS transistor (Qp1) 5601 with a gate electrode connected to a scanning line 101, and one of a source electrode and a drain electrode connected to a signal line 102; a second p-type MOS transistor (Qp2) 5602 with a gate electrode connected to the other of the source electrode and the drain electrode of the first p-type MOS transistor (Qp1) 5601, and one of a source electrode and a drain electrode connected to a reset pulse power supply VR 3704, and the other of the source electrode and the drain electrode connected to a pixel electrode 107; a voltage holding capacitor 106 formed between the gate electrode of the second p-type MOS transistor (Qp2) 5602 and a voltage holding capacitor electrode 105; a third p-type MOS transistor (Qp3) 5603 with a gate electrode connected to the voltage holding capacitor electrode 105, a source electrode connected to a source power supply VS 5701, and a drain electrode connected to the pixel electrode 107; and a liquid crystal 109 which is to be switched, disposed between the pixel electrode 107 and an opposing electrode 108. Here the first p-type MOS transistor (Qp1) 5601 and the second and third p-type MOS transistors (Qp2) 5602 and (Qp3) 5603 are constituted by p-SiTFTs.

Moreover, the source power supply VS 5701 for supply to the gate electrode of the third p-type MOS transistor (Qp3) 5603, is set so that a source-drain resistance Rdsp of the third p-type MOS transistor (Qp3) 5603 becomes less than or equal to the value of the resistance component which determines the response time constant of the liquid crystal. That is, the resistances Rr, Rsp in the liquid crystal equivalent circuit shown in FIG. 60 and FIG. 62, and the source-drain resistance Rdsp, have the relation shown by the previously mentioned equation (3). For example, in the case when the resistance Rsp is 5 GΩ, then a source power supply VS 5701 such that the source-drain resistance Rdsp does not exceed 1 GΩ is supplied. The operating point for the third p-type MOS transistor (Qp3) 5603 is the same as the beforementioned operating point shown in FIG. 11. That is, with the example in FIG. 11, the gate-source voltage (VCH−VS) of the third p-type MOS transistor (Qp3) 5603 is set to around −3V. As a result, when the drain current of the third p-type MOS transistor (Qp3) 5603 becomes around 1E-8 (A) and the source-drain voltage Vdsp is −10V, then the source-drain resistance Rdsp becomes 1 GΩ. Furthermore, even if the third p-type MOS transistor (Qp3) 5603 is operated in the weakly inverted region with the source-drain voltage Vdsp changing from −2 to −14V, the drain current is approximately constant. The third p-type MOS transistor (Qp3) 5603 is operated as the bias current power supply for the case where the second p-type MOS transistor (Qp2) 5602 is operated as an analog amplifier.

The above described drive method for the liquid crystal display device of the thirty second embodiment shown in FIG. 57 is the same as the drive method for the liquid crystal display device of the thirtieth and thirty first embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 54 and FIG. 55. Moreover, also in the case where a TN liquid crystal is driven using the liquid crystal display device shown in FIG. 57, this can be driven with the same drive method as shown in FIG. 54 and FIG. 55.

That is to say, if the liquid crystal display device shown in FIG. 57 is used, then as with the thirtieth and thirty first embodiments, the fluctuations of the pixel voltage Vpix accompanying the response of the liquid crystal can be eliminated, enabling a desired gradation to be obtained for each one field.

Moreover, with the liquid crystal display device shown in FIG. 57, the construction is such that resetting of the second p-type MOS transistor (Qp2) 5602 which operates as an analog amplifier, is performed by the second p-type MOS transistor (Qp2) 5602 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the eighth and sixteenth embodiments, this has the advantage that the delay of the scanning pulse signal accompanying resetting of the amplifier can be eliminated.

Moreover, with the present embodiment, since the pixel portion is made from a p-type MOS transistor, there is the advantage that the manufacturing process is simplified.

Furthermore, with the abovementioned embodiment, it was noted that the first p-type MOS transistor (Qp1) 5601 and the second and third p-type MOS transistors (Qp2) 5602 and (Qp3) 5603 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the thirty second embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

Figure 58:
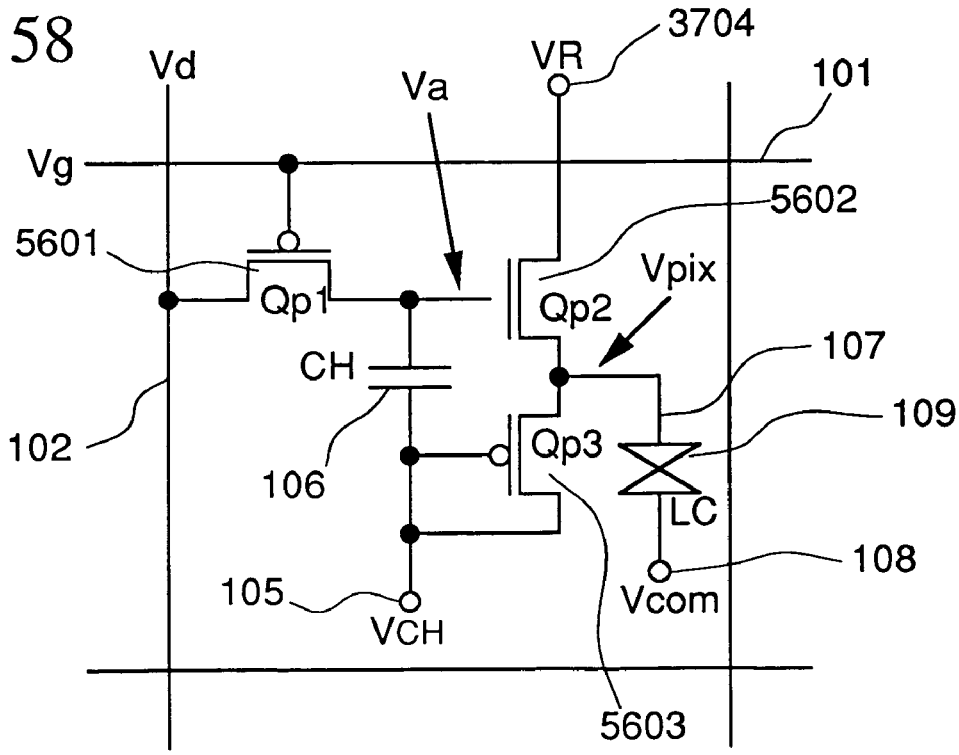
FIG. 58 is a diagram showing a thirty third embodiment of a liquid crystal display device of the present invention.
Figure 59:
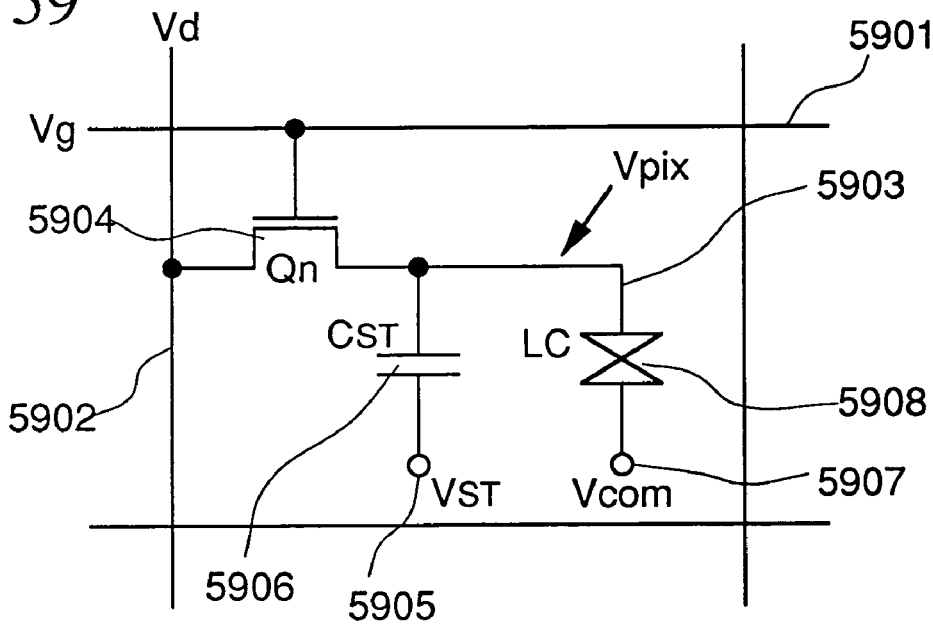
FIG. 59 is a diagram showing the construction of a conventional liquid crystal display device.

A thirty third embodiment of the present invention will now be described in detail with reference to the figures. FIG. 58 is a diagram showing a thirty third embodiment of a liquid crystal display device of the present invention. As shown in the figure, the liquid crystal display device of the present invention comprises: a first p-type MOS transistor (Qp1) 5601 with a gate electrode connected to a scanning line 101, and one of a source electrode and a drain electrode connected to a signal line 102; a second p-type MOS transistor (Qp2) 5602 with a gate electrode connected to the other of the source electrode and the drain electrode of the first p-type MOS transistor (Qp1) 5601, and one of a source electrode and a drain electrode connected to a reset pulse power supply VR 3704, and the other of the source electrode and the drain electrode connected to a pixel electrode 107; a voltage holding capacitor 106 formed between the gate electrode of the second p-type MOS transistor (Qp2) 5602 and a voltage holding capacitor electrode 105; a third p-type MOS transistor (Qp3) 5603 with a gate electrode and a source electrode connected to the voltage holding capacitor electrode 105, and a drain electrode connected to the pixel electrode 107; and a liquid crystal 109 which is to be switched, disposed between the pixel electrode 107 and an opposing electrode 108. Here the first p-type MOS transistor (Qp1) 5601 and the second and third p-type MOS transistors (Qp2) 5602 and (Qp3) 5603 are constituted by p-SiTFTs.

Furthermore, since the gate electrode and the source electrode of the third p-type MOS transistor (Qp3) 5603 are both connected to the voltage holding capacitor electrode 105, then the gate-source voltage Vgsp of the third p-type MOS transistor (Qp3) 5603 becomes 0V. Under this bias condition, so that the source-drain resistance Rdsp of the third p-type MOS transistor (Qp3) 5603 satisfies the beforementioned equation (3), the threshold value voltage of the third p-type MOS transistor (Qp3) 5603 is shift controlled to the positive side by channel-dose. At this time, the drain current-gate current characteristics of the third p-type MOS transistor (Qp3) 5603, and the operating point are the same as shown in FIG. 14. That is, with the example in FIG. 14, the threshold value voltage is shift controlled to the positive side by channel-dose so that when the gate-source voltage is 0V, the drain current becomes approximately 1E-8 (A). As a result, when the drain current of the third p-type MOS transistor (Qp3) 5603 becomes around 1E-8 (A) and the source-drain voltage Vdsp is −10V, then the source-drain resistance Rdsp becomes 1 GΩ. Furthermore, even if the third p-type MOS transistor (Qp3) 5603 is operated in the weakly inverted region with the source-drain voltage Vdsp changing from −2 to −14V, the drain current is approximately constant. The third p-type MOS transistor (Qp3) 5603 is operated as the bias current power supply for the case where the second p-type MOS transistor (Qp2) 5602 is operated as an analog amplifier.

With the thirty third embodiment, the bias power supply VB 5604, and the source power supply VS 5701 necessary in the thirty first and thirty second embodiments are not necessary. However a channel-dose forming step is additionally required.

The above described drive method for the liquid crystal display device of the thirty third embodiment shown in FIG. 58 is the same as the drive method for the liquid crystal display device of the thirtieth through thirty second embodiments explained beforehand. That is, in the case where a high speed liquid crystal such as a ferroelectric liquid crystal having polarization, an antiferroelectric liquid crystal, or an OCB mode liquid crystal which responds within one field period, is driven, the pixel voltage Vpix and the liquid crystal light transmittance are the same as those shown in FIG. 54 and FIG. 55. Moreover, also in the case where a TN liquid crystal is driven using the liquid crystal display device shown in FIG. 58, this can be driven with the same drive method as shown in FIG. 54 and FIG. 55.

That is to say, if the liquid crystal display device shown in FIG. 58 is used, then as with the thirtieth through thirty second embodiments, the fluctuations of the pixel voltage Vpix accompanying the response of the liquid crystal can be eliminated, enabling a desired gradation to be obtained for each one field.

Moreover, with the liquid crystal display device shown in FIG. 58, the construction is such that resetting of the second p-type MOS transistor (Qp2) 5602 which operates as an analog amplifier, is performed by the second p-type MOS transistor (Qp2) 5602 itself. Therefore wiring and circuits such as a power supply lead and a reset switch, become unnecessary. As a result, the analog amplifier can be constructed with a smaller area than heretofore, giving a high aperture efficiency so that a noticeable effect is obtained.

Furthermore, since the reset pulse power supply VR is provided separately, then compared to the liquid crystal display device described in the ninth and seventeenth embodiments, this has the advantage that the delay of the scanning pulse signal accompanying resetting of the amplifier can be eliminated.

Moreover, with the present embodiment, since the pixel portion is made from a p-type MOS transistor, there is the advantage that the manufacturing process is simplified.

Furthermore, with the abovementioned embodiment, it was noted that the first p-type MOS transistor (Qp1) 5601 and the second and third p-type MOS transistors (Qp2) 5602 and (Qp3) 5603 were formed from p-SiTFTs. However these may be formed from other thin film transistors such as a-SiTFTs or CdSeTFTs. Furthermore, these may be formed from single crystal silicon transistors.

When the above described liquid crystal display device and drive method of the thirty third embodiment is applied to a liquid crystal display device with a time division driving method which switches the color of the incident light in one field (one frame) period to perform color display, good color reproduction and high gradation display can be realized. This is because of the characteristic that even in the case where the liquid crystal display device of the present invention drives a high speed liquid crystal such as a ferroelectric liquid crystal having polarization, an antiferroelectric liquid crystal, or an OCB mode liquid crystal which responds within one field period, fluctuations do not occur in the pixel voltage accompanying the response of the liquid crystal, and hence a desired gradation display can be performed for each one field (one frame) period. At this time, for liquid crystal material, a thresholdless antiferroelectric liquid crystal is used.

As described above, by application of the liquid crystal display device and drive method of the present invention, the fluctuation in pixel voltage accompanying the response of the liquid crystal can be eliminated, and hence a more accurate gradation display than heretofore can be realized. In particular, even with a high speed liquid crystal such as a ferroelectric liquid crystal having polarization, an antiferroelectric liquid crystal, or an OCB mode liquid crystal which responds within one field period, drive is possible without the occurrence of fluctuations in the pixel voltage. As a result, it is possible to perform accurate gradation display for each one field (frame), so that even with a liquid crystal display device of a time division driving method, good color reproduction and high gradation display can be realized.

Furthermore, with the liquid crystal display device and drive method of the present invention, the construction is such that the scanning voltage is used as the power supply for the MOS type transistor which operates as an analog amplifier, and as the reset power supply, and resetting of the amplifier is performed by the MOS transistor itself. Therefore, wiring and circuits such as a power supply lead, a reset power supply lead and a reset switch, become unnecessary. Hence, the analog amplifier can be constructed with a smaller area than heretofore, giving a high aperture efficiency so that a noticeable effect is obtained.

Moreover, with the liquid crystal display device and drive method of the present invention, since the load resistance of the source follower type analog amplifier, or the resistance of the active load transistor is a high value of for example 1 GΩ then the steady state consumption current can be kept low.

Due to the above characteristics, a small size, light weight, high aperture efficiency, high speed, high visual field, high gradation, low power consumption, and low cost projector apparatus, notebook PC or monitor liquid crystal display device can be provided.

What is claimed is:

1. An active matrix-type liquid crystal display device comprising a pixel electrode and a MOS transistor circuit, the pixel electrode being driven by the MOS transistor circuit, the MOS transistor circuit disposed in the vicinity of a cross-over point of one of a plurality of scanning lines and one of a plurality of signal lines, the MOS type transistor circuit comprising:

a first MOS transistor, in which a gate electrode is connected to the scanning line, and one of a source electrode and a drain electrode is connected to the signal line; and a source follower type analog amplifier, in which an input electrode is connected to the other one of the source electrode and the drain electrode of the first MOS transistor and one of a plurality of power supply electrodes is connected to the scanning line, and an output electrode is connected to the pixel electrode.

2. An active matrix-type liquid crystal display device according to claim 1, wherein the MOS transistor circuit is formed by integrating thin film transistors.

3. A method of driving an active matrix-type liquid crystal display device comprising a pixel electrode and a MOS transistor circuit, the pixel electrode being driven by the MOS transistor circuit, the MOS transistor circuit disposed in the vicinity of a cross-over point of one of a plurality of scanning lines and one of a plurality of signal lines, the MOS type transistor circuit comprising:

a first MOS transistor, in which a gate electrode is connected to the scanning line, and one of a source electrode and a drain electrode is connected to the signal line; and a source follower type analog amplifier, in which an input electrode is connected to the other one of the source electrode and the drain electrode of the first MOS transistor and one of a plurality of power supply electrodes is connected to the scanning line, and an output electrode is connected to the pixel electrode, the method comprising the steps of:

in a scanning line selection period, storing a data signal in the input electrode of the source follower type analog amplifier through the first MOS transistor by a scanning pulse signal and resetting the source follower type analog amplifier by use of the scanning pulse signal; and after completion of the scanning line selection period, writing signals corresponding to the stored data signal to the pixel electrode through the source follower type analog amplifier.

4. An active matrix-type liquid crystal display device comprising a pixel electrode and a MOS transistor circuit, the pixel electrode being driven by the MOS transistor circuit, the MOS transistor circuit disposed in the vicinity of a cross-over point of a plurality of scanning lines and a plurality of signal lines, the MOS type transistor circuit comprising:

a first MOS transistor, in which a gate electrode is connected to an Nth scanning line, N being an integer of 2 or more, and one of a source electrode and a drain electrode is connected to the signal line; and a source follower type analog amplifier, in which an input electrode is connected to the other one of the source electrode and the drain electrode of the first MOS transistor, one of a plurality of power supply electrodes is connected to an (N−1)th scanning line, and an output electrode is connected to the pixel electrode.

5. A method of driving an active matrix-type liquid crystal display device comprising a pixel electrode and a MOS transistor circuit, the pixel electrode being driven by the MOS transistor circuit, the MOS transistor circuit disposed in the vicinity of a cross-over point of a plurality of scanning lines and a plurality of signal lines, the MOS type transistor circuit comprising:

a first MOS transistor, in which a gate electrode is connected to an Nth scanning line, N being an integer of 2 or more, and one of a source electrode and a drain electrode is connected to the signal line; and a source follower type analog amplifier, in which an input electrode is connected to the other one of the source electrode and the drain electrode of the first MOS transistor, one of a plurality of power supply electrodes is connected to an (N−1)th scanning line, and an output electrode is connected to the pixel electrode, comprising the steps of:

in the (N−1)th scanning line selection period, resetting the source follower type analog amplifier by use of the (N−1)th scanning pulse signal;

in the Nth scanning line selection period, storing a data signal in the input electrode of the source follower type analog amplifier by the Nth scanning pulse signal through the first MOS transistor; and after completion of the Nth scanning line selection period, writing signals corresponding to the stored data to the pixel electrode through the source follower type analog amplifier.

* * * * *